US005803363A

United States Patent [19]

Matsumura et al.

[11] Patent Number: 5,803,363

[45] Date of Patent: Sep. 8, 1998

[54] LIQUID SPRINKLER HAVING A HEMISPHERICAL HEAD WITH A PATTERN OF NOZZLE OPENINGS

[75] Inventors: Shunji Matsumura, Hirakata; Keiichi Fujimoto, Toyonaka; Hiroshi Ota, Kobe, all of Japan

[73] Assignee: Sumitomo Chemical Company, Limited, Osaka, Japan

[21] Appl. No.: 329,578

[22] Filed: Oct. 25, 1994

[30] Foreign Application Priority Data

| | | | |
|---|---|---|---|
| Nov. 2, 1993 | [JP] | Japan | 5-274673 |
| Jun. 30, 1994 | [JP] | Japan | 6-150141 |
| Jun. 30, 1994 | [JP] | Japan | 6-150151 |

[51] Int. Cl.[6] ..... B05B 1/14

[52] U.S. Cl. ..... 239/200; 239/559

[58] Field of Search ..... 239/556–561, 239/DIG. 1, 201, 200, 280–281

[56] References Cited

U.S. PATENT DOCUMENTS

| | | | |
|---|---|---|---|
| 1,400,533 | 12/1921 | Engel | 239/DIG. 1 X |
| 1,539,331 | 5/1925 | Siemann . | |
| 1,702,605 | 2/1929 | Hartman . | |
| 1,906,991 | 5/1933 | McTernan . | |
| 2,076,445 | 4/1937 | Callender | 239/543 |
| 2,290,258 | 7/1942 | Svet . | |
| 2,493,714 | 1/1950 | Garabedian | 230/DIG. 1 X |
| 2,746,792 | 5/1956 | Hough | 239/DIG. 1 X |
| 2,919,861 | 1/1960 | Meck | 239/561 X |
| 3,035,777 | 5/1962 | Bodell et al. | 239/DIG. 1 X |
| 3,081,950 | 3/1963 | Rinkewich | 239/561 X |
| 3,363,845 | 1/1968 | Pierce | 239/561 X |
| 3,558,054 | 1/1971 | Ragot | 239/DIG. 1 |
| 3,762,437 | 10/1973 | King | 239/201 X |
| 3,790,082 | 2/1974 | Pochard | 239/DIG. 1 X |

FOREIGN PATENT DOCUMENTS

| | | |
|---|---|---|
| A1376493 | 2/1965 | France . |
| C 408676 | 6/1923 | Germany . |
| 0743105 | 1/1956 | United Kingdom . |
| 0787687 | 12/1957 | United Kingdom . |
| 0861614 | 2/1961 | United Kingdom . |
| 2119285 | 11/1983 | United Kingdom . |

*Primary Examiner*—Kevin Weldon

*Attorney, Agent, or Firm*—Watson Cole Stevens Davis, P.L.L.C.

[57] ABSTRACT

A liquid sprinkler having a substantially hemispherical shaped head at the upper end of a vertical rise pipe. The head is spaced above an area to be watered and has a plurality of nozzles on the hemispherical surface which are sized and positioned to afford even water distribution over the watered area.

10 Claims, 51 Drawing Sheets

SPRINKLED WATER DISTRIBUTION FIG. 4

SPRINKLED WATER DISTRIBUTION

SPRINKLED WATER DISTRIBUTION

SPRINKLED WATER DISTRIBUTION

SPRINKLED WATER DISTRIBUTION

LIQUID SPRINKLER HAVING A HEMISPHERICAL HEAD WITH A PATTERN OF NOZZLE OPENINGS

BACKGROUND OF THE INVENTION

1) Field of the Invention

The present invention relates to a liquid sprinkler, and more particularly to a sprinkler head for a liquid sprinkler. The present liquid sprinkler can be also suitably used to prevent crops, trees, etc. from frost damages.

2) Related Prior Art

Water sprinklers have been so far used to sprinkle water in farms or vegetable gardens for growing vegetables, flowers, etc. outdoors, or in green house farms or gardens, orchards, public gardens planted with lawns, flowers, etc. or on roads.

Generally, the sprinkler is perpendicularly provided at the center of desired water sprinkling area, and water is ejected through a nozzle formed at a rotatable sprinkler head, the water ejected through the nozzles is allowed to hit a vane mounted on the head, thereby rotating the head in one direction by virtue of its impact force to sprinkle water concentrically in a broad range.

However, the sprinkler head of the above-mentioned conventional water sprinkler produces a concentric (doughnut shaped) sprinkled area around the sprinkle as a center, as shown in FIG. 73, where the sprinkled area is a hatched region far from a sprinkler 11. That is, when the desired sprinkling area is a rectangular or square area, water cannot be sprinkled to the corners of the area. Furthermore, the sprinkler can sprinkle water in a broad area, but fails to sprinkle water in the area near the sprinkler.

To sprinkle water all over the desired sprinkling area, sprinklers must be provided to overlap the respective sprinkling areas in parts, as shown in FIG. 74, where the sprinklers 11 are so provided to overlap parts of the hatched sprinkled regions. That is, there is another problem of failure to efficiently provide the sprinklers in a sprinkling area.

Furthermore, the sprinkler head of the conventional sprinkler has a nozzle having nozzle diameters of more than 2 mm to obtain a sufficient impact force, and thus the larger sprinkled water droplets are inevitably formed. That is, a strong impact is imparted to the surface of sprinkling area by the larger water droplets and thus water cannot be gently sprinkled due to rebounding of water droplets, etc. When water is sprinkled onto the surface of sprinkling area as if to hit the surface, for example, sown seeds flow away from the soil or roots are exposed from the soil to give a serious plant growth inhibition problem.

Furthermore, when water is sprinkled to vegetables or flowers planted on ridges in a farm field or linearly planted trees, water is inevitably sprinkled into grooves between the ridges or into spaces between a line of trees and another line, that is, even onto the unwanted area for water sprinkling and thus the larger volume of sprinkled water is required. In other words, a larger volumes of water is wasted.

When the desired sprinkling is not on the horizontally flat plane, that is, when water is sprinkled onto an inclined plane, the sprinkling distance of sprinkled water droplets from a sprinkler perpendicularly provided at the center of the inclined plain differs between the downward side and the upward side of the inclined plain, and thus water cannot be sprinkled uniformly all over the inclined plain. Furthermore, on the upward side of the inclined plain the water droplets ejected through the nozzle inevitably hit the soil surface because the sprinkler head is nearer to the soil surface. Thus, for example, sown seeds flow away from the soil, leaves or stems are damaged or roots are exposed from the soil to give a serious problem of plant growth inhibition.

Still furthermore, the sprinkler is to sprinkle water from the rotating head, as explained above, and the sprinkling range of the sprinkler can be changed only by the specific rotatable angular range of sprinkler head. Water sprinkling to a plurality of water sprinkling areas is not possible to control. That is, the water sprinkling area is always restricted to a sector-shaped area or a semicircular area around the sprinkler location as a center, and only the rotatable angular range of sprinkler head can be changed. However, the actual change of the rotatable angular range has a technical difficulty, because, for example, balance between the rotatable angular range and the feed rate of water must be precisely adjusted beforehand. Thus, when the water sprinkling area is a portion of the area all over around the sprinkler location, for example, when the water sprinkling area is not an area all over around, the sprinkler locates on one side of the sprinkler location (for example, on the west side of the sprinkler location), or when the water sprinkling area is on both sides of the sprinkler location (, that is, all over around the sprinkler location), but locates far from the sprinkler location, or near to the sprinkler location, there is a problem of a failure to efficiently sprinkle water only in such a portion of the area.

Generally, crops such as beans, potatoes, vegetables, corns, tea leaves, coffee beans, mulberry leaves, feed crops, etc., and fruit trees such as grape vines, orange trees, etc. are susceptible to frost damages due to early frost in the autumn or late frost in the spring. Frost is formed by contact of water vapor in the air with the soil surface or objects on the ground and by successive sublimation. That is, frost damages are physical climatic disasters due to lower temperature. Thus, the following measures have been so far taken against the frost damages, for example, in orchards, tea gardens, mulberry fields, etc: (1) a frost sheet belt of trees must be planted; (2) plants must be housed with plastic sheets; (3) air in the gardens, farms, etc. must be heated or agitated by a fan, etc.; (4) smoke must be generated or water droplets or an anti-freeze agent must be sprinkled to prevent frost generation, etc. Among these measures, sprinkling of water droplets is easy to carry out because of a relatively low labor power, a low running cost and a low capital investment. Thus, sprinklers have been tried as a device for preventing frost damages, because they can inhibit frost generation.

However, the sprinkler head of the conventional sprinkler is to eject water through a nozzle to hit the vane and rotate the sprinkler head by the impact force of ejected water, and thus the sprinkled water droplets are so large in the droplet sizes that they cannot be suspended in the air for a long time and thus fall immediately, and no sufficient heat exchange can be carried out between the water droplets and the air. As already mentioned before, the water sprinkling area of the sprinkler head is a concentric (doughnut-shaped) area round the sprinkler as a center. That is, water sprinkling can be carried out in a broad area, and cannot be done in the area near the sprinkler. Thus, the distribution of sprinkled water is not uniform in the entire sprinkling area, and there is a fructuation in the frost damage-preventing effect. The sprinkler head of the conventional sprinkler has a problem of poor frost damage-preventing effect.

Furthermore, the conventional sprinkler is provided with a filter for preventing cloggings due to sands, rusts, dusts, etc. at the discharge outlet of a pump for feeding water to the sprinkler or in a water distributor pipe connected to the discharge outlet of the pump. However, the discharge outlet of the pump or the water distributor pipe connected to the discharge outlet, at or in which the filter is provided, is so small in diameter that a filter provided in the liquid passage cannot have a large number of meshes. Thus, there are problems of a larger pressure drop, a restricted flow rate, and an early clogging by sands, rusts, dusts, etc.

When the conventional sprinkler is used in orchards, water droplets ejected onto the vane from the nozzle are spread toward the overhead of sprinkler head, and thus attached to fruits, which are thus kept in a constantly wet state. This leads to very liable infection by the so called pathogenic organisms such as growth of molds on fruits, propagation of pathogenic bacteria, etc., lowering the quality and yield of fruits.

When the conventional sprinkler is used in a green house farms or gardens, the angle of nozzle elevation must be made lower so that the water droplets ejected from the nozzle may not hit the ceiling of the green house. That is, there is a limitation to the sprinkling height. That is, impacts of water droplets ejected from such nozzle on the soil surface are so large, resulting in rebounding of water droplets and a failure to conduct gentle water sprinkling. In other words, the conventional sprinkler has such a problem that water cannot be sprinkled without any consideration of the so called limitation to the sprinkling height. Thus, a sprinkler head capable of sprinkling water all over a sprinkling area of any shape and size and well applicable to orchards, green house farms or gardens with the so called limitation to the sprinkling height has been so far keenly required.

SUMMARY OF THE INVENTION

An object of the present invention is to provide a liquid sprinkler freed from the above-mentioned problems of the prior art.

Another object of the present invention is to provide a liquid sprinkler capable of gently sprinkling a liquid substantially uniformly all over the entire sprinkling area of any desired shape and size.

Other object of the resent invention is to provide a liquid sprinkler capable of sprinkling a liquid substantially uniformly all over an inclined sprinkling area, i.e. an inclined plain.

Further object of the present invention is to provide a liquid sprinkler capable of sprinkling smaller liquid droplets substantially uniformly all over the sprinkling area while suspending the liquid droplets in the air for a long time, thereby sufficiently conducting heat exchange between the liquid droplets and the air, that is, a liquid sprinkler utilizable as a device for preventing frost damages.

According to the present invention, there is provided a liquid sprinkler perpendicularly provided at a desired position in a desired liquid sprinkling area, which comprises:

(1) a rise pipe perpendicularly provided at the desired position in the desired liquid sprinkling area, (2) an upwardly protruded, substantially hemispherical sprinkler head having a plurality of nozzles capable of sprinkling a liquid to the desired sprinkling area, the sprinkler head being detachably mounted on the top end of the rise pipe, and (3) a liquid distributor pipe connected to the rise pipe at the lower end.

According to a first aspect of the present invention, the sprinkler head is a sprinkler head capable of setting a liquid sprinkling distance as desired by selecting a nozzle diameter, an angle of nozzle elevation, and a liquid pressure on the nozzles in combination; the angle of nozzle elevation is selected in a range of 20° to less than 90°; the nozzle diameter is selected in a range of 0.1 mm to 2 mm; and a liquid pressure-changing means capable of changing the liquid pressure on the nozzles to a desired pressure is provided in the liquid distributor pipe or the rise pipe.

Since the liquid sprinkling distance can be set as desired by selecting a nozzle diameter, an angle of nozzle elevation, and a liquid pressure on the nozzles in combination, the liquid sprinkling distance can be changed, for example, according to the shape and size of a sprinkling area, whereby a liquid can be sprinkled substantially uniformly all over the sprinkling area of any shape and size.

Since the angle of nozzle elevation is selected from a range of 20° to less than 90°, the liquid ejected through the nozzles under the selected liquid pressure never hits the soil surface of the sprinkling area. Thus, there is no rebounding of the sprinkled liquid droplets and the liquid can be gently sprinkled.

Since the nozzle diameter is selected from a range of 0.1 mm to 2 mm, smaller liquid droplets are sprinkled from the nozzles, whereby impacts of the liquid droplets on the surface of a sprinkling area are made smaller. Thus, there is no rebounding of the sprinkled liquid droplets from the soil surface and the liquid can be gently sprinkled.

Since a liquid pressure-changing means capable of changing the liquid pressure to a desired pressure is provided in the liquid distributor pipe or the rise pipe, a degree of freedom in the combination of the nozzle diameter and the angle of nozzles elevation can be increased when the liquid sprinkling distance is changed, for example, according to the shape and size of a sprinkling area, and thus the substantially uniform liquid sprinkling all over the sprinkling area of any shape and size can be much ensured.

According to a second aspect of the present invention, the sprinkler head has nozzles formed along a plurality of imaginary lines intersecting at the vertex of the substantially hemispherical sprinkler head and extending substantially radially on the surface of the substantially hemispherical sprinkler head, and the nozzles formed along the same imaginary lines have increasing diameters with increasing distances of the nozzles from the vertex.

Since a plurality of nozzles are formed along a plurality of imaginary lines intersecting at the vertex of the substantially hemispherical sprinkler head and extending substantially radially on the surface of the substantially hemispherical sprinkler head, the liquid sprinkling distance can be set as desired by nozzle positions on the surface of the substantially hemispherical sprinkler head, and the liquid can be sprinkled according to the shape and size of a sprinkling area by changing a pattern of a plurality of the imaginary lines on the surface of the substantially hemispherical sprinkler head.

Since the nozzles formed along the same imaginary lines have increasing diameters with increasing distances of the nozzles from the vertex, the liquid can be sprinkled substantially uniformly all over the sprinkling area, whereby the liquid can be sprinkled substantially uniformly all over a sprinkling area of any shape and size. Furthermore, since the present liquid sprinklers can be efficiently provided, the number of the liquid sprinklers can be reduced in a given sprinkling area than that of the conventional liquid sprinklers.

According to a third aspect of the present invention, the sprinkler head has the nozzles formed along first imaginary lines defined by the respective sides of a polygon surrounding the vertex of the substantially hemispherical sprinkler head, the first imaginary lines defined by the respective sides of the polygon being curved toward the vertex of the substantially hemispherical sprinkler head, as viewed in a plan view of the substantially hemispherical sprinkler head from the vertex side, and also nozzles formed along second imaginary lines drawn in parallel to the first imaginary lines but positioned from the first imaginary lines toward the vertex; the polygon is a rhombus; and the nozzles formed on the same imaginary lines have an equal nozzle diameter.

Since a plurality of nozzles are formed on the surface of the substantially hemispherical sprinkler head along first imaginary lines defined by the respective sides of a polygon surrounding the vertex of the substantially hemispherical sprinkler head, the first imaginary lines defined by the respective sides of the polygon being curved toward the vertex of the substantially hemispherical sprinkler head, as viewed in a plan view of the substantially hemispherical sprinkler head from the vertex side, and also formed along second imaginary lines drawn in parallel to the first imaginary lines but positioned from the first imaginary toward the vertex, the liquid sprinkling distance can be set as desired by nozzle positions on the substantially hemispherical sprinkler head, and the liquid can be sprinkled according to the shape and size of a sprinkling area, for example, by selecting a shape of the polygon, that is, a pattern of imaginary lines on the surface of the substantially hemispherical sprinkler head. Thus, the liquid can be sprinkled substantially uniformly all over a sprinkling area of any shape and size, and since the present liquid sprinklers can be provided efficiently, the number of the liquid sprinklers can be reduced in a given sprinkling area than that of the conventional liquid sprinklers.

Since the polygon is a rhombus, the liquid can be sprinkled substantially uniformly all over a sprinkling area of, for example, a rectangular shape or a square shape.

Since the nozzles formed on the same imaginary lines have an equal nozzle diameter, more uniform liquid sprinkling all over a sprinkling area of any shape or size can be attained.

According to a fourth aspect of the present invention, the sprinkler head has the nozzles formed in a strip zone defined by two second imaginary lines substantially in parallel to a first imaginary straight line passing through the vertex of the substantially hemispherical sprinkler head, as viewed in a plan view of the substantially hemispherical sprinkler head from the vertex side; at least one strip zone is provided on each side of the first imaginary straight line; and the strip zone is provided in a range of angles of elevation of 0° to 85° from the center of the substantially hemispherical sprinkler head in a vertical cross-sectional view of the sprinkler head, i.e. the cross-sectional view passing through the vertex and vertical to the first imaginary straight line.

Since a plurality of nozzles are formed in a strip zone defined by two second imaginary lines substantially in parallel to a first imaginary straight line passing through the vertex of the substantially hemispherical sprinkler head, as viewed in a plan view of the substantially hemispherical sprinkler head from the vertex side, the liquid sprinkling distance can be set as desired by nozzle positions on the surface of the substantially hemispherical sprinkler head, and the liquid can be sprinkled according to the shape and size of a sprinkling area, for example, by changing a pattern of the strip zone.

Since the nozzles are formed in the strip zone, the liquid is never sprinkled onto an unwanted area for the liquid sprinkling. Thus, the volume of sprinkling liquid can be reduced. That is, the volume of wasted liquid can be reduced.

Since at least one strip zone is provided on each side of the first imaginary straight line, the liquid can be sprinkled from one sprinkler head onto two sprinkling areas at the same time by perpendicularly providing a liquid sprinkler between the two sprinkling areas.

The strip zone is provided in a range of angles of elevation of 0° to 85° from the center of the substantially hemispherical sprinkler head in a vertical cross-sectional view of the sprinkler head, i.e. the cross-sectional view passing through the vertex and vertical to the first imaginary straight line.

Impact forces of sprinkled liquid droplets onto the surface of a sprinkling area are weaker with increasing angles of nozzle election. Thus, the liquid can be gently sprinkled onto the sprinkling area without rebounding of sprinkled liquid droplets from the soil surface. When the present liquid sprinkler is used to sprinkle water under fruit trees such as graph vine trellises, a strip zone having low angles of elevation is preferable, and a preferable range of angles of elevation for such a strip zone is 0° to 60°, where impact forces of sprinkled liquid droplets onto the soil surface of a sprinkling area can be made weaker by selecting smaller nozzle diameters for such a strip zone.

According to a fifth aspect of the present invention the sprinkler head has the nozzles formed in a rectangular zone enclosed by two first imaginary straight lines substantially in parallel to each other and by two second imaginary straight lines intersecting the first imaginary straight lines substantially at a right angle and substantially in parallel to each other, as viewed in a plan view of the substantially hemispherical sprinkler head from the vertex of the substantially hemispherical sprinkler head, the vertex locating in the rectangular zone; and the rectangular zone is provided in a range of angle of elevations of 30° to less than 90° to the center of the substantially hemispherical sprinkler head in a vertical cross-sectional view of the sprinkler head, i.e. the vertical cross-sectional view passing the vertex and vertical to the first imaginary straight lines, and also provided in a range of angles of elevations of 30° to less than 90° to the center of the substantially hemispherical sprinkler head in a vertical cross-sectional view of the sprinkler head, i.e. the vertical cross-sectional view passing the vertex and vertical to the second imaginary straight lines.

Since a plurality of nozzles are formed in a rectangular zone enclosed by two first imaginary straight lines substantially in parallel to each other and by two second imaginary straight lines intersecting the first imaginary straight lines substantially at a right angle and substantially in parallel to each other, as viewed in a plan view of the substantially hemispherical sprinkler head from the vertex of the substantially hemispherical sprinkler head, the vertex locating in the rectangular zone, the liquid can be sprinkled upwards just from the sprinkler head and thus can be sprinkled substantially uniformly all over a desired sprinkling area. Sprinkled liquid droplets can be made smaller by selecting nozzle diameters, and the liquid droplets can be suspended in the air for a long time, thereby conducting sufficient heat exchange between the liquid droplets and the air. That is, frost damages can be effectively prevented. In other words, the present liquid sprinkler can be effectively utilized as a device for preventing frost damages. Furthermore, since the nozzles are formed in the rectangular zone, the liquid will never be sprinkled downwards just from the sprinkler head. Thus, the volume of the sprinkling liquid can be reduced. That is, the volume of wasted liquid can be reduced. Since the sprinkler head has no movable parts, there is no fear of moving troubles, failures, etc.

Since the rectangular zone is provided in a range of angle of elevations of 30° to less than 90° to the center of the substantially hemispherical sprinkler head in a vertical cross-sectional view of the sprinkler head, i.e. the vertical cross-sectional view passing the vertex and vertical to the first imaginary straight lines, and also provided in a range of angles of elevations of 30° to less than 90° to the center of the substantially hemispherical sprinkler head in a vertical cross-sectional view of the sprinkler head, i.e. the vertical cross-sectional view passing the vertex and vertical to the second imaginary straight lines, the liquid can be sprinkled upwards from the sprinkler head so thoroughly that the sprinkled liquid droplets can be suspended in the air for a much longer time, thereby conducting more sufficient heat exchange between the liquid droplets and the air.

According to a sixth aspect of the present invention, the sprinkler head has nozzles in two divided zones of the substantially hemispherical sprinkler head, divided by an imaginary straight line passing through the vertex of the substantially hemispherical sprinkler head, the nozzles in one of the two divided zones have a denser nozzle distribution with increasing distance from the vertex, while the nozzles in other divided zone have a sparser nozzle distribution with increasing distance from the vertex, or the sprinkler head has nozzles formed in a zone enclosed by two second imaginary lines intersecting a first imaginary straight line passing through the vertex of the substantially hemispherical sprinkler head substantially at a right angle and substantially in parallel to each other; the zone is further divided into two subzones by the first imaginary straight line; the respective divided subzones are further divided each into two subsections by an imaginary ellipse drawn by a segment of a line between two intersections of the first imaginary straight line and the two second imaginary straight lines as the line of upsides; and the nozzles in the subsection outside the imaginary ellipse in one of the subzones have a larger total opening area than in the subsection inside the imaginary ellipse, while the nozzles in the subsection outside the imaginary ellipse in other subzone have a smaller total opening area than in the subsection inside the imaginary ellipse.

Since a plurality of nozzles are formed in two divided zones of the substantially hemispherical sprinkler head, divided by an imaginary straight line passing through the vertex of the substantially hemispherical sprinkler head, the nozzles in one of the two divided zones have a denser nozzle distribution with increasing distance from the vertex, while the nozzles in other divided zone have a sparser nozzle distribution with increasing distance from the vertex, the sprinkler head must be mounted on the rise pipe, in the case of an inclined sprinkling area, that is, in the case the liquid is to be sprinkled onto an inclined plain, so that the divided zone having a denser nozzle distribution with increasing distance from the vertex can be faced toward the downward side of the inclined plain, whereby the volume of liquid sprinkled onto the downward side of the inclined plain can be made larger than that of liquid sprinkled onto the upward side of the inclined plain. By virtue of this nozzle distribution, the liquid sprinkling distance can be set as desired by nozzle positions on the substantially hemispherical sprinkler head, and thus the liquid can be sprinkled substantially uniformly all over the desired inclined sprinkling area.

Since the sprinkled liquid droplets can be made smaller by selecting nozzle diameters, impact forces of the sprinkled liquid on the soil surface can be made smaller. Thus, the liquid droplets never vigorously hit the soil surface even on the upward side of the inclined plain. That is, the liquid can be gently sprinkled without rebounding of sprinkled liquid droplets from the soil surface, etc., and, for example, the sown seeds never flow away from the soil or neither leaves nor stems are damaged, or the roots are never exposed from the soil. That is, there is no fear of plant growth inhibition. Thus, the present liquid sprinkler is suitable for sprinkling a liquid to an inclined plain.

Since a plurality of nozzles are formed in a zone enclosed by two second imaginary lines intersecting a first imaginary straight line passing through the vertex of the substantially hemispherical sprinkler head substantially at a right angle and substantially in parallel to each other; the zone is further divided into two subzones by the first imaginary straight line; the respective divided subzones are further divided each into two subsections by an imaginary ellipse drawn by a segment of a line between two intersections of the first imaginary straight line and the two second imaginary straight lines as the line of upsides; and the nozzles in the subsection outside the imaginary ellipse in one of the subzones have a larger total opening area than those in the subsection inside the imaginary ellipse, while the nozzles in the subsection outside the imaginary ellipse in other subzone have a smaller total opening area than those in the subsection inside the imaginary ellipse, the sprinkler head must be mounted on the rise pipe, in case of an inclined sprinkling area, that is, in the case the liquid is to be sprinkled onto an inclined plain, so that the subzone with nozzles with a larger total opening area in the subsection outside the imaginary ellipse than in the subsection inside the imaginary ellipse can be faced toward the downward side of the inclined plain, whereby the volume of liquid sprinkled onto the downward side of the inclined plain can be made larger than that of liquid sprinkled onto the upward side of the inclined plain. By virtue of this nozzle distribution, the liquid sprinkling distance can be set as desired by nozzle positions on the substantially hemispherical sprinkler head, and thus more substantially uniform liquid sprinkling all over the desired inclined sprinkling area can be attained.

According to a seventh aspect of the present invention, the sprinkler head has the nozzles formed along concentrical lines from the vertex of the substantially hemispherical sprinkler head as a center, and the nozzles formed along the concentrical lines have increasing diameters with increasing distance from a plurality of imaginary lines substantially radially extending on the surface of the substantially hemispherical sprinkler head from the vertex; the imaginary lines are four lines each intersecting their adjacent lines at a right angle; and the nozzles formed along the concentrical lines on the surface of the substantially hemispherical sprinkler head have an increasing total nozzle opening area with increasing distance of the concentrical lines from the vertex.

That is, the nozzles are formed along concentrical lines from the vertex of the substantially hemispherical sprinkler head as a center, and have increasing diameters with increasing distance from a plurality of imaginary lines substantially radially extending on the surface of the substantially hemispherical sprinkler head from the vertex. In other words, diameters of the nozzles along each of concentrical lines are not equal to one another, that is, the smallest at the position nearest to the imaginary lines and the largest at the farthest position from the imaginary lines. Since the nozzles have different diameters, depending on their distances from the imaginary lines, the sprinkling distance of liquid droplets ejected from the nozzles differs from one nozzle to another. Thus, the sprinkling area, which has been in a doughnut shape by the conventional liquid sprinkler, can be changed into a desired shape. That is, a liquid can be sprinkled onto a sprinkling area of any desired shape by adjusting diameters of nozzles formed along the concentrical lines. The liquid can be sprinkled substantially all over a sprinkling area of any desired shape and size. In other words, the present liquid sprinkler must be perpendicularly provided according to the shape of a sprinkling area, because the present liquid sprinkler can sprinkle a liquid to a sprinkling area of any shape. Furthermore, since the present liquid sprinkler can be efficiently provided, number of the liquid sprinklers to be provided on the entire sprinkling area can be made smaller than that of the conventional liquid sprinklers.

Furthermore, the imaginary lines are four lines each intersecting their adjacent lines at a right angle. When nozzles having an equal diameter are formed along the 4 imaginary lines, and diameters of the nozzles to be formed along the concentrical lines have an equal ratio of increasing according to distances from the imaginary lines, a liquid can be sprinkled uniformly onto a sprinkling area of square shape.

Since the nozzles formed along the concentrical lines on the surface of the substantially hemispherical sprinkler head have an increasing total nozzle opening area with increasing distance of the concentrical lines from the vertex, sprinkled liquid volume per unit area can be made uniform between a region locating at a shorter sprinkling distance, i.e. a region near the liquid sprinkler, and a region locating at a longer sprinkling distance, i.e. a region far from the liquid sprinkler, and thus substantially uniform liquid sprinkling can be carried out all over the sprinkling area.

According to an eighth aspect of the present invention, the sprinkler head is provided with a sprinkling-inhibiting member for inhibiting sprinkling of a liquid through other nozzles than those destined to the desired sprinkling area, and the sprinkler head is provided with a sealing member for clearances between the sprinkling-inhibiting member and the sprinkler head.

Since the sprinkling liquid can pass only through nozzles not inhibited by the sprinkling-inhibited member and sprinkled, the liquid can be sprinkled only through the desired nozzles by selecting sprinkling-unwanted nozzles by the sprinkling-inhibiting member, whereby the liquid can be sprinkled efficiently only onto a desired sprinkling zone of the area around the liquid sprinkler, that is, not onto the entire area around the liquid sprinkler, for example, only onto a sprinkling area on one side of the liquid sprinkler, or only onto an area around the liquid sprinkler, but far from or near it.

Since the sprinkler head is closely fitted to the sprinkling-inhibiting member by a sealing member, there are no clearances between the sprinkler head and the sprinkling-inhibiting member, and thus when the liquid sprinkling is inhibited by the sprinkling-inhibiting member, the liquid can be prevented from retaining in clearances between the sprinkler head and the sprinkling-inhibiting member or from leakage to the outside through clearances between the sprinkler head and the sprinkling-inhibiting member. Thus, more efficient liquid sprinkling can be attained with a smaller volume of liquid.

According to a ninth aspect of the present invention, the sprinkler head has a filter between the sprinkler head and a fixing jig, and the filter has a smaller mesh size than the nozzle diameter and a larger trap area than the lateral cross-sectional area of the rise pipe.

Since the filter has a larger trap area than the lateral cross-sectional area of the rise pipe, the filtration area of the filter can be made larger. That is, the filter can have a larger number of meshes and thus can have a smaller pressure drop and no limitation to the feed rate of sprinkling liquid. Thus, clogging by sand, rusts, dust, etc. can be prevented for a long time.

Since the liquid can be distributed throughout the sprinkler head from the rise pipe connected to the fixing jig, the liquid pressure can be uniformly applied to the entire sprinkler head, and thus the liquid can be sprinkled uniformly onto the sprinkling area.

According to a tenth aspect of the present invention the sprinkler head has nozzles formed at angles of nozzle elevation of not more than 27° to the center of the substantially hemispherical sprinkler head and along a plurality of imaginary lines substantially radially extending on the surface of the substantially hemispherical sprinkler head from the vertex thereof, and diameters of the nozzles along the same imaginary lines decrease with increasing distance from the vertex, and total nozzle opening area of the nozzles at the same angle of nozzle elevation decreases with decreasing angle of nozzle elevation.

A plurality of nozzles are formed on a sprinkler head at angles of nozzle elevation of not more than 27° to the center of the substantially hemispherical sprinkler head and along a plurality of imaginary lines substantially radially extending on the surface of the substantially hemispherical sprinkler head from the vertex thereof. Generally, the sprinkling distance of a liquid sprinkled from nozzles is the longest at an angle of nozzle elevation of 27° and decreases with increasing or decreasing angles of nozzles elevation. Thus, the sprinkling distance of liquid droplets can be set as desired by selecting nozzle positions within a range of angles of nozzle elevation of not more than 27°, and the liquid droplets can be sprinkled onto a sprinkling area of any shape and size by selecting a pattern for the imaginary lines on the surface of the hemispherical part. Since no nozzles are formed at angles of nozzle elevation of more than 27°, liquid droplets are never sprinkled toward the overhead of the sprinkler head. Furthermore, diameters of the nozzles along the same imaginary lines are made to decrease with increasing distance from the vertex, and thus the liquid can be sprinkled substantially uniformly all over a sprinkling area. That is, the present sprinkler head can be well applied to orchards or green house farms or gardens with the so called limitation to the sprinkling height. For example, when the present sprinkler head is used for water sprinklers for orchards, water droplets are never sprinkled toward the overhead of the sprinkler head, and thus are never attached to overhead fruits, which can be kept in a constantly dry state. This leads to very less infection by the so called pathogenic organisms and to maintenance of good quality and high yield of fruits. When the present sprinkler head is used for sprinklers for green house farms or gardens, water droplets are never sprinkled toward the overhead of the sprinkler head without hitting the ceilings of housing. That is, water sprinkling can be conducted without any consideration of the so called limitation to the sprinkling height.

Furthermore, total nozzle opening area of the nozzles at the same angle of nozzle elevation is made to decrease with decreasing angle of nozzle elevation. Thus, the sprinkled liquid volume per unit area can be made equal between a region of relatively short sprinkling distance, i.e. a region near the liquid sprinkler, and a region of relatively long sprinkling distance, i.e. a region far from the liquid sprinkler. That is, more uniform liquid sprinkling can be conducted all over a sprinkling area.

PREFERRED EMBODIMENTS OF THE INVENTION

Figure 1:
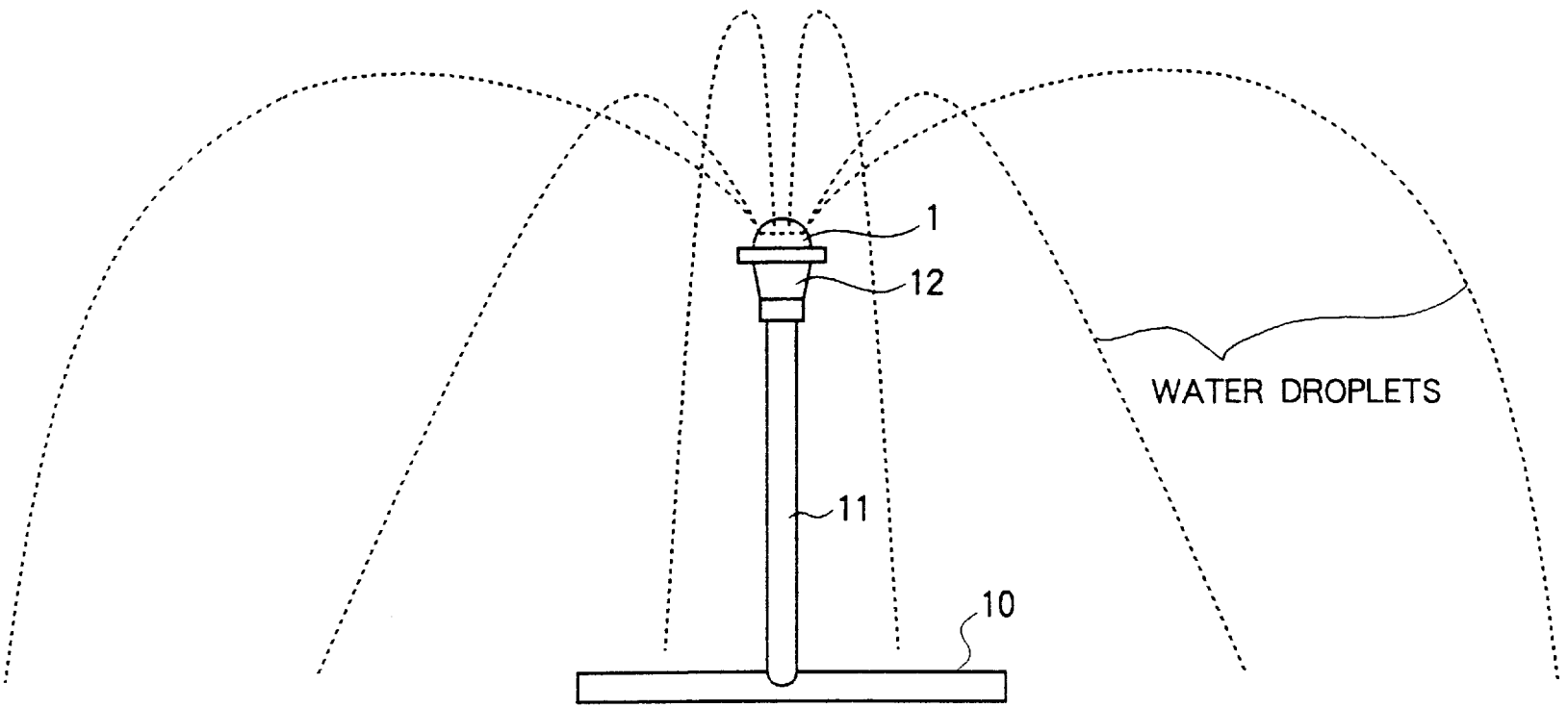
FIG. 1 is a schematic elevation view of the present liquid sprinkler provided with a sprinkler head.

The present invention will be described in detail below, referring to embodiments and drawings. In the following description, embodiments will be described, referring to water as a sprinkling liquid, that is, to a water sprinkler as a liquid sprinkler.

A water sprinkler as a liquid sprinkler, shown in the following embodiments, comprises a rise pipe 11 to which water is fed from a water distributor pipe 10. The rise pipe 11 is perpendicularly provided at a desired location in a desired soil surface for water sprinkling, that is, a sprinkling area. A sprinkler head 1 is detachably mounted on the top end of the rise pipe 11 through a fixing jig 12. The fixing jig 12 has a screw part, that is, a female screw part (not shown in the drawing) corresponding to screw part 1*b*, that is, a male screw part, as shown in FIG. 3, of the sprinkler head 1.

Figure 2:
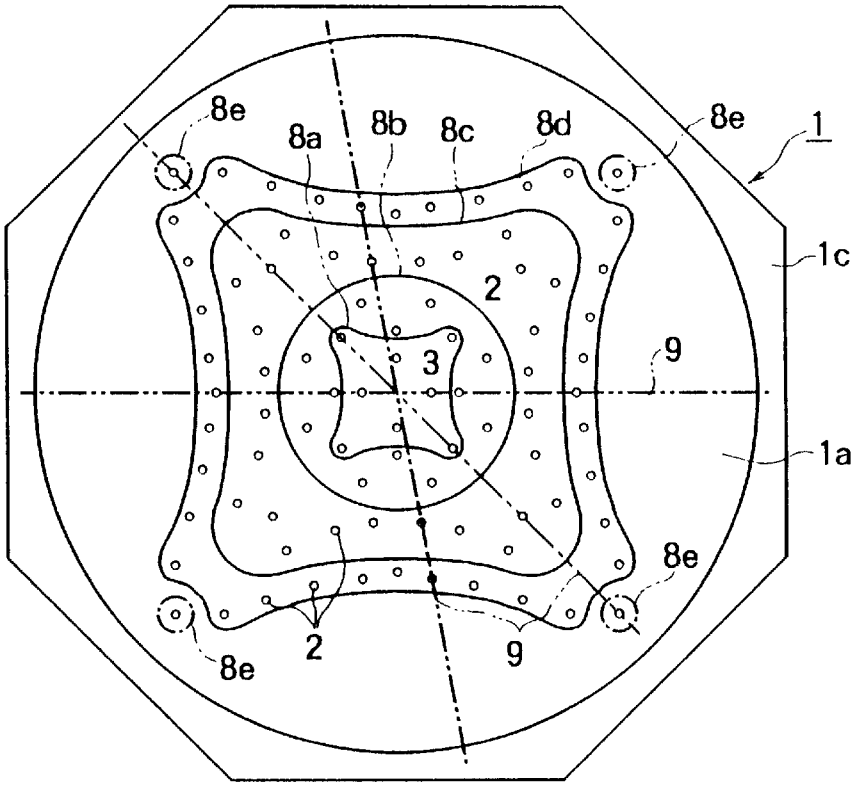
FIGS. 2 and 3 are a plan view and an elevation view, respectively, of a sprinkler head according to one embodiment based on a second aspect of the present invention.
Figure 3:
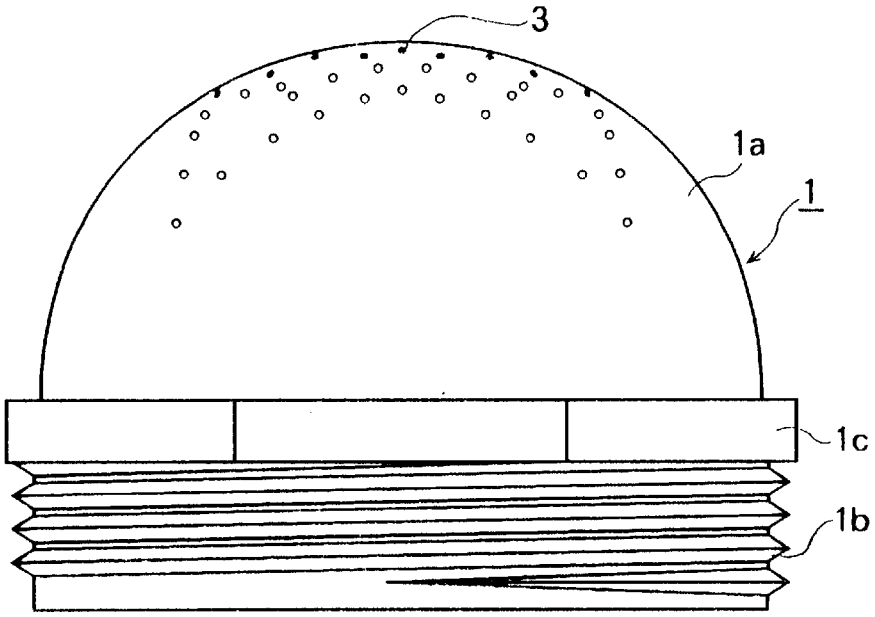

As shown in FIGS. 2 and 3, the sprinkler head 1 comprises a upwardly protruded, substantially hemispherical part 1*a*, a screw part (male screw part) 1*b* to be fixed to the fixing jig 12, and a connection part 1*c* for connecting the substantially hemispherical part 1*a* to the screw part 1*b*. The term "substantially hemispherical" herein used means that the vertical cross-sectional shape of the part 1*a* (on the cross-sectional plane vertical to the drawing surface in FIG. 2) is an approximately semicircular sector shape or an approximately semielliptical sector shape.

The connection part 1*c* is in such a shape that the sprinkler head 1 can be easily engaged with or disengaged from the fixing jig 12, for example, in an octagonal shape, as viewed from the overhead of the sprinkler head, as shown in FIG. 2. A plurality of nozzles 2 capable of sprinkling water onto a soil surface, etc. are provided on the substantially hemispherical part 1*a*. Number of nozzles 2 is not particularly limited, and the size of the sprinkler head is also not particularly limited.

Embodiments according to the first aspect of the present invention will be described below:

As shown in FIG. 2, a plurality of nozzles 2 capable of sprinkling water are formed on the sprinkler head 1 provided at the top end of the rise pipe 11 through the fixing jig 12, and the sprinkling distance of sprinkled water droplets can be set as desired by selecting a nozzle diameter, an angle of nozzle elevation and a water pressure on the nozzles in combination. The rise pipe 11 can be perpendicularly set to a desired location on a soil surface, etc. (sprinkling area), but it is preferable to set it at the center or corner in the sprinkling area so as to easily select a nozzle diameter, an angle of nozzle elevation and a water pressure on the nozzles in combination.

The nozzle diameter is not particularly limited, but a nozzle diameter of 0.1 mm to 2 mm is preferable. By selecting the nozzle diameter from the above-mentioned range, the water droplets sprinkled through the nozzles can be made smaller and the impact forces of the water droplets on the soil surface of a sprinkling area can be made weaker. That is, water can be sprinkled gently without rebounding of the water droplets from the soil surface. When the nozzle diameter is less than 0.1 mm, the sprinkled water droplets will be so small that they will highly take a fog state, resulting in a failure to cover a long distance. Furthermore, sprinkled water volume per unit area will be so small that sufficient water sprinkling in the sprinkling area cannot be attained. When the nozzle diameter is more than 2 mm, on the other hand, the water droplets will be so larger that the impact force of the water droplets on the soil surface of a sprinkling area will be stronger, and rebounding of water droplets from the soil surface, etc. will take place, resulting in a failure to conduct gentle water sprinkling.

The angle of nozzle elevation is not particularly limited, but it is preferable to select it from a range of 20° to less than 90°. By selecting the angle of nozzle elevation from the above-mentioned range, there is no hitting of sprinkled water droplets onto the soil surface of a sprinkling area due to the water pressure on the nozzles. Thus, water can be gently sprinkled without rebounding of water droplets from the soil surface, etc. When the angle of nozzle elevation is less than 20°, sprinkled water droplets will hit the surface of the sprinkling area due to the water pressure on the nozzles, resulting in an increase in the impact force on the soil surface of the sprinkling area and occurrences of water droplet rebounding from the soil surface, etc. Thus, water cannot be gently sprinkled.

Generally, it is known that water droplets can proceed in the air against resistances proportional to the square of their speeds, and thus the sprinkled water droplets can proceed farthest when the angle of nozzle elevation is set to about 30°, exactly 27°, while the water pressure and the nozzle diameter are constant. As to the sprinkling distance of water droplets, such a relationship as $Y_1/Y_2=1.4$ to 1.5 is established, where $Y_1$ is a sprinkling distance when the angle of nozzle elevation is set to 30° and $Y_2$ is a sprinkling distance when the angle of nozzle elevation is set to 60°, while the water pressure and the nozzle diameter are constant. Furthermore, the sprinkled water droplets can proceed far with increasing nozzle diameter and with the resulting decrease in the spreading angle when the water pressure on the nozzles and the angle of nozzle elevation are constant. Furthermore, the spreading angle of water droplets is increased with increasing sprinkling distance, and thus the sprinkling coverage is broadened. That is, when the water pressure on the nozzles and the nozzle diameter are constant, the sprinkling coverage is narrowed with increasing angle of nozzle elevation, resulting in an increase in the sprinkled water volume per unit area. In order to keep the sprinkled water volume per unit area substantially constant, it is necessary, for example, to make the diameter of nozzles formed at an angle of nozzle elevation of 60° smaller than that of nozzles formed at an angle of nozzle elevation of 30°.

Water pressure on the nozzles is not particularly limited. In the case the liquid sprinkler, that is, the rise pipe, is directly connected, for example, to the ordinary water pipe (tap water pipe), the available water pressure is 1 to approximately 2 kg/cm$^2$. Water pressure on the nozzles can be changed, when desired, by a liquid pressure-changing means such as a pump, a pressure reducing valve, a gate valve, etc. which can change the water pressure in a desired range, for example, 1 to 5 kg/cm$^2$, preferably 1 to 2 kg/cm$^2$.

Since the sprinkling distance and direction of water droplets can be set as desired by selecting a nozzle diameter, an angle of nozzle elevation, a sector angle (which will be defined later), and a water pressure on the nozzles in combination, the present liquid sprinkler can change the sprinkling distance according to the shape and size of a sprinkling area, and thus can sprinkle water substantially uniformly all over a sprinkling area of any shape and size.

When the water pressure on the nozzles is changed by a pump, etc., as mentioned above, to change the sprinkling distance and direction of water droplets according to the shape and size of a sprinkling area, a degree of freedom in combination of the nozzle diameter, the angle of nozzle elevation and the sector angle can be enhanced.

Procedure for selecting a nozzle diameter and an angle of nozzle elevation by calculation and test will be described, referring to specific cases.

Figure 9:
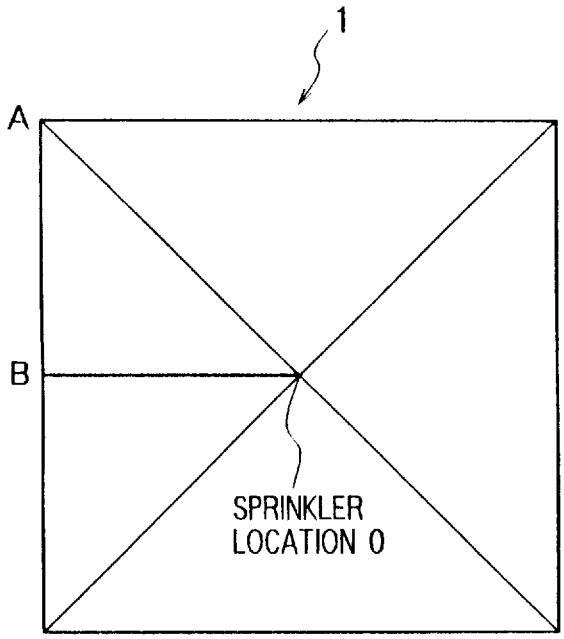
FIGS. 9, and 10, 11 and 12 are schematically plan view of a sprinkling area subjected to the water sprinkling test as shown in FIGS. 4 to 8, and detailed plan views thereof, respectively.

It is presumed as conditions for the selection to sprinkle water all over a square of 10 m×10 m as a desired sprinkling area 1 by perpendicularly providing a rise pipe 11 (FIG. 1) at the center 0 of the sprinkling area 1, as shown in FIG. 9. Water pressure on nozzles 2 on the sprinkler head 1 is set to 2 kg/cm$^2$.

Nozzle diameter and angle of nozzle elevation capable of sprinkling water all over a one-eighth region of the sprinkling area, i.e. a zone defined by a triangle OAB in FIG. 9, are determined, because, once the nozzle diameter and the angle of nozzle elevation capable of sprinkling water all over the region defined by the triangle OAB are determined, a nozzle diameter and an angle of nozzle elevation capable of sprinkling water all over other regions, that is, the entire sprinkling area 1, can be likewise simply determined.

Figure 10:
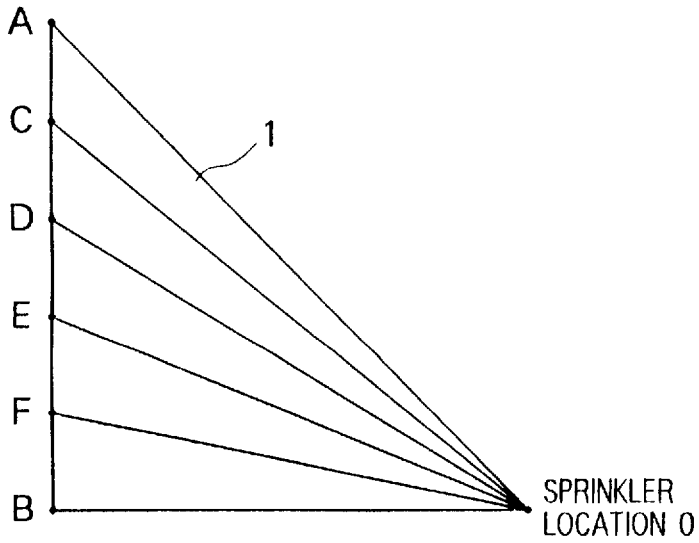

At first, water sprinkling onto the segment AB of the triangle OAB will be studied. As shown in FIG. 10, the segment AB is divided in 5 equal subsegments and it is set to sprinkle water approximately to the respective points A, B, C, D, E and F from the respective nozzles. Distances from the location point 0 of the rise pipe (sprinkler) as the center to the respective points A to F are as follows: distance OA=5 $\sqrt{2}$≈7 m, distance OB=5 m, distance OC≈6.4 m, distance OD≈5.8 m, distance OE≈5.4 m and distance OF≈5.1 m. Angle ∠AOB=45°, ∠AOC≈6°, ∠AOD≈14°, ∠AOE≈23° and ∠AOF≈34°. In the following description, the segment OA is deemed to be a base line, and the above-mentioned angles between other segments and the segment OA are defined as "sector angles".

Angles of elevations of nozzles capable of sprinkling water approximately to the respective points A to F, (the nozzles will be hereinafter referred to as nozzles a, b, c, d, e and f, respectively) are calculated. As described above, the water droplets can proceed farthest from a nozzle at an angle of nozzle elevation of about 30°, exactly 27°, when the water pressure is constant, and thus the angle of elevation of nozzle a capable of sprinkling water to the farthest point A from the sprinkler location O is set to 30°.

Tests for determining the diameter of nozzle a were carried out at an angle of elevation of nozzle a of 30°, and it was found that water could be sprinkled approximately to the point A when the diameter of nozzle a was 0.7 mm.

It is known that when the nozzle diameter is constant, the sprinkling distance of water droplets at an angle of nozzle elevation of 30° is 1.4–1.5 times the sprinkling distance of water droplets at an angle of nozzle elevation of 60°, whereas a ratio of distance OA/distance OB=7/5=1.4. Thus, the diameter of nozzle b for sprinkling water approximately to the point B is set to 0.7 mm and the angle of elevation of nozzle b is set to 60°.

When the diameters and angles of elevation of nozzles a and b are set to the above-mentioned figures, the sprinkling distance of water droplets at an angle of nozzle elevation of 30° is 7 m and that at 60° is 5 m, that is, its difference in the distance is 2 m (=7–5). In other words, when the nozzle diameter is constant, a change in the angle of nozzle elevation by 30° will change the sprinkling distance by 2 m. That is, it can be seen that, when the sprinkling distance of water droplets is in a range of 7 m to 5 m under the above-mentioned conditions, an angle of nozzle elevation must be increased by 1.5° to shorten the sprinkling distance by 10 cm. For example, the distance OC (≈6.4 m) is shorter than the distance OA (≈7 m) by 0.6 m, the angle of elevation of nozzle c for sprinkling water approximately to the point C will be 39° (=30°+6×1.5°). Likewise angles of elevation of nozzles d, e and f can be calculated to be 48°, 54° and 58.5°, respectively. Diameters of nozzles c to f are each set to 0.7 mm. Diameters, sector angles and angles of elevation of nozzles a to f are shown in Table 1.

Water sprinkling tests were carried out by setting diameters, sector angles and angles of elevations of nozzles a to f as above, and by using engineering plastics comprising a polymer alloy of polyphenyleneether (PPE) and polyamide, containing 20% by weight of talc on the basis of the polymer alloy as materials for the sprinkler head.

The water sprinkling tests were carried out by arranging top-open measure boxes each with a bottom square of 16 cm×16 cm and a height of 3.5 cm in the triangular zone OAB in the sprinkling area (FIG. 9) closely without any clearances therebetween and by sprinkling water from the sprinkler head for 10 minutes. After the water sprinkling, depth, i.e. depth per 256 cm$^2$, of water stored in the respective measure boxes was measured. In the following description, volume of water stored in one pressure box per hour, converted to depth of water per hour, will be called "sprinkling intensity", which will be also referred to as "sprinkled water volume per unit area". For example, when the depth of water stored in one measure box per hour is 10 mm, the sprinkling intensity in the box is 10 mm.

Figure 5:
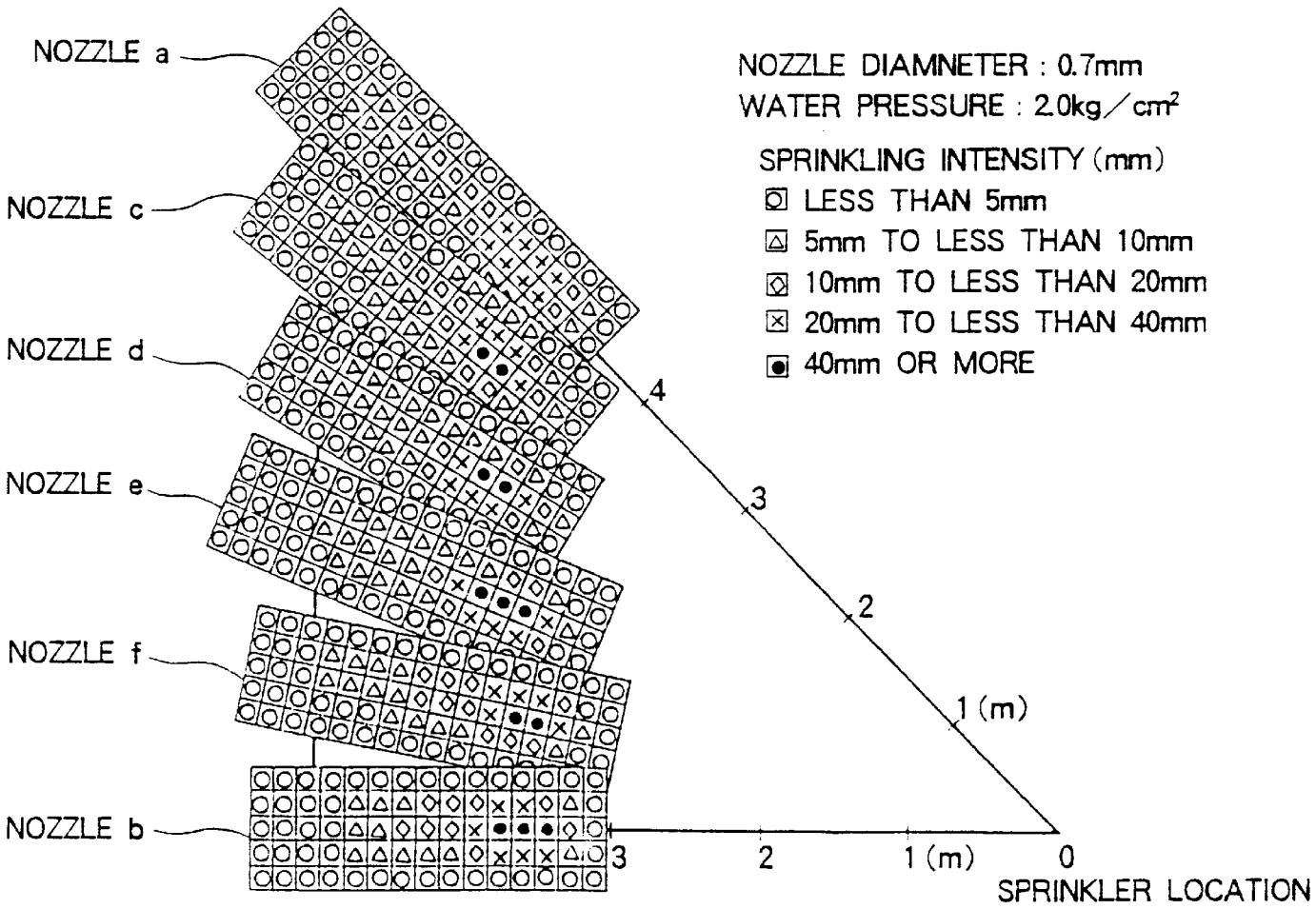
FIGS. 5, 6, 7 and 8 show sprinkled water intensity distributions as parts of the result of the water sprinkling test conducted in the same manner as in FIG. 4.

Results of water sprinkling tests conducted under the above-mentioned conditions are shown in FIG. 5 as a sprinkling intensity distribution, which corresponds to a sprinkled water distribution. As is evident from FIG. 5, water droplets sprinkled, for example, from nozzle a are distributed in a narrow zone along the segment OA as a center line with a width of about 50 cm, and further water droplets can be sprinkled approximately to the entire segment AB with a sprinkling intensity of 5 mm to 40 mm from nozzles a to f.

Zone not sprinkled from nozzles a to f in the triangle OAB, that is, the zone near the sprinkler location O in the triangle OAB, will be studied. It is evident from the foregoing sprinkling tests that water can be sprinkled all over the zone distant from the sprinkler location O by 5 m or more, and cannot be sprinkled in the zone distant from O by less than 5 m.

Figure 11:
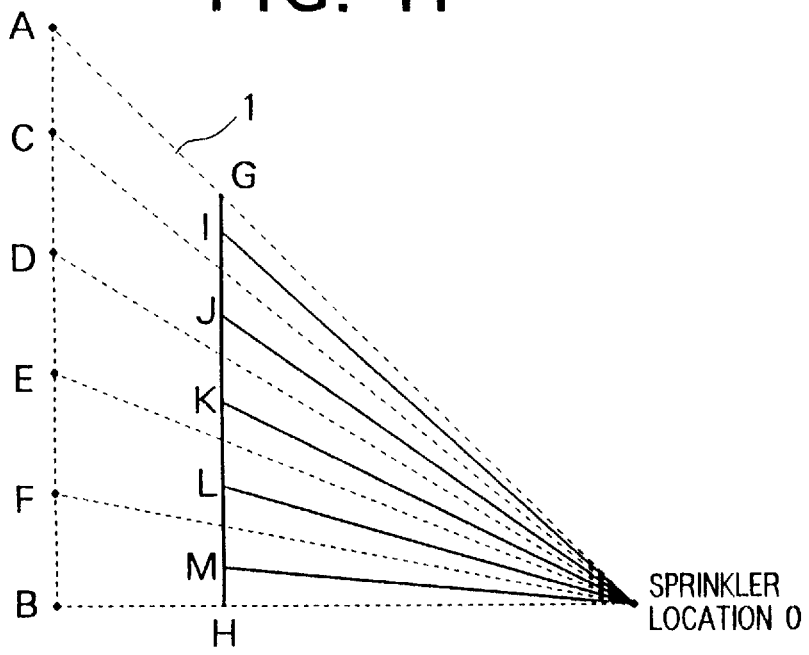

In order to efficiently sprinkle water to the zone near the sprinkler location O, a segment GH in parallel to the segment AB is drawn from the point G, 5 m distant from the sprinkler location O, as shown in FIG. 11, and water must be sprinkled approximately to points I, J, K, L and M as intersections on the segment GH with bisectors of ∠AOC, ∠COD, ∠DOE, ∠EOF and ∠FOB, respectively, from the respective nozzles. Distances from the sprinkler location O to the respective points I to M are as follows: distance OI≈4.8 m, distance OJ ≈4.3 m, distance OK≈3.9 m, distance OL≈3.7 m and distance OM≈3.6. Their sector angles are as follows: sector angle AOI≈3°, sector angle AOJ≈10°, sector angle AOK≈19°, sector angle AOL≈29° and sector angle AOM≈40°.

Angles of elevation of nozzles capable of sprinkling water approximately to the respective points I to M, that is, nozzles i, j, k, l and m are calculated. As already mentioned above, when the water pressure on the nozzles and the nozzle diameter are constant, water droplets sprinkled from nozzles are sprinkled onto a narrower sprinkling area with increasing angle of nozzle elevation, and thus in order to obtain a substantially constant sprinkling intensity, the diameters of nozzles i to m are set to 0.6 mm, which is smaller than the diameters of nozzles a to f, i.e. 0.7 mm.

Sprinkling tests were carried out for determining an angle of elevation of nozzle i whose nozzle diameter was set to 0.6 mm. It was found that water could be sprinkled approximately to the point I at an angle of nozzle elevation of 50°. When the tests were conducted for determining an angle of elevation of nozzle m whose nozzle diameter was set to 0.6 mm, it was found that water could be sprinkled approximately to the point M at an angle of elevation of 70°.

When the diameters and angles of elevation of nozzles i to m are set to the above-mentioned figures, the sprinkling distance of water droplets is 4.8 m at an angle of elevation of 50° and 3.6 m at an angle of elevation of 70°, a difference in the sprinkling distance is 1.2 m (=4.8−3.6), and thus a change in the angle of elevation by 20° will change the sprinkling distance by 1.2 m. That is, when the sprinkling distance of water droplets is in a range of 4.8 m to 3.6 m under the above-mentioned conditions, a sprinkling distance can be shortened by 10 cm by increasing the angle of elevation by 1.7°. For example, the distance OJ (≈4.3 m) is shorter by 0.5 m than the distance OI (≈4.8 m), and thus the angle of elevation of nozzle j for sprinkling water to the point J will be 50°+5×1.7≈58°. Likewise, angles of elevation of nozzles k and l will be 65° and 68°, respectively. Diameters, sector angles and angles of elevation of nozzles i to m are also shown in Table 1.

Figure 6:
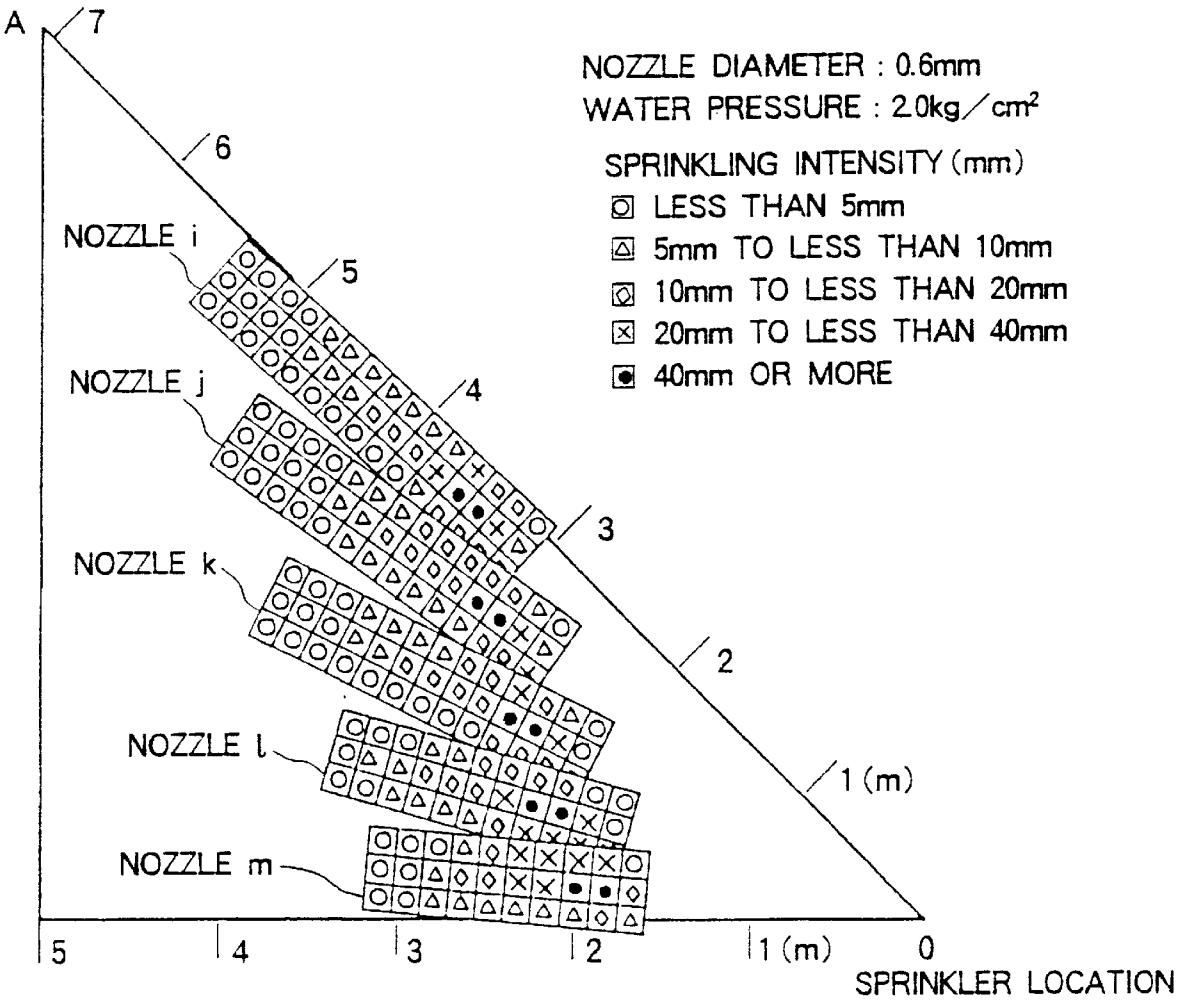

Results of water sprinkling tests under the same conditions as before by setting the diameters, sector angles and angles of elevation of nozzles i to m as mentioned above are shown in FIG. 6 as a sprinkling intensity distribution. As is evident from FIG. 6, water droplets, for example, from the nozzle i can be sprinkled in a narrow zone along the segment OI as a center line with a width of about 50 cm, and further water droplets can be sprinkled approximately to the entire segment GH with a sprinkling intensity of 5 mm to 40 mm from nozzles i to m.

Figure 7:
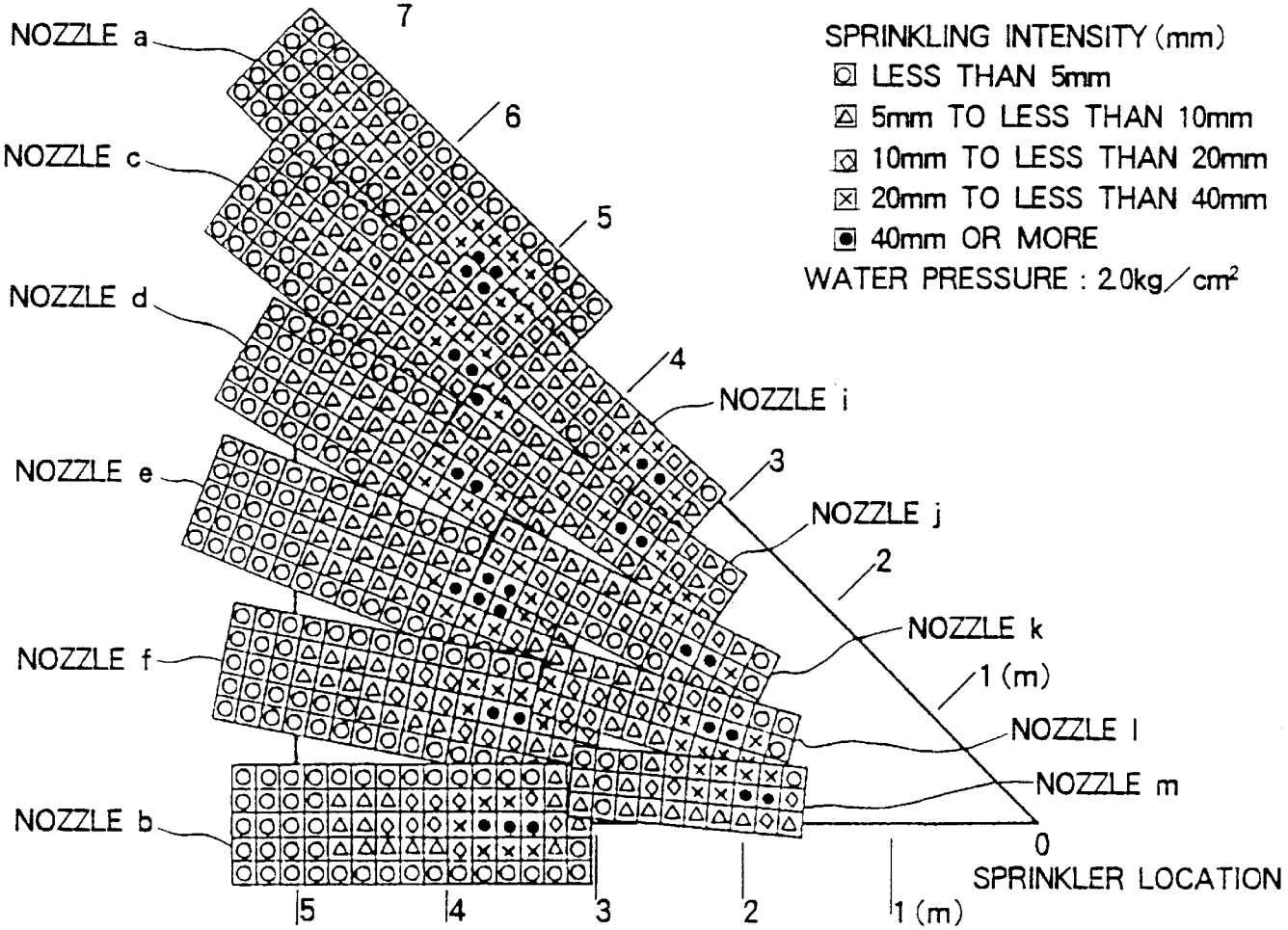

Sprinkling intensity distribution prepared by overlapping the sprinkling intensity distribution (FIG. 5) obtained by the water sprinkling tests through nozzles a to f with that (FIG. 6) obtained by the water sprinkling tests through nozzles i to m is shown in FIG. 7. Sprinkling intensity at the overlapped positions of the measure boxes, i.e. sprinkling intensity distributions, is a value obtained by addition of two values of water depth. As is evident from FIG. 7, it can be seen that water droplets from the nozzles a to m can be sprinkled all over the region by at least about 3 m far from the sprinkler location O with a sprinkling intensity of about 5 mm to about 40 mm.

Zone not sprinkled by the water droplets from the nozzles a to m in the triangle OAB, that is, the zone much near the sprinkler location O in the triangle OAB, will be studied.

Tests were carried out for determining nozzle diameters, sector angles and angles of nozzle elevation in the same manner as above. It was found that, when the diameters, sector angles and angles of elevation of nozzles n, and p to s were set to figures shown in Table 1, the zone much near the sprinkler location O could be sprinkled with water.

TABLE 1

| Nozzle identification | Nozzle diameter (mm) | Sector angle (°) (Angle from segment OA) | Angle of nozzle elevation (°) |
|---|---|---|---|
| a | 0.7 | 0 | 30 |
| b | 0.7 | 45 | 60 |
| c | 0.7 | 6 | 39 |
| d | 0.7 | 14 | 48 |
| e | 0.7 | 23 | 54 |
| f | 0.7 | 34 | 58.5 |
| i | 0.6 | 3 | 50 |
| j | 0.6 | 10 | 58 |
| k | 0.6 | 19 | 65 |
| l | 0.6 | 29 | 68 |
| m | 0.6 | 40 | 70 |
| n | 0.5 | 5 | 70 |
| p | 0.5 | 22.5 | 75 |
| q | 0.5 | 38 | 80 |
| r | 0.4 | 15 | 80 |
| s | 0.4 | 30 | 85 |

Figure 4:
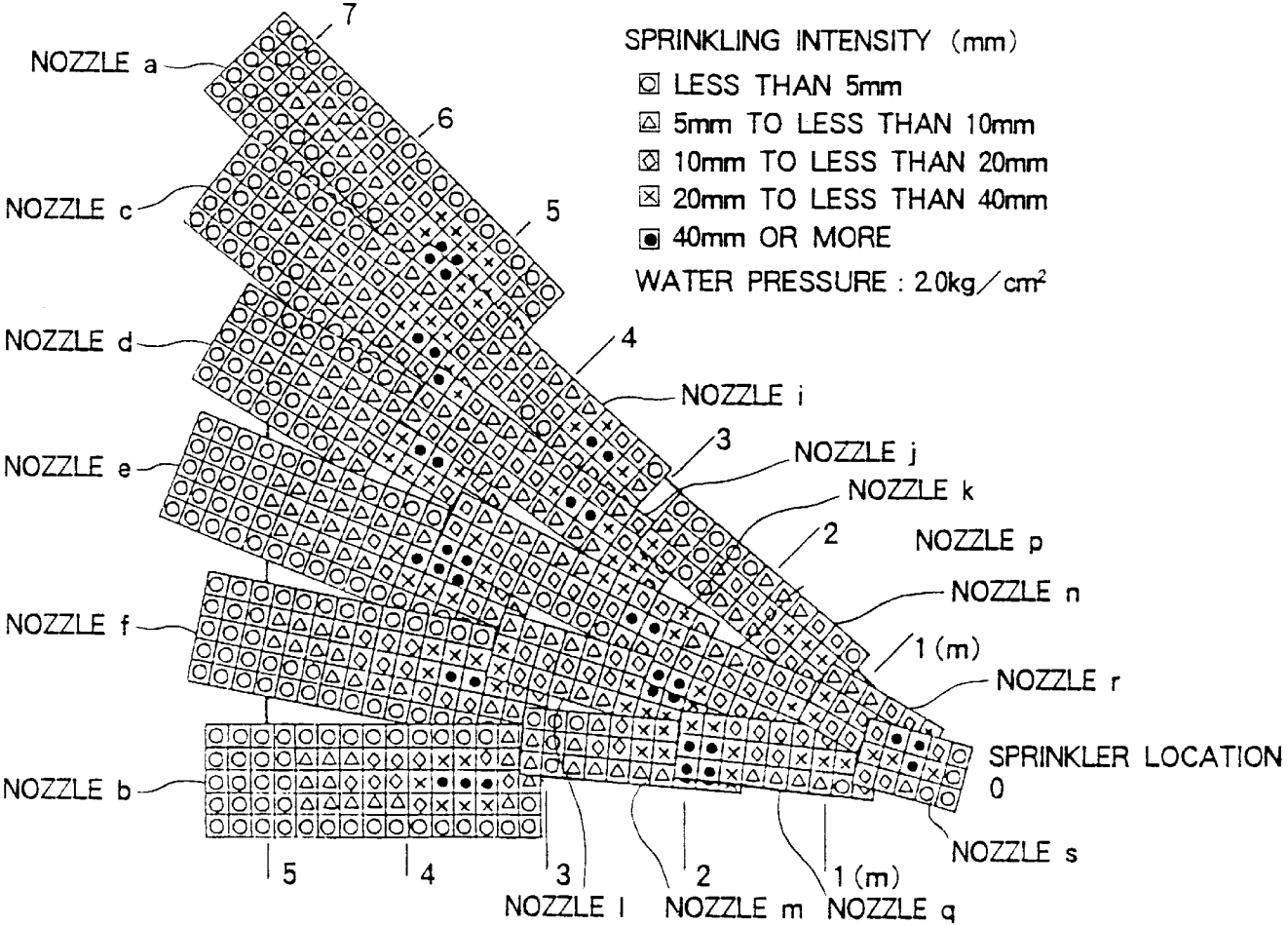
FIG. 4 shows a sprinkled water intensity distribution as a result of a water sprinkling test conducted by a liquid sprinkler with a sprinkler head according to an embodiment based on a first aspect of the present invention.
Figure 8:
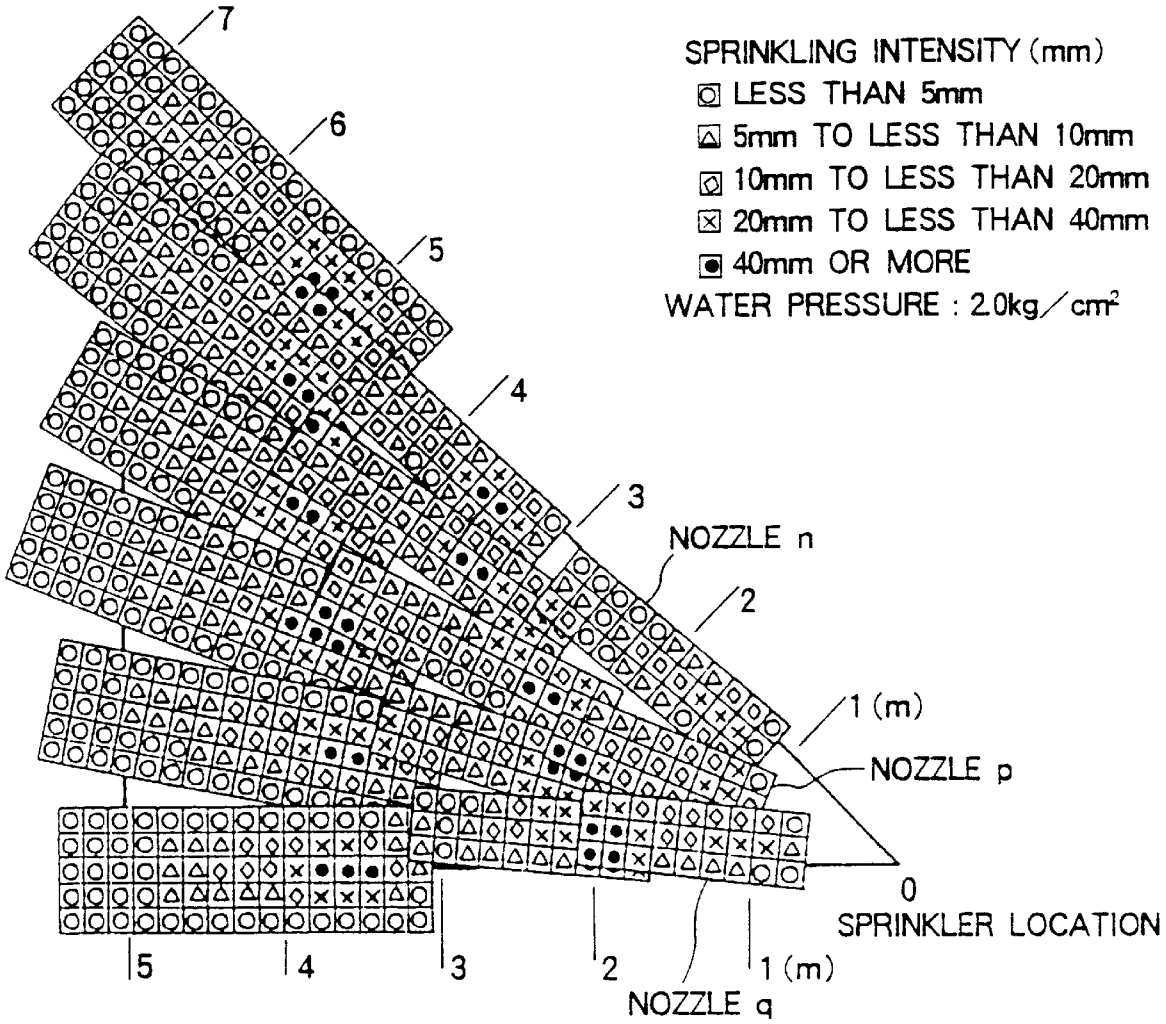

Results of water sprinkling tests under the same conditions as above by setting the diameters, sector angles and angle of elevation of nozzles n and p to s as mentioned above, as overlapped with the sprinkling intensity distribution obtained by the water sprinkling tests through the nozzles a to m (FIG. 7) are shown in FIGS. 4 and 8 as sprinkling intensity distributions, respectively. As is evident from FIGS. 4 and 8, the entire triangle OAB can be sprinkled with water droplets from total 16 nozzles a to n and p to s with a sprinkling intensity of about 5 mm to about 40 mm. That is, the entire one-eighth zone of the sprinkling area 1 can be gently sprinkled with the water droplets from the nozzles a to s.

In FIG. 4 there are some blank zones, i.e. zones not indicated with the sprinkling intensity. These blank zones are zones whose sprinkling intensity was not measured at the water sprinkling tests, but, of course, can be presumed to be entirely sprinkled with the water droplets, because water droplets are diffused into the soil of the sprinkled area, while some of them flows along the soil surface of the sprinkled area. Even if there are some fluctuations in the sprinkling intensity from points to points, it can be presumed that water is substantially uniformly sprinkled in the one-eighth zone of the sprinkling area 1 by sprinkling water all over the triangle OAB, as described above.

By applying the diameters, sector angles and angles of elevation of nozzles a to n and p to s set in the above-mentioned procedure to the remaining seven-eighths zones of the sprinkling area 1, nozzle diameters, sector angles and angles of nozzle elevation capable of sprinkling water onto the entire sprinkling area 1 can be likewise determined simply. Since the segments OA and OB of triangle OAB are common to those of adjacent triangles, and since water droplets from the nozzles a and b can be sufficiently sprinkled approximately to the segments OA and OB of the adjacent triangles, as is evident from FIG. 4, one of the overlapped nozzles destined to sprinkle water approximately to these segments OA and OB can be omitted. Thus, 120 nozzles (=16×8−8) must be provided to sprinkle water substantially uniformly all over the sprinkling area 1, that is, from the area much near the sprinkler location O to the corners.

Water droplets can proceed farther by making the water pressure higher than 2 kg/cm$^2$, but no farther at a lower water pressure than 2 kg/cm$^2$. Thus, the sprinkling distance of water droplets can be changed as desired by changing the water pressure, that is, by changing the water pressure on the nozzles with a pressure-changing means capable of changing the water pressure in a specific range, for example, 1 to 2 kg/cm$^2$, such as a pump, etc.

The foregoing description has been limited to sprinkling of water onto the sprinkling area 1 of 10 m×10 m square, but the shape of the sprinkling area is not limited to the square shape, but any other desired shape such as a rectangle or polygons, a circle and an ellipse can be sprinkled. Size of the sprinkling area is not limited in the present invention. Furthermore, combinations of diameters and angles of elevations of nozzles a to n and p to s are not limited to the combinations determined according to the above-mentioned procedure, and any other combinations are possible, for example, in view of the sprinkled water volume per unit area, etc.

In the foregoing description, the number of nozzles for sprinkling water all over the triangle OAB, that is, the one-eighth zone of the sprinkling area 1, is set to 16, but the number of nozzles is not particularly limited.

Another embodiment for sprinkling water approximately to the segment AB of triangle OAB will be described below.

Figure 12:
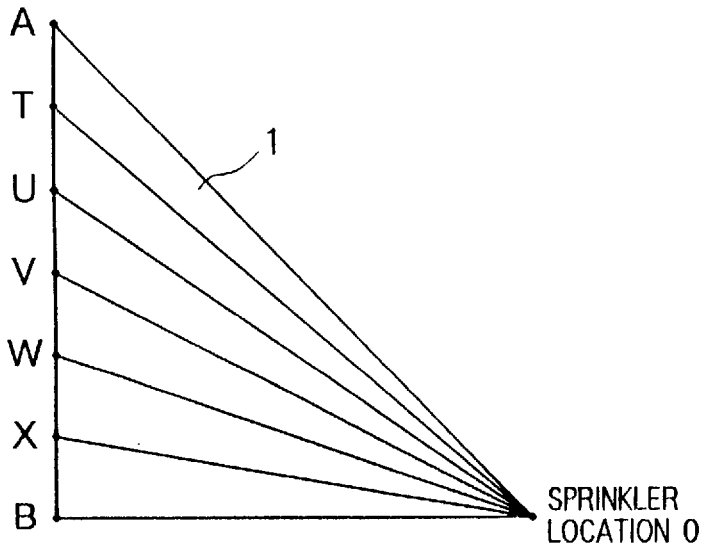

Water is to be sprinkled approximately to the segment AB through 7 nozzles in place of 6 nozzles a to f. As shown in FIG. 12, the segment AB is divided into 6 equal subsegments, and water must be sprinkled approximately to the respective points A, B, T, U, V, W and Z from the respective nozzles. Distances to the respective points, A, B and T to X from the sprinkler location O are as follows: distance OA=≈7 m, distance OB=5 m, distance OT≈6.5 m, distance OU≈6.0 m, distance OV≈5.6 m, distance OW≈5.3 m and distance OX ≈5.1 m. The respective sector angles are as follows: sector angle AOB=45°, sector angle AOT≈4°, sector angle AOU≈11°, sector angle AOV≈18°, sector angle AOW≈27° and sector angle AOX≈36°.

Angles of elevation of nozzles capable of sprinkling water approximately to the respective points A, B, T to X, that is, nozzles a', b', t, u, v, w and x, respectively, are calculated in the same manner as above. Angles of elevation of nozzles a', b' and t to x are 30°, 60°, 37.5°, 45°, 51°, 55.5° and 58.5°. Diameters of nozzles a', b'and t to x are each set to 0.7 mm. Diameters, sector angles and angles of elevation of the nozzles a', b' and t to x are shown in Table 2.

TABLE 2

| Nozzle identification | Nozzle diameter (mm) | Sector angle (°) (Angle from segment OA) | Angle of nozzle elevation (°) |
|---|---|---|---|
| a' | 0.7 | 0 | 30 |
| b' | 0.7 | 45 | 60 |
| t | 0.7 | 4 | 37.5 |
| u | 0.7 | 11 | 45 |
| v | 0.7 | 18 | 51 |
| w | 0.7 | 27 | 55.5 |
| x | 0.4 | 36 | 58.5 |

Figure 13:
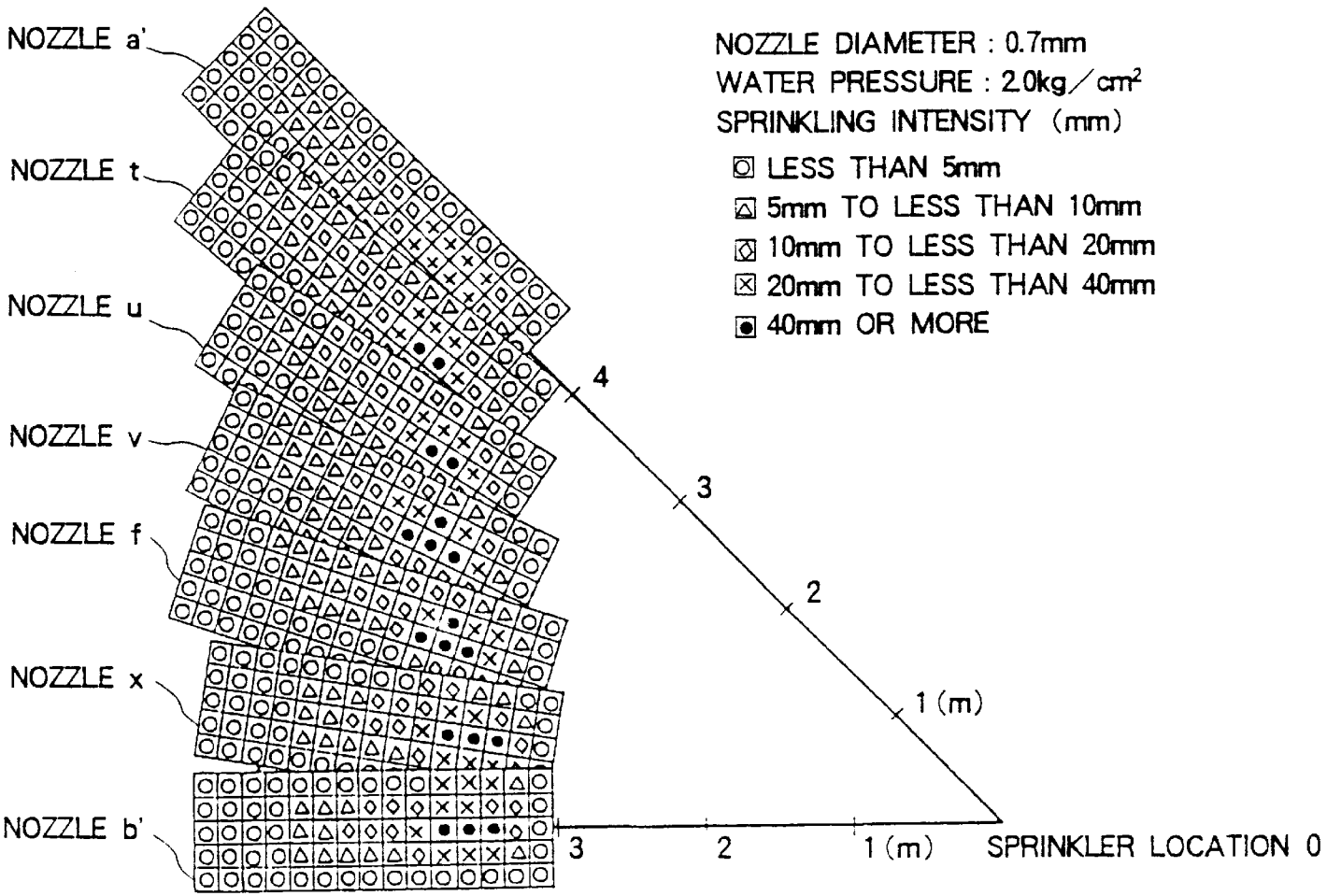
FIG. 13 shows a sprinkled water intensity distribution as part of the results of the water sprinkling test conducted in the same manner as shown in FIG. 4.

Results of water sprinkling tests under the same conditions as above by setting the diameters, sector angles and angle of elevations of nozzles a', b' and t to x to figures as mentioned above are shown in FIG. 13 as a sprinkling intensity distribution. As is evident from FIG. 13, water droplets can be sprinkled approximately to the entire segment AB with a sprinkling intensity of about 5 mm to about 40 mm from the nozzles a', b' and t to x. Small number of the nozzles is preferable from the viewpoint of the productivity of a rise pipe with a sprinkler head, that is, a liquid sprinkler.

It is also possible to determine optimum nozzle diameters, sector angles and angles of nozzle elevation by inputting data, for example, on varied nozzle diameters, angles of nozzle elevation and water pressure on nozzles into a computer and analyzing relations between these factors as to the sprinkling distance of water droplets in advance in place of determining nozzle diameters, sector angles and angles of nozzle elevation according to the shape and size of a sprinkling area by tests, etc. Thus, number, diameter and angles of elevation of nozzles and water pressure can be easily determined according to a sprinkling area of any shape and size by the so called computer simulation without any water sprinkling test.

Embodiments according to the second aspect of the present invention will be described in detail below:

In FIG. 2, a plurality of nozzles 2 are formed on a plurality of imaginary lines 9 intersecting one another at the vertex 3 of the hemispherical part 1*a* of the sprinkler head 1 and substantially extending along the surface of the hemispherical part 1*a*. In FIG. 2, only three imaginary lines are shown by two-dot chain lines, while other imaginary lines are not shown. Nozzles 2 formed along each imaginary line 9 must have increasing diameters with increasing distance of nozzles from the vertex 3, and the several nozzles 2 along each imaginary line 9 can have an equal diameter. That is, nozzles 2 formed along each imaginary line 9 must have a largest diameter at the farthest distance from the vertex 9 than the nozzles at the nearest distance to the vertex 3.

Pattern of the imaginary lines 9 on the sprinkler head 1 shown in FIG. 2, that is, a distribution pattern of nozzles 2, shows a case that the shape of a sprinkling area is a square. Thus, the pattern of nozzles 2 is not limited only to the pattern shown in FIG. 2.

In the embodiments, diameters of nozzles 2 are 0.4 mm for the nozzles located inside the closed curved line 8*a*, shown by a one-dot chain line; 0.5 mm for the nozzles located between the closed curved line 8*a* and the closed curved line 8*b;* 0.6 mm for the nozzles located between the closed curved line 8*b* and the closed curved line 8*c;* 0.7 mm for the nozzles located between the closed curved line 8*c* and the closed curved line 8*d*; and 0.8 mm for the nozzles located inside the closed curved lines 8*e* in FIG. 2. Of course, the distribution pattern of nozzles 2 and diameters of the respective nozzles 2 are not limited to those give above.

Sprinkled water volume per unit area of the sprinkler head 1 according to the second aspect of the present invention was investigated in the same manner as already described above by setting the nozzle distribution pattern and nozzle diameters to those shown in FIG. 2, and using a hemispherical part 1*a* of the sprinkler head 1 having a diameter of 5 cm, a water feed. rate of about 17l/min and a water pressure of about 2 kg/cm$^2$ on the nozzles 2.

Figure 14:
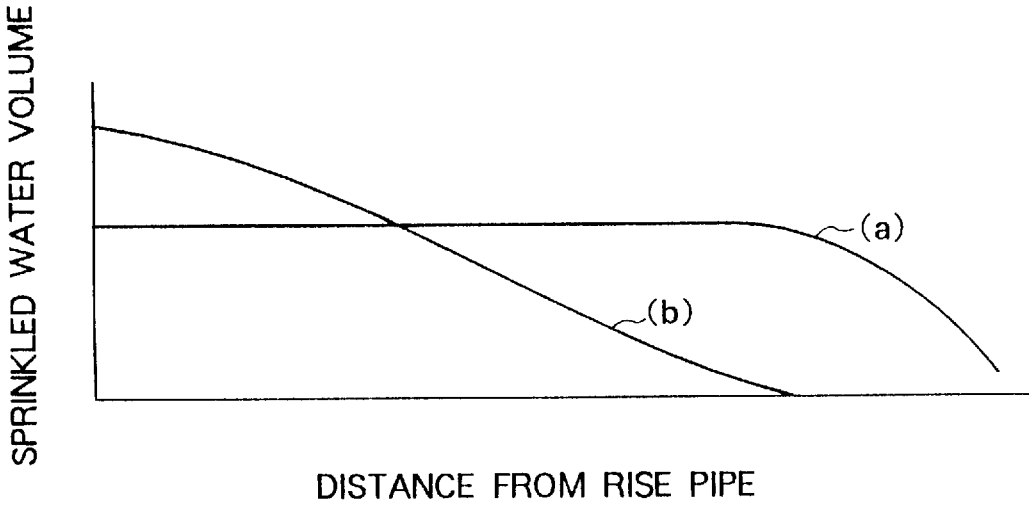
FIG. 14 shows profiles of sprinkled water distribution in relation to the distance from the rise pipe.

The sprinkled water volume per unit area measured under the above-mentioned conditions is shown in FIG. 14, where the abscissa shows a distance from the rise pipe 11, the ordinate shows a sprinkled water volume per unit area, curve (a) shows the sprinkled water volume per unit area according to the second aspect of the present invention and curve (b) shows that of a comparative sprinkler head made in the following manner. That is, a comparative sprinkler head was prepared in the same structure and under the same conditions as those for the present sprinkler head 1 except all the nozzles were made to have an equal diameter and equal total nozzle opening area to that of nozzles 2 of the present sprinkler head 1.

As is evident from FIG. 14, the present sprinkler head 1 can sprinkle water substantially uniformly all over the sprinkling area, whereas the comparative sprinkler head sprinkles much water only in the zone near the sprinkler and the sprinkled water volume per unit area decreases with increasing distance from the sprinkler. Thus, the comparative sprinkler head cannot sprinkle water uniformly.

Figure 15:
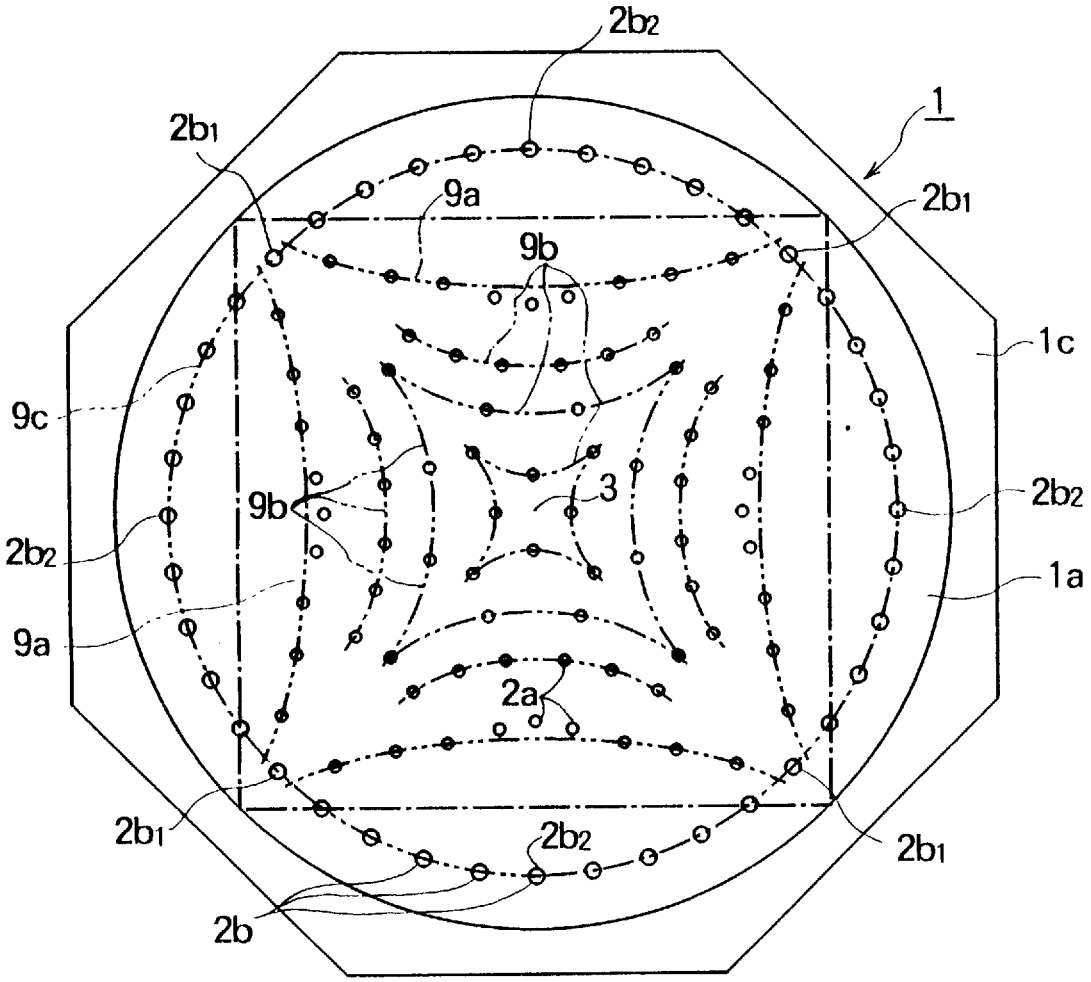
FIGS. 15 and 16 are a plan view and an elevation view, respectively, of a sprinkler head according to an embodiment based on a third aspect of the present invention.
Figure 16:
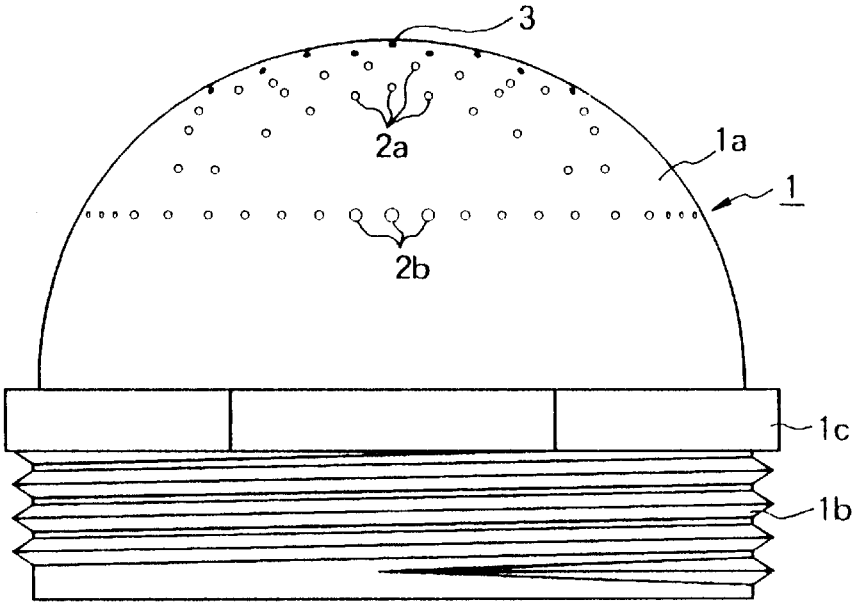

Embodiments according to the third aspect of the present invention will be described in detail below:

In FIG. 15, which is a plan view of the surface of the hemispherical part 1*a*, as viewed from the overhead of the vertex 3 (where FIG. 16 is an elevation view of the hemispherical part 1*a*), a plurality of nozzles 2*a* are formed along 4 imaginary lines 9*a* defined by four sides of a square as a polygon surrounding the vertex 3 and curved inwardly toward the vertex 3, as shown by two-dot chain lines, and along a plurality of imaginary lines 9*b* drawn along the imaginary lines 9*a* but inside the imaginary lines 9*a* toward the vertex 3, as shown also by two-dot chain lines.

Nozzles 2*a* formed along one imaginary line 9*a* or 9*b* are made to have an equal diameter. A pattern of imaginary lines 9*a* and 9*b* on the sprinkler head 1 shown in FIG. 15, that is, a distribution pattern of nozzles 2*a*, shows a case where the shape of a sprinkling area is a square. Thus, the distribution pattern of nozzles 2*a* is not limited only to that shown in FIG. 15.

In FIG. 15, nozzles 2*b* are formed along an imaginary circle 9*c* around the vertex 3 as a center, as shown by a two-dot chain line. Among nozzles 2*b*, the nozzles $2b_1$ locating near the intersection of the imaginary circle 9*c* and the imaginary lines 9*a* are made to have the smallest diameter, whereas the nozzles $2b_2$ locating farthest from the imaginary lines 9*a* are made to have the largest diameter. Other nozzles 2*b* are made to have increasing diameters in the direction from the nozzle $2b_1$ toward nozzle $2b_2$. The pattern of imaginary circle 9*c* on the surface of sprinkler head 1 shown in FIG. 15, that is, distribution pattern and diameters of nozzles 2*b*, shows a case that the shape of desired sprinkling area is a square. Thus, the distribution pattern of nozzles 2*b* is not limited only to the pattern shown in FIG. 15.

As already mentioned before, in order to make the sprinkled water volume per unit area substantially constant on the entire surface of a sprinkling area, it is necessary to make nozzles 2*b* formed at positions far from the vertex 3, that is, nozzles 2*b* located at a small angle of nozzle elevation, larger than nozzles 2*a* located at positions near the vertex 3, that is, nozzles 2*a* at large angles of nozzle elevation. Furthermore, in order to sprinkle water all over a sprinkling area of any shape and size, it is necessary to select diameters of nozzles 2*a* and 2*b* according to their positions, i.e. angles of nozzle elevation and a desired sprinkling distance.

Diameters of nozzles 2*a* are not particularly limited, and preferably are in a range of 0.1 mm to 2 mm.

In the embodiments according to the third aspect of the present invention, diameters of nozzles 2*a*, for example, nozzles 2*a* locating along the imaginary lines 9*a*, are set to 0.7 mm, and those of nozzles 2*a* locating along the imaginary lines 9*b* adjacent to the imaginary lines 9*a* are set to 0.6 mm. That is, diameters of nozzles 2*a* locating along the imaginary lines 9*b* are set to 0.6 mm, 0.5 mm and 0.4 mm successively in the direction from the imaginary lines 9*b* farthest from the vertex 3 to the imaginary lines 9*b* nearest to the vertex 3. Nozzle distribution pattern and diameter of nozzles 2*a* are, of course, not limited only to those mentioned above.

Diameters of nozzles 2*b* are not particularly limited and preferably are in a range of 0.1 mm to 2 mm. By making the diameters of nozzles 2*b* have the figures in the above-mentioned range, water can be more substantially uniformly sprinkled all over the sprinkling area. Nozzles 2*b* must be formed in view of uses, etc. of the sprinkler head 1, that is, the liquid sprinkler. That is, nozzles 2*b* must be provided on the hemispherical part 1*a* of the sprinkler head 1, as required. In other words, no nozzles 2*b* may be formed on the sprinkler head 1.

In the present embodiment, diameters of nozzles 2*b* are set to 0.8 mm for nozzles $2b_1$ and 1.3 mm for nozzles $2b_2$, and diameters of other nozzles 2*b* are set to increasing figures between 0.8 mm and 1.3 mm in the direction from the nozzle $2b_1$, toward the nozzle $2b_2$. Of course, the distribution pattern and diameter of nozzles 2*b* are not limited only to those given above.

Water pressure on the sprinkler head 1, that is, nozzles 2*a* and 2*b*, are not particularly limited, and can be selected from the water pressure range as already mentioned before by changing it with a water-pressure changing means.

The present sprinkler head 1 is in a rhombic shape as a polygonal shape. In the foregoing embodiment, square shape is illustrated as a polygonal shape. Thus, water can be sprinkled substantially uniformly all over a sprinkling area of rectangular shape, such as a square shape.

Diameters of nozzles 2*a* formed along the same imaginary line 9*a* or 9*b* on the sprinkler head 1 of the present embodiment have an equal diameter, and thus water can be sprinkled more substantially uniformly all over a sprinkling area of any shape and size.

The polygonal shape is not limited only to the rhombic shape, as already mentioned above, and any shape, for example, a triangular or pentagonal shape, can be used. In other words, the shape of the polygon must be set to meet the shape of a sprinkling area. Furthermore, number of imaginary lines 9*a* and 9*b* is not particularly limited. Position and number of the imaginary circles 9*c*, that is, distribution pattern of nozzles 2*b*, are not particularly limited.

Sprinkled water volume per unit area of the sprinkler head 1 according to the present embodiment will be described below.

Figure 17:
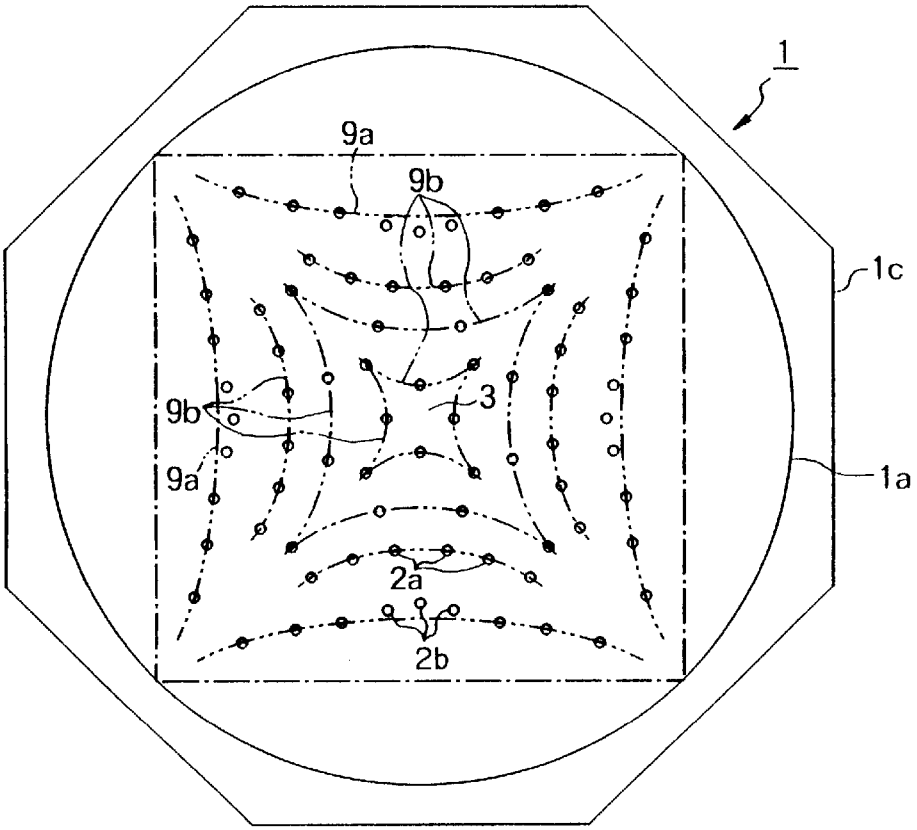
FIGS. 17 and 18 are a plan view and an elevation view, respectively, showing a modification of the sprinkler head shown in FIGS. 15 and 16.
Figure 18:
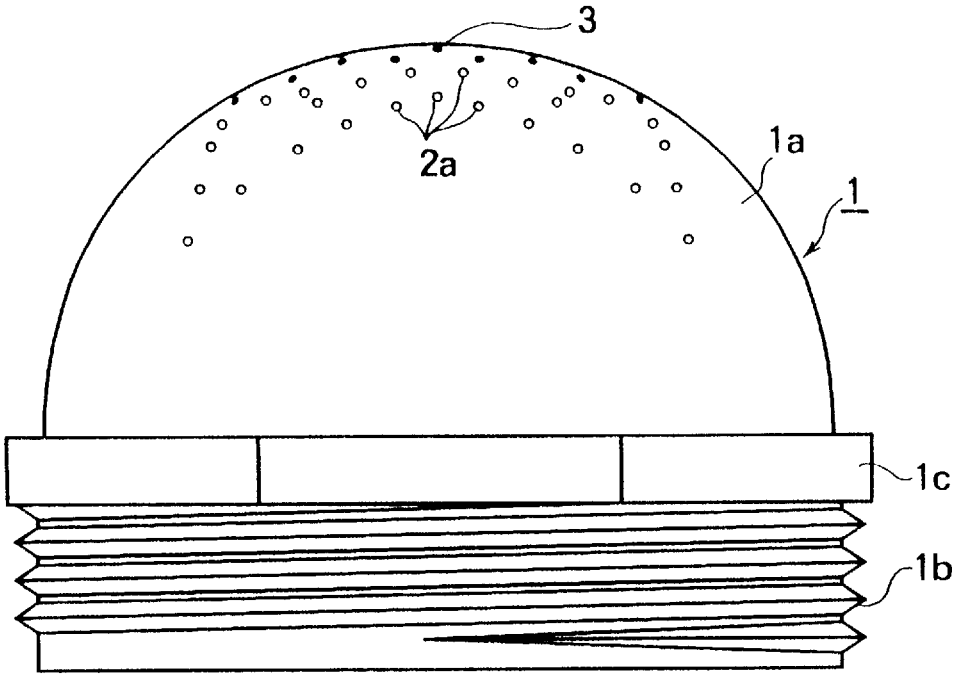

Water sprinkling tests were carried out in the same manner as already described before with a sprinkler head 1 having a hemispherical part 1*a*, 5 cm in diameter and a distribution pattern and diameters of only nozzles 2*a* as shown in FIGS. 17 and 18. That is, the sprinkler head 1 had no nozzles 2*b*. Water was sprinkled at a water feed rate of about 17l/min and a water pressure of about 2 kg/cm$^2$. The distribution pattern and diameters of nozzles 2*a* shown in FIGS. 17 and 18 were the same as given in FIGS. 15 and 16.

Figure 19:
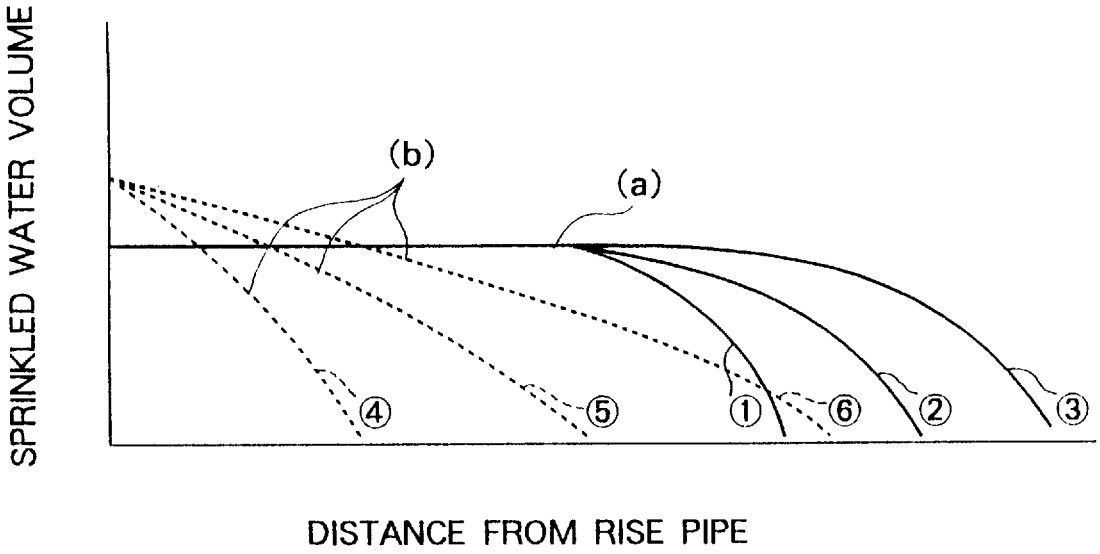
FIG. 19 shows profiles of sprinkled water distribution in relation to the distance from the rise pipe.

Results of sprinkled water volume per unit area measured under the above-mentioned conditions are shown in FIG. 19, where a group of curves (a) shows sprinkled water volume per unit area of the sprinkler head 1, among which the curve ① shows the sprinkled water volume directed toward the centers of four sides of the square sprinkling area, the curve ③ shows the one directed toward the four corners of the square sprinkling area and the curve ② shows the one directed toward the intermediate segments between the centers of the four side and the four corners of the square sprinkling area.

On the other hand, a comparative sprinkler head was tested in the water sprinkling tests to measure the sprinkled water volume per unit area. The comparative sprinkler head was prepared under the same structure and conditions as shown in FIGS. 17 and 18, except number of nozzles per imaginary line was equal throughout all the imaginary lines, and all the nozzles on the comparative sprinkler head were set to have the same total nozzle opening area as that of all the nozzles 2*a* on the present sprinkler head 1.

Sprinkled water volumes per unit area of the comparative sprinkler head varies, depending on the direction of water sprinkling, as shown by a group of curves (b) as dotted lines in FIG. 19, among which the curve ④ shows sprinkled water volume directed toward the centers of the four sides of the square sprinkling area, the curve ⑥ shows the one directed toward the four corners of the square sprinkling area, and the curve ⑤ shows the one directed toward the intermediate segments between the center points and the corners of the square sprinkling area.

As is evident from FIG. 19, the present sprinkler head 1 can sprinkle water substantially uniformly all over the square sprinkling area, whereas the comparative sprinkler head has varied sprinkled water volumes per unit area, depending on the sprinkling directions. Furthermore, the comparative sprinkler head has a larger sprinkled water volume per unit area in the zone near the sprinkler and a decreasing sprinkled water volume per unit area with increasing distance from the sprinkler. Thus, the comparative sprinkler head fails to conduct uniform water sprinkling.

Figure 20:
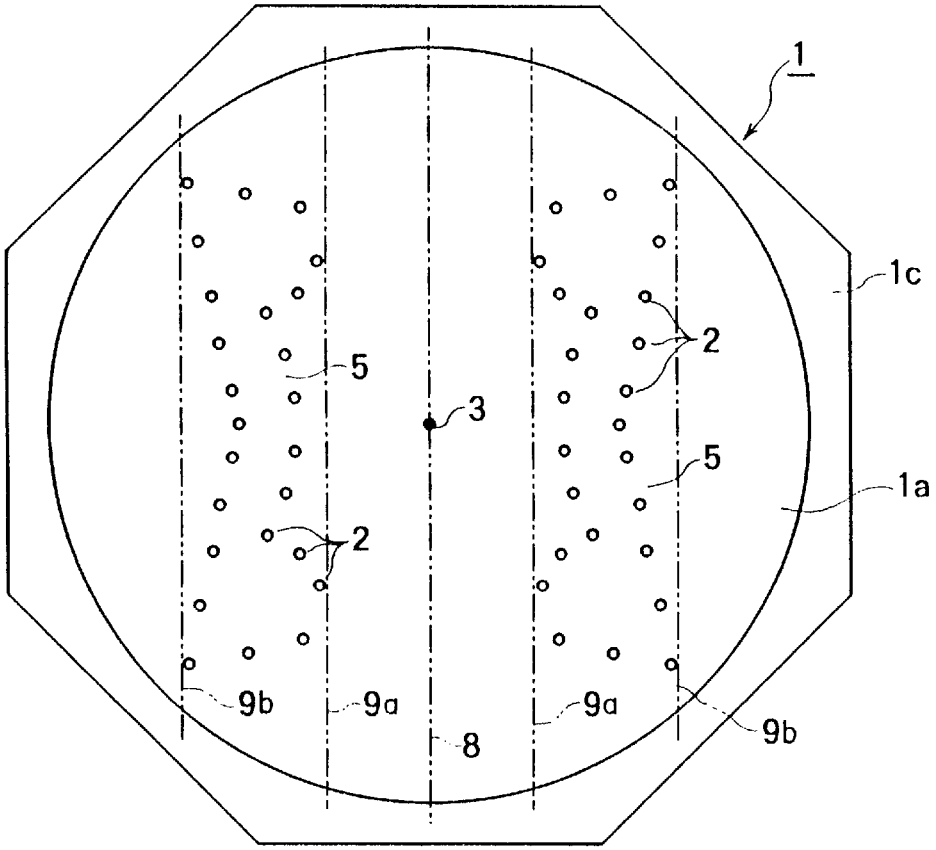
FIGS. 20 and 21 are a plan view and an elevation view of a sprinkler head according to one embodiment based on a fourth aspect of the present invention.
Figure 21:
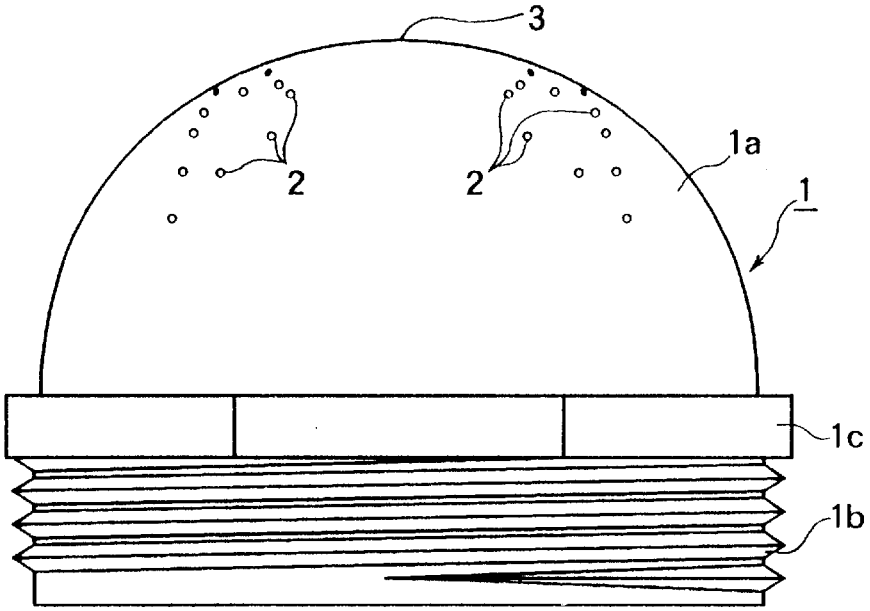

Embodiments according to the fourth aspect of the present invention will be described in detail below:

In FIG. 20, which is a plan view of the surface of the hemispherical part 1*a* of the substantially hemispherical sprinkler head 1, as viewed from the vertex side (FIG. 21 is an elevation view thereof), a plurality of nozzles 2 are formed in strip zones 5, provided substantially in parallel to a first imaginary straight line 8 passing through the vertex 3 of the substantially hemispherical sprinkler head 1, where the first imaginary straight line 3 is shown by a two-dot chain line. That is, the nozzles 2 are formed in each of the strip zones 5 and 5 provided on both sides along the imaginary straight line 8. In FIG. 20, each of the strip zones 5 are formed between two secondary imaginary straight lines 9*a* and 9*b* substantially in parallel to the first imaginary straight line 8, where the second imaginary straight lines 9*a* and 9*b* are shown also by two-dot chain lines.

Figure 22:
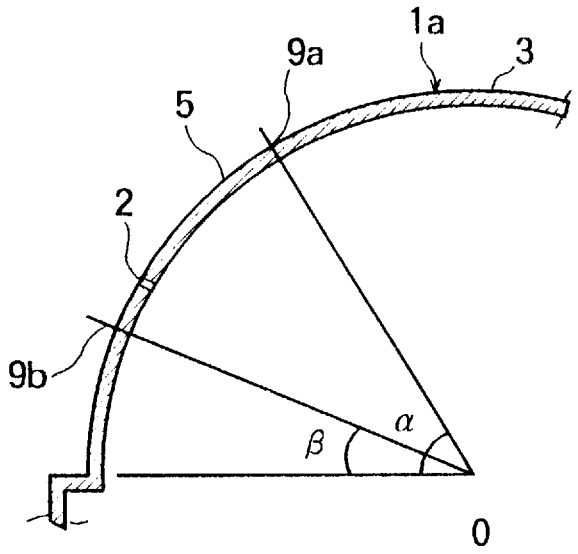
FIG. 22 is a vertical cross-sectional view of the essential part of the sprinkler head shown in FIG. 20, and shows a position of the strip zone on the sprinkler head.

As shown in FIG. 22, which is a vertical cross-sectional view to the first imaginary straight line 8 passing through the vertex 3, the strip zones 5, each between the second imaginary straight lines 9*a* and 9*b*, are so provided as to satisfy the following conditions: the imaginary second straight lines 9*a* near the vertex 3 are provided so as to satisfy such a condition as $15° \leqq \alpha \leqq 85°$, where $\alpha$ is an angle of elevation of the second imaginary straight lines 9*a* to the center or symmetrical center O of the hemispherical part 1*a*, whereas the second imaginary straight lines 9*b* far from the vertex 3 are so provided as to satisfy such a condition as $0° \leqq \beta \leqq 60°$, where $\beta$ is an angle of elevation of the second imaginary straight lines 9*b*, where such a condition as $\alpha < \beta$ must be also satisfied. Thus, the strip zones are provided in a range of an angle of elevation of the secondary imaginary straight lines to the center 0 of 0° to 85°, preferably 15° to 85°.

In the case of sprinkling water to, for example, various vegetables or flowers planted on the ridges, or to linearly planted trees, water sprinkling even to sprinkling-unwanted areas such as spaces between the lines of trees, etc. can be saved by providing the strip zones 5 so that the above-mentioned conditions can be satisfied. Thus, the volume of sprinkling water can be reduced. That is, the volume of wasted water can be reduced. Furthermore, by selecting angles of elevation of 15°–85° for the strip zones, impact forces of sprinkled water droplets on the soil surface of a sprinkling area can be made smaller. That is, water sprinkling can be carried out without rebounding of sprinkled water droplets from the soil surface, resulting in gentle water sprinkling. More specifically, the angles of elevation for the strip zones must be selected in view of, for example, size of a sprinkling area, a distance from the sprinkler to the desired water sprinkling area, nozzle diameter, etc.

Nozzles 2 formed in the strip zones 5 have increasing diameters with increasing distance from the vertex 3. That is, nozzles 2 can be formed so that their diameters can be successively larger with increasing distance from the vertex 3 or so that several adjacent nozzles 2 can have an equal diameter.

The pattern of the strip zones 5 on the water head 1, as shown in FIG. 20, that is, a pattern of nozzle distribution, illustrates such an example that the desired sprinkling area is in a rectangular shape, that is, a strip shape. Thus, the pattern of nozzle distribution is not limited to the one shown in FIG. 20.

In the present embodiment, diameters of nozzle are set to, e.g. 0.4 mm to 0.8 mm. Since one strip zone 5 is provided on each side of the first imaginary straight line 8 passing through the vortex 3 of the sprinkler head 1, the single sprinkler head 1 can sprinkle water onto two sprinkling zones at the same time by perpendicularly providing the sprinkler between the two sprinkling zones, when the sprinkling area is divided into the two sprinkling zones.

Since the strip zones 5 are each provided in a range of angles of elevation of 15° to 85° and the nozzle diameters are formed in a range of 0.4 mm to 0.8 mm, impact forces of sprinkled water droplets on the soil surface of a sprinkling area is made smaller and gentle water sprinkling can be carried out without rebounding of sprinkled water droplets from the soil surface. That is, there are no such fears that the sown seeds will flow away from the soil or the roots will be exposed from the soil by the sprinkled water to inhibit the growth of plants.

Sprinkled water volume per unit area of the sprinkler head 1 according to the embodiment based on the fourth aspect of the present invention will be described below:

A desired sprinkling area consisted of two sprinkling zones each having an equal rectangular sprinkling area, and the sprinkler was perpendicularly provided at the desired position between the two sprinkling zones, all over which water is to be sprinkled. Thus, a pattern of strip zones 5, that is, the distribution pattern of nozzles and nozzle diameters, were set to those given in FIG. 20. The hemispherical part 1*a* of the sprinkler head 1 had a diameter of 5 cm, the sprinkling water feed rate was about 14 l/min and the water pressure on the nozzles 2 was about 2 kg/cm$^2$.

The water sprinkling tests were carried out in the same manner as already described before. The results are shown in FIG. 23, where the curve (a) shows the present embodiment.

Sprinkled water volume per unit area of the conventional water sprinkler head having a nozzle with a total nozzle opening area equal to that of the nozzles 2 of the sprinkler head 1 of the present embodiment, was measured under the same test conditions as above. The results are shown by curve (b) in FIG. 23.

Figure 23:
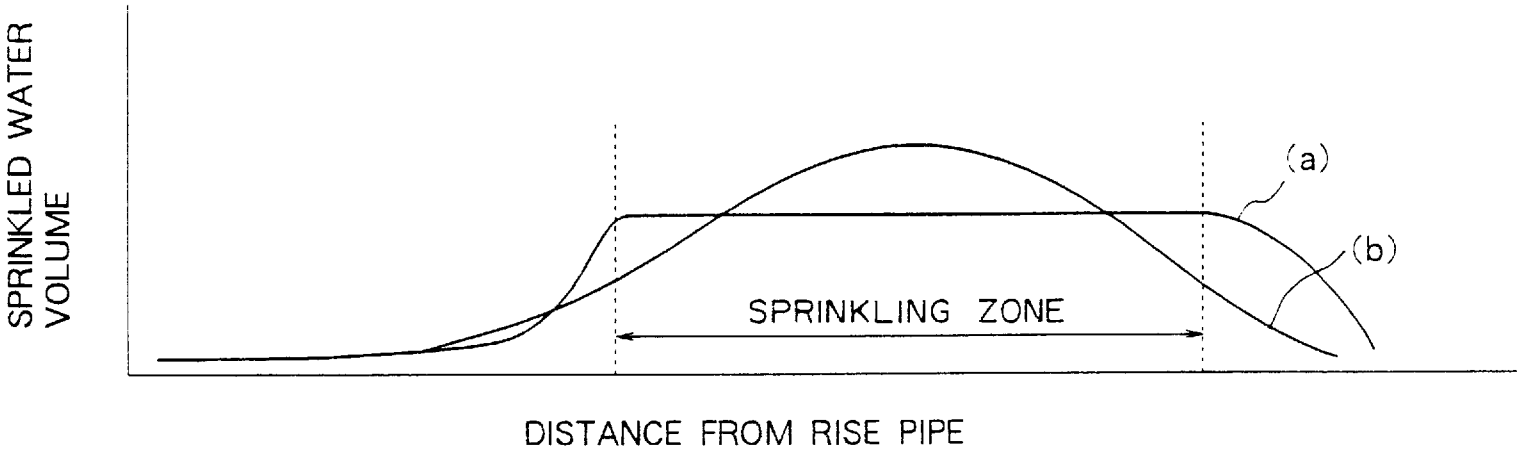
FIG. 23 shows profiles of sprinkled water distribution in the sprinkling area of the sprinkler head shown in FIGS. 20 and 21 in relation to the distance from the rise pipe.

As is evident from FIG. 23, the present sprinkler head can sprinkle water substantially uniformly all over the sprinkling zones, whereas the conventional water sprinkler head fails to conduct uniform water sprinkling.

The foregoing embodiment shows an example of a sprinkler head 1 capable of sprinkling water to two sprinkling zones at the same time, but the number of the sprinkling zones all over which the present sprinkler head 1 can sprinkle at the same time is not limited only to the two shown above.

In order to sprinkle water to 3 sprinkling zones at the same time, three strip zones must be provided on the sprinkler head. However, when water is to be sprinkled to various vegetables or flowers planted on ridges or to lines of linearly planted trees, etc., it is preferable to provide at least one strip zone at each side of the imaginary first straight line 8. When a plurality of strip zones are to be formed, a relative positional relationship of the strip zones is not particularly limited.

Figure 24:
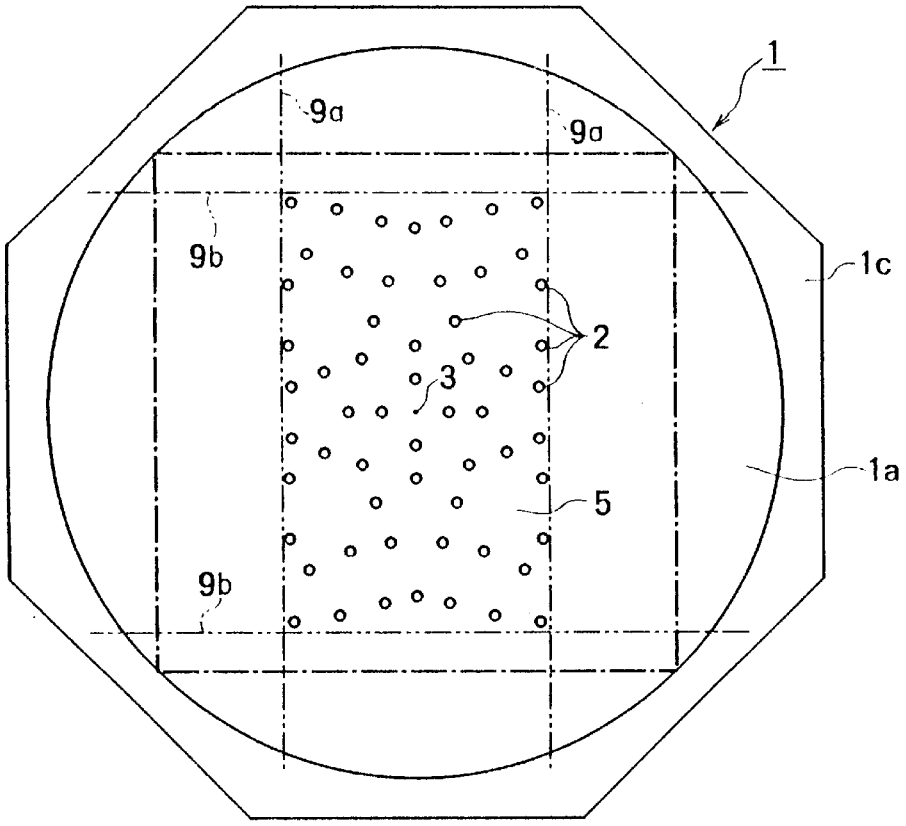
FIG. 24 and 25 are a plan view and an elevation view, respectively, of a sprinkler head according to one embodiment based on a fifth aspect of the present invention.
Figure 25:
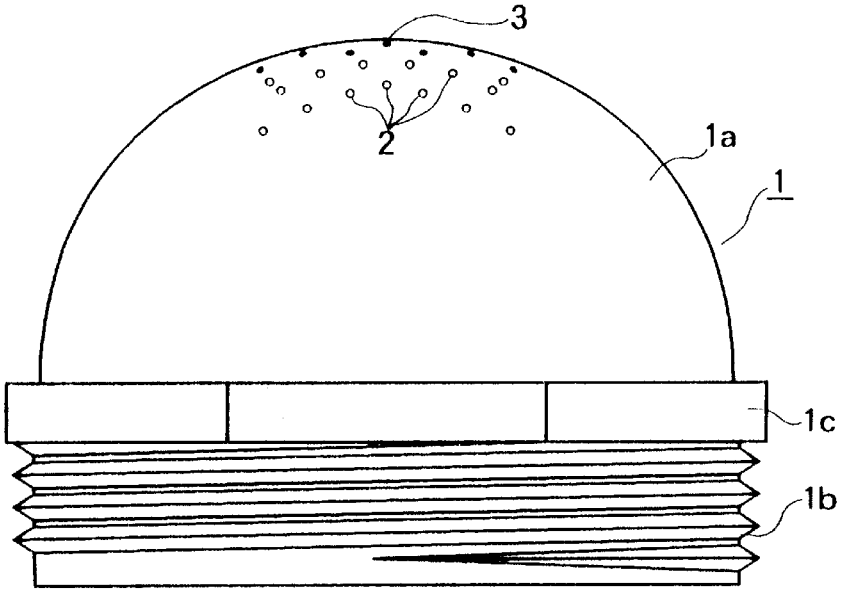
Figure 28:
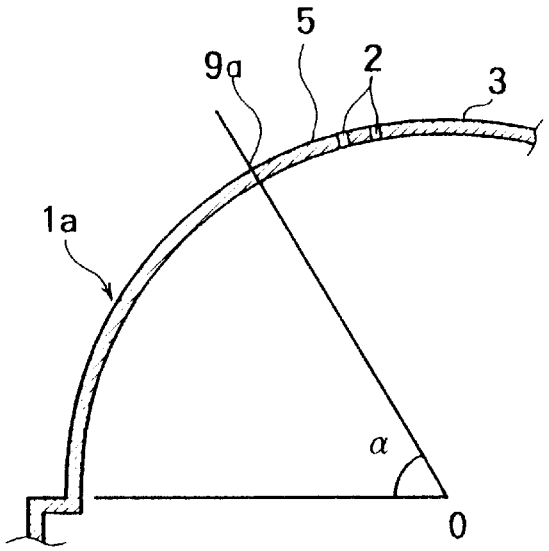
FIGS. 28 and 29 are vertical cross-sectional views of the essential part of the sprinkler head shown in FIGS. 24 and 25 and show the position of the rectangular zone the sprinkler head.

Embodiments according to the fifth aspect of the present invention will be described in detail below:

In FIG. 24, which is a plan view of the surface of the hemispherical part 1*a* of the substantially hemispherical sprinkler head 1, as viewed from the vertex side (FIG. 25 is an elevation view thereof), a plurality of nozzles 2 are formed in a rectangular zone 5 enclosed by two first imaginary straight lines 9*a* substantially in parallel to each other, as shown by two-dot chain lines, and by two second imaginary straight lines 9*b* intersecting the first imaginary straight lines 9*a* and 9*a* substantially at a right angle and substantially in parallel to each other, as shown by two-dot chain lines. The vertex 3 locates in the rectangular zone 5. That is, the nozzles are provided in the rectangular zone 5 enclosed by the first imaginary straight lines 9*a* and the second imaginary straight lines 9*b*. As shown in FIG. 28, which is a vertical cross-sectional view of the sprinkler head through the vertex 3 and vertical to the first imaginary straight lines 9*a*, the rectangular zone 5, that is, the first imaginary straight lines 9*a*, are provided so as to satisfy the following condition.

The first imaginary straight lines 9*a* are provided so that their angles of elevation $\alpha$ to the center or symmetrical center O of the hemispherical part 1*a* can satisfy such a condition as $30° \leqq \alpha < 90°$, preferably $45° \leqq \alpha < 90°$.

Figure 29:
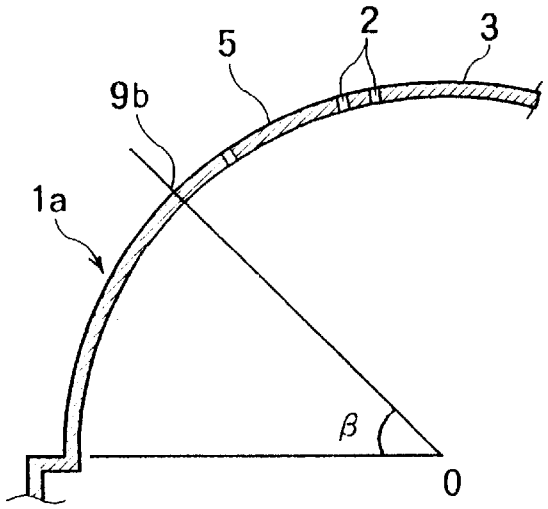

Furthermore, as shown in FIG. 29, which is a vertical cross-sectional view of the sprinkler head through the vertex 3 and vertical to the second imaginary straight lines 9*b*, the rectangular zone 5, that is, the second imaginary straight lines 9*b*, are provided so as to satisfy the following condition.

The second imaginary straight lines 9*b* are provided so that their angles of elevation to the center or symmetrical center O of the hemispherical part 1*a* can satisfy such a condition as $30° \leqq \beta < 90°$, preferably $45° \leqq \beta < 90°$. Relationship in magnitude between $\alpha$ and $\beta$ is not particularly limited.

By providing the rectangular zone 5 so as to satisfy the above-mentioned conditions, water can be sprinkled constantly from the sprinkler head upward, and thus water can be sprinkled substantially uniformly all over a desired sprinkling area. Furthermore, since the nozzles 2 are formed in the rectangular zone 5, water is never sprinkled from the sprinkler head 1 downward. More specifically, the angles of elevation $\alpha$ and $\beta$ can be selected according to the size of a sprinkling area, diameter of nozzles, distances between the perpendicularly provided sprinklers, etc.

Figure 26:
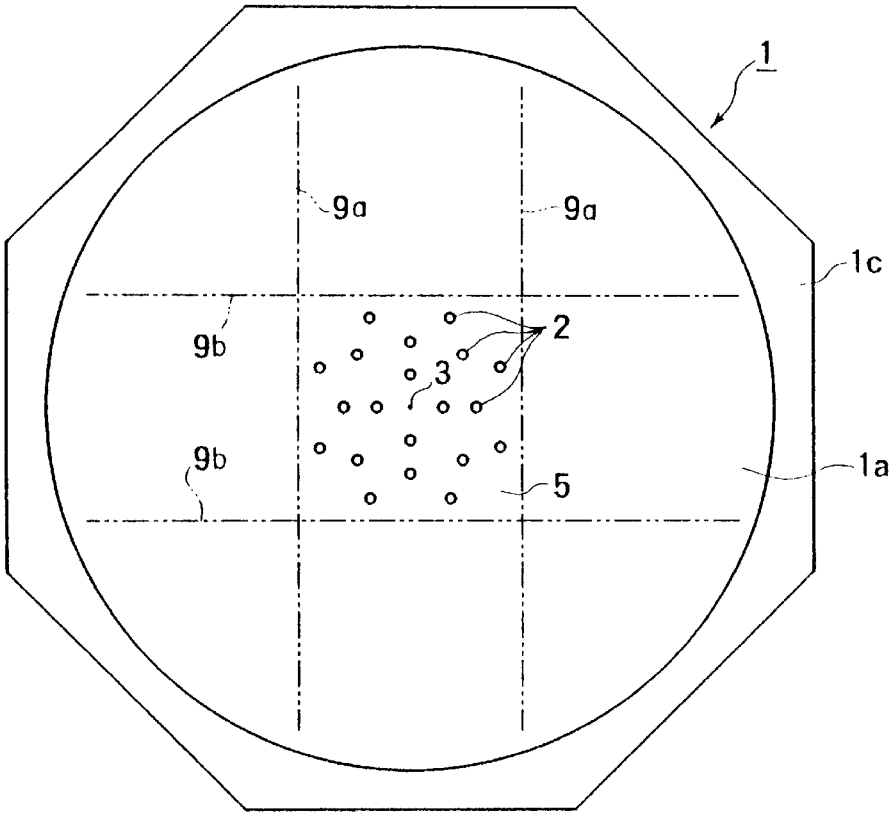
FIGS. 26 and 27 are a plan view and an elevation view, respectively, of one modification of the nozzle distribution pattern on the sprinkler head shown in FIGS. 24 and 25.
Figure 27:
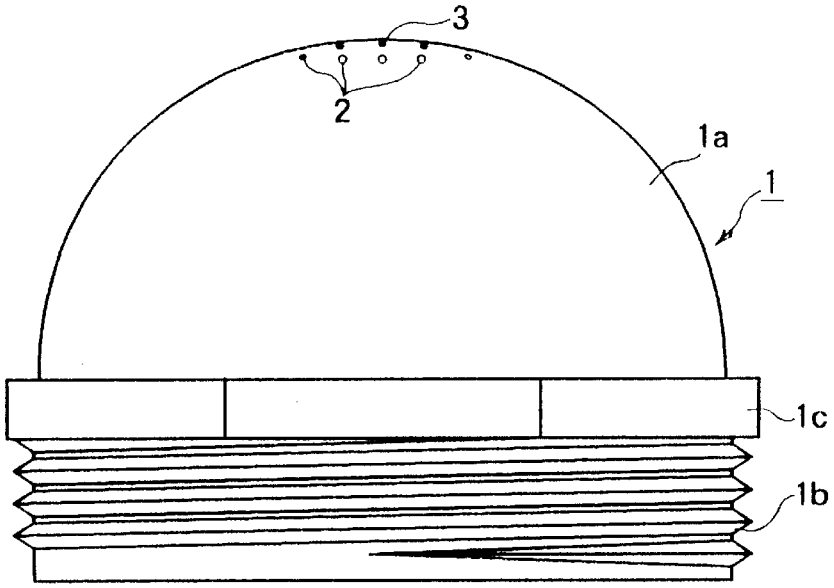

A distribution pattern of nozzles 2 formed within the rectangular zone 5 is not particularly limited, that is, not limited only to the distribution pattern shown in FIGS. 24 and 25. For example, as shown in FIGS. 26 and 27, the distribution pattern of nozzles 2 can be a pattern where no nozzles 2 are provided at the corners of the rectangular zone 5. The distribution pattern shown in FIGS. 26 and 27 is suitable for sprinkling water onto a circular sprinkling area.

The diameter of nozzles 2 is not particularly limited, but preferably is in a range of 0.1 mm to 2.0 mm, because small water droplets can be sprinkled from the nozzles 2 having nozzle diameters in the above-mentioned range and can be suspended in the air for a long time, whereby sufficient heat exchange can be carried out between the water droplets and the air. When the diameter of nozzles 2 is smaller than 0.1 mm, water droplets sprinkled from such nozzles 2 will be too small, and thus the rate of sprinkled water volume per hour will be too low, resulting in insufficient heat exchange between the water droplets and the air. When the diameter of nozzles 2 is larger than 2 mm on the other hand, the water droplets sprinkled from such nozzles will be extremely large, and will soon fall downwards. That is, the water droplets cannot be suspended in the air for a long time. In the present embodiment, nozzle diameters are set to 0.4 mm to 0.8 mm, but are not limited thereto. Thus, water can be sprinkled constantly from the sprinkler head 1 upward, and can be suspended in the air for a long time, ensuring sufficient heat exchange between the water droplets and the air.

Sprinkled water volume of the sprinkler head 1 per unit area and effect thereof on the prevention of frost damage will be described below.

A sprinkler with the present sprinkler head 1 was perpendicularly provided at the center of a rectangular sprinkling area, 10 m×5 m. Distribution pattern and diameter of nozzles 2 in the rectangular zone 5, as shown in FIG. 24, were used, where diameter of the hemispherical part 1*a* of the substantially spherical sprinkler head 1 was 5 cm, sprinkling water feed rate about 12 l/min and water pressure on the nozzles 2 about 2 kg/cm$^2$.

Water sprinkling tests were carried out in the same manner as already described before. Results are shown in FIG. 30, where the curve (a) shows results of the present sprinkler head 1.

On the other hand, the sprinkled water volume per unit area of the conventional water sprinkler having a nozzle with a total nozzle opening area equal to that of the present nozzle head 1 was measured at the same time under the same conditions as above but the angle of the sprinkler head was changed in three stages (that is, measurements were conducted at three different angles). Results are shown in FIG. 30, where a group of curves (b) shows the results of the conventional water sprinkler, i.e. each of curves in the group (b) corresponds to each changed angle of the sprinkler head of the conventional water sprinkler.

Figure 30:
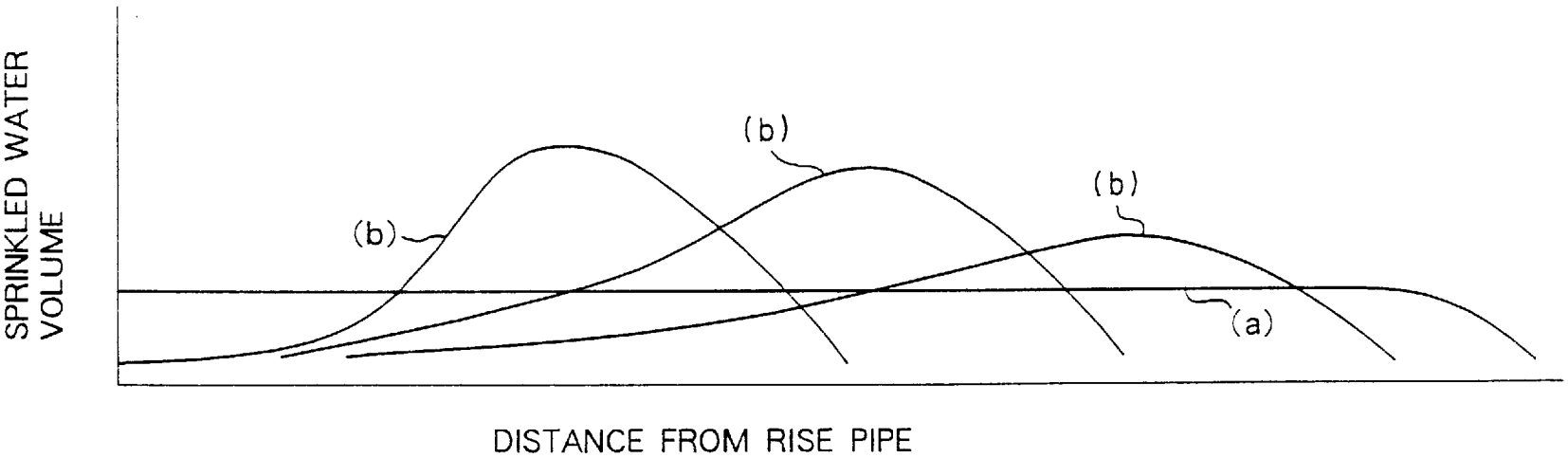
FIG. 30 shows profiles of sprinkled water distribution in relation to the distance from the rise pipe.

As is evident from FIG. 30, the present sprinkler head 1 can sprinkle water substantially uniformly all over the sprinkling area, whereas the conventional water sprinkler fails to conduct uniform water sprinkling.

Effect on the prevention of frost damage was investigated in a tea garden as a sprinkling area by water sprinkling under the following conditions.

Tests were carried out in an area, 10 m×5 m, in a tea garden provided with the present water sprinkler with the sprinkler head 1 at the center of the area (which will be hereinafter referred to as "present area") and in another area, 10 m×5 m, in the tea garden, provided with the conventional water sprinkler at the center of the area (which will be hereinafter referred to as "comparative area"). These two area were sprinkled with water constantly every night under the same conditions. On the day when the climatic temperature was lowered to less than −2° C. from the midnight to early morning, tea leaves and leaf buds of tea trees planted in both of the present area and the comparative area were inspected in the afternoon and compared with one another. It was found that the tea trees planted in the present area were not damaged with frosts at all and were in a sound state, whereas those planted in the comparative area suffered from changes in color into brown or withering of some leaves and leaf buds. That is, frost damages of tea trees were observed in the comparative area, and were particularly remarkable in the region near the water sprinkler.

Furthermore, a difference in the average climatic temperature was observed during the nights between the present area and the comparative area. That is, the average climatic temperature in the present area during the nights was higher than that in the comparative area. As is evident from the difference in the climatic temperature, sufficient heat exchange occurred between the water droplets sprinkled from the present sprinkler head and the air, whereas no sufficient heat exchange occurred between the water droplets sprinkled from the conventional water sprinkler and the air.

Figure 31:
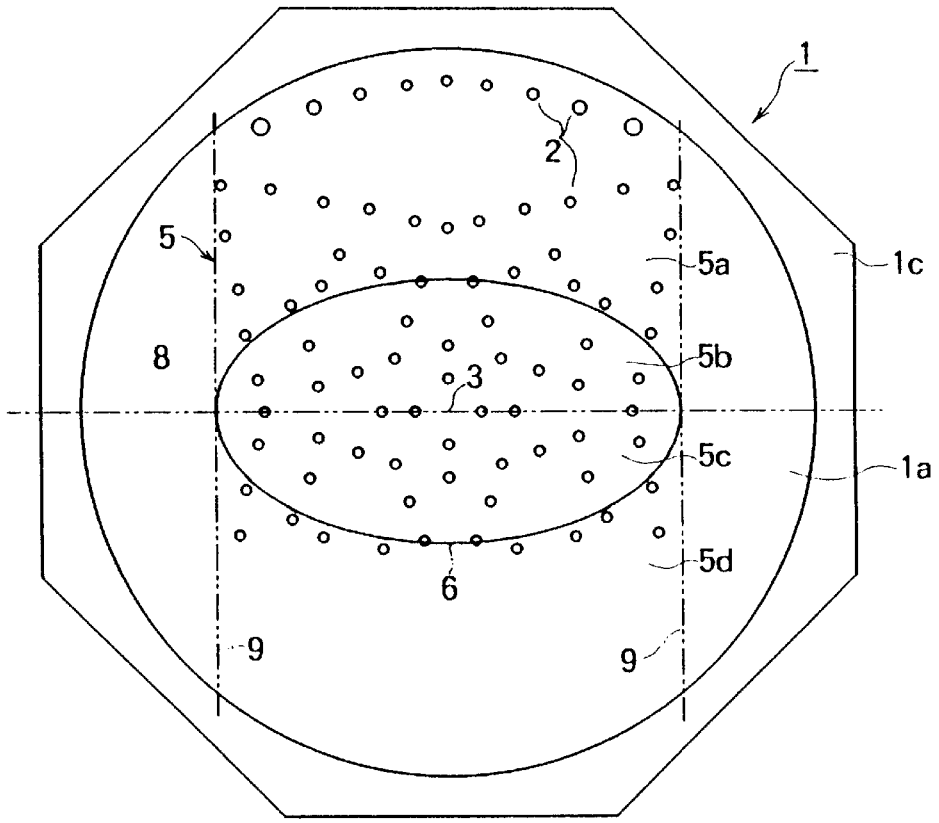
FIGS. 31 and 32 are a plan view and an elevation view, respectively, of a sprinkler head according to one embodiment based on a sixth aspect of the present invention.
Figure 32:
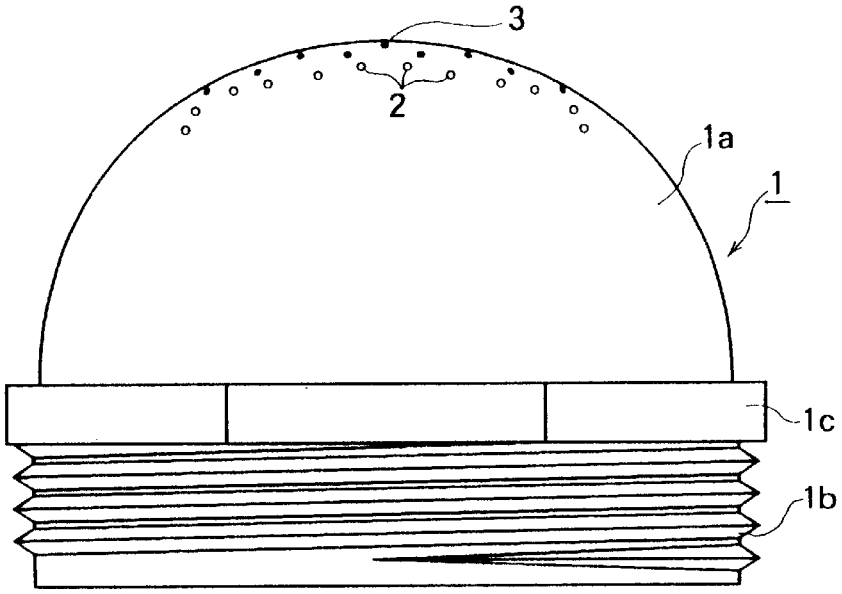

Embodiments according to the sixth aspect of the present invention will be described in detail below;

In FIG. 31, which is a plan view of the surface of the hemispherical part 1*a* of the substantially hemispherical sprinkler head 1, as viewed from the vertex side (FIG. 32 is an elevation view thereof), a plurality of nozzles 2 are formed in two divided zones of the substantially hemispherical sprinkler head 1, divided by an imaginary straight line 8 passing through the vertex 3 of the substantially hemispherical sprinkler head 1, as shown by a two-dot chain line, the nozzles 2 in one of the two divided zones, as shown by the upper divided zone over the first imaginary straight line 8 in FIG. 31, has a denser nozzle distribution with increasing distance from the vertex 3, while the nozzles 2 in other divided zone, as shown by the lower divided zone below the first imaginary straight line 8 in FIG. 31, has a sparser nozzle distribution with increasing distance from the vertex 3. That is, the nozzles 2 are formed in a zone 5 enclosed by two second imaginary lines 9 intersecting a first imaginary straight line 8 passing through the vertex 3 of the substantially hemispherical sprinkler head 1 substantially at a right angle and substantially in parallel to each other, as shown by two-dot chain lines; the zone 5 is further divided into two subzones by the first imaginary straight line 8; the respective divided subzones are further divided each into two subsections by an imaginary ellipse 6 drawn by a segment of a line between two intersections of the first imaginary straight line 8 and the two second imaginary straight lines 9 as the line of upsides. In FIG. 31, the imaginary ellipse 6 is shown by a two-dot chain line. That is, the zone 5 is divided into 4 subsections 5*a*, 5*b*, 5*c* and 5*d*. The nozzles 2 in the subsection 5*a* outside the imaginary ellipse 6 in one of the subzones, i.e. the upper subzone above the first imaginary straight line 8 in FIG. 31, have a larger total opening area than in the subsection 5*b* inside the imaginary ellipse 6, while the nozzles in the subsection 5*d* outside the imaginary ellipse 6 in other subzone, i.e. the lower subzone below the first imaginary straight line 8 in FIG. 31, have a smaller total opening area than in the subsection 5*c* inside the imaginary ellipse 6.

Relationship in the magnitude between the total nozzle opening area of nozzles 2 in the subsection 5*b* and that in the subsection 5*c* is not particularly limited and the positions of the second imaginary straight lines 9 and a ratio of the line of upsides to the minor axis of the ellipse 6 are not particularly limited. The zone 5 may not include the vertex 3.

The nozzles 2 formed in the zone 5 have increasing diameters with increasing distance from the vertex 3. That is, the nozzles 3 can have successively increasing diameters with increasing distance from the vertex 3 and several adjacent nozzles 3 may have an equal diameter to one another.

A distribution pattern of nozzles 2 on the sprinkler head 2 shown in FIG. 31 illustrates such an example that the shape of an inclined sprinkling area is a square. Thus, the distribution pattern of nozzles 2 is not limited only to that shown in FIG. 31, and any distribution pattern of nozzles 2 is applicable so long as it can satisfy the above-mentioned condition for the total nozzle opening area. That is, the distribution pattern of nozzles 2 can be selected in view of a degree of inclination and size of an inclined sprinkling area, diameters of nozzles 2, etc.

In the present embodiment, diameters of nozzles 2 are set to, for example, 0.4 mm to 1.3 mm, but the distribution pattern and diameters of the nozzles 2 are not limited to those given above.

In the case of sprinkling water onto an inclined sprinkling area, the sprinkler must be perpendicularly provided so that the subsection 5*a* can be faced to the downward side of the inclined area, whereby the volume of water sprinkled to the downward side of the inclined area can be made larger than that to the upward side of the inclined area. Furthermore, the sprinkling distance of water droplets can be selected as desired by forming the nozzles 2 in the above-mentioned manner. Thus, water can be sprinkled more uniformly all over the desired inclined sprinkling area.

Since the impact force of sprinkled water droplets on the soil surface of the inclined sprinkling area can be lowered by selecting the diameters of nozzles 2, thereby making the sprinkled water droplets smaller, water can be gently sprinkled even onto the upward side surface of the inclined sprinkling area without hitting the soil surface by the sprinkled water droplets, that is, without rebounding of the water droplets from the soil surface. Thus, the sown seeds never flow away from the soil or leaves or stems are never damaged or plant growth is never inhibited thereby. Thus, the sprinkler head 1 of the present embodiment is very suitable for water sprinkling onto an inclined sprinkling area.

Figures 33A, 33B:
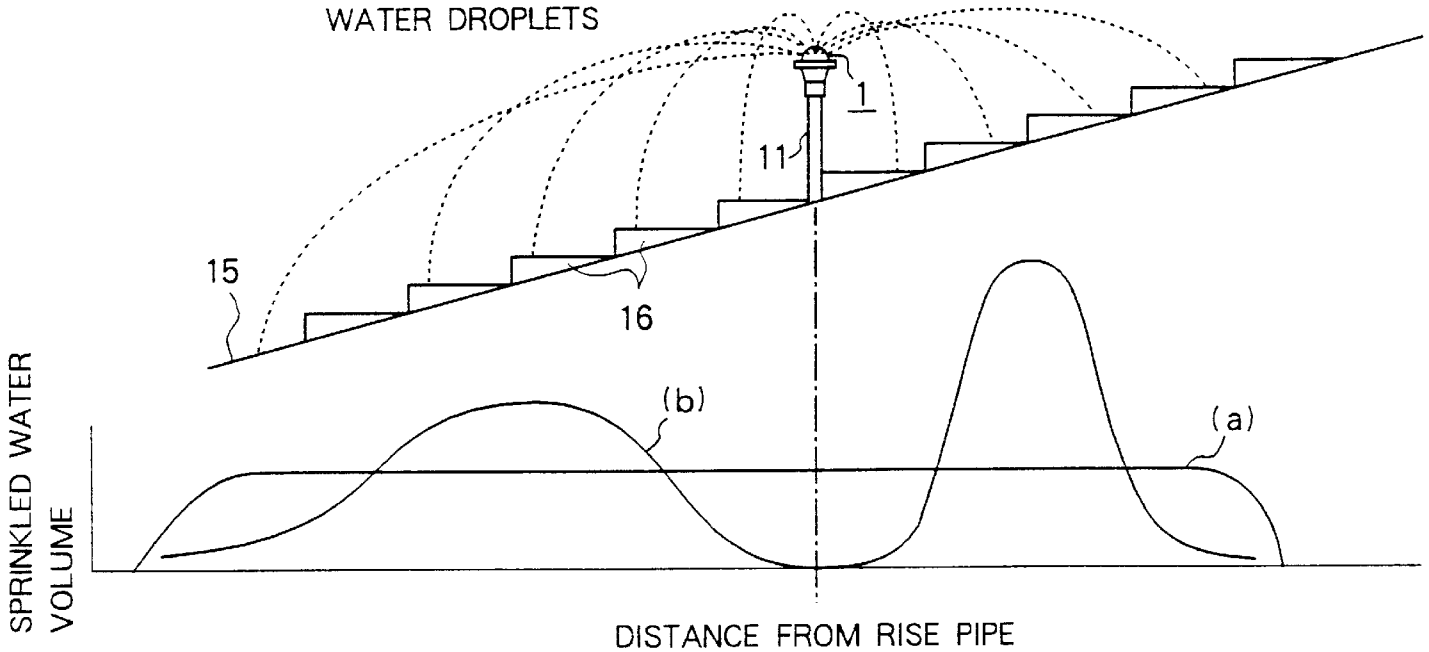
FIGS. 33A and 33B are a schematic elevation view showing the mode of sprinkling water onto an inclined plain by a liquid sprinkler provided with the sprinkler head shown in FIGS. 31 and 32, and profiles of the sprinkled water distribution in relation to the distance from the rise pipe, respectively.

Sprinkled water volume per unit area of the present sprinkler head 1 will be described in detail below:

As shown in FIG. 33A, an inclined sprinkling area 15 was in the shape of a square of given size and the rise pipe 11 of the present sprinkler was perpendicularly provided substantially at the center of the inclined sprinkling area 15 to sprinkle water all over the inclined sprinkling area 15. The distribution pattern of nozzles 2 in the zone 5, that is, the distribution pattern and diameters of nozzles 2 were set to those shown in FIG. 31, where diameter of the hemispherical part 1*a* of the substantially hemispherical sprinkler head 1 was 5 cm, sprinkling water feed rate about 17 l/min and water pressure on the nozzles about 2 kg/cm$^2$.

Water sprinkling tests were carried out in the same manner as already described before, and the results are shown in FIGS. 33B and 34, where curves (a) shows the results of the present sprinkler head 1. As is evident from FIGS. 33B and 34, there is no difference in the sprinkled water volume per unit area between the upward side and the downward side of the inclined sprinkling area 15.

On the other hand, the conventional water sprinkler having a nozzle with a total nozzle opening area equal to that of the sprinkler head 1 was subjected to the same water sprinkling tests in the same manner under the same test conditions as above, but the angles of the conventional sprinkler were changed in three stages (that is, the measurements were carried out at three different angles). The results are shown by a group of curves (b) in FIGS. 33B and 34, i.e. each of curves in the group (b) corresponds to each changed angle of the sprinkler head of the conventional water sprinkler. It was found that there was difference in the sprinkled water volume in unit area between the upward side and the downward side of the inclined sprinkling area 15, that is, the sprinkled water volume per unit area is larger on the upward side of the inclined sprinkling area 15 than on the downward side thereof.

Figure 34:
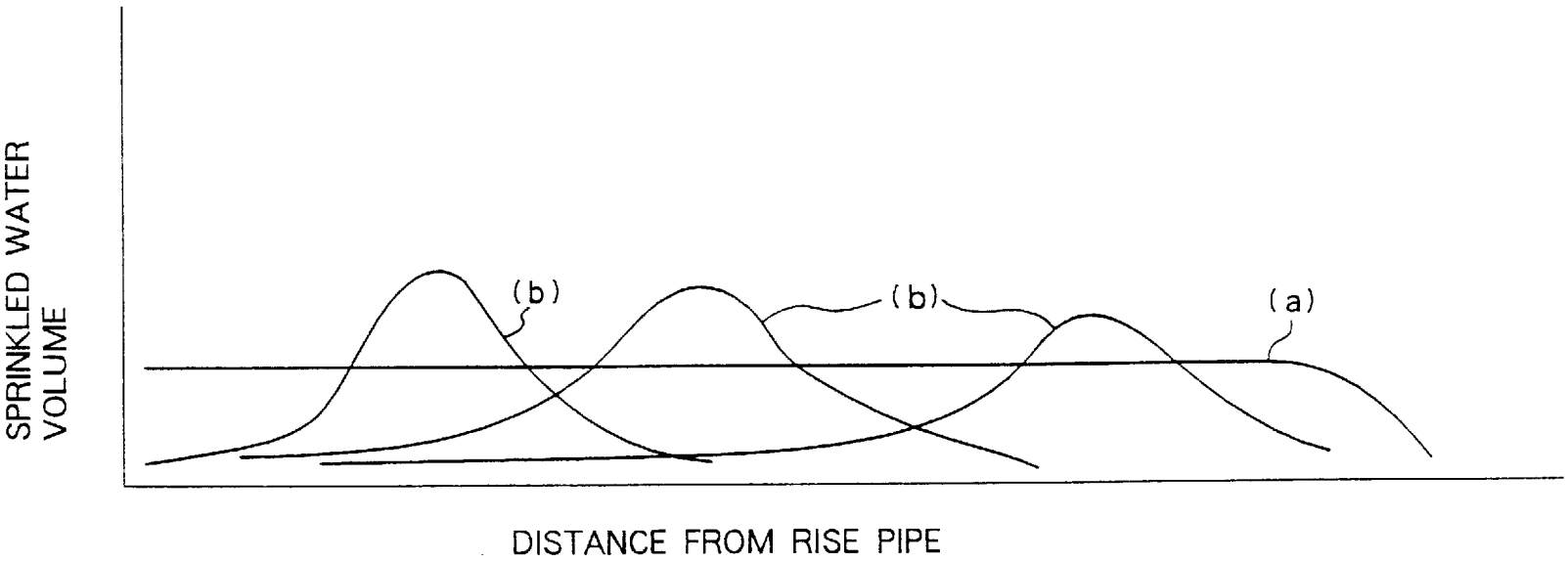
FIG. 34 shows profiles of sprinkled water distribution in relation to the distance from the rise pipe.

As is evident from FIGS. 33B and 34, the present sprinkler head 1 can sprinkle water substantially uniformly all over the inclined sprinkling area 15, whereas the conventional water sprinkler fails to conduct uniform water sprinkling.

In the foregoing embodiment, a sprinkler head 1 capable of sprinkling water all over an inclined sprinkling area of square shape has been illustrated, but the shape of an inclined sprinkling area to be sprinkled with the present sprinkler head 1 is not limited only to the illustrated square shape, but can also include any desired other shape, such as polygonal shapes including a rectangular shape, a circular shape, an elliptical shape, etc. Combinations of distribution pattern and diameters of nozzles 2 can be selected in view of a degree of inclination and size of an inclined sprinkling area, a sprinkling water feed rate, etc.

Figure 35:
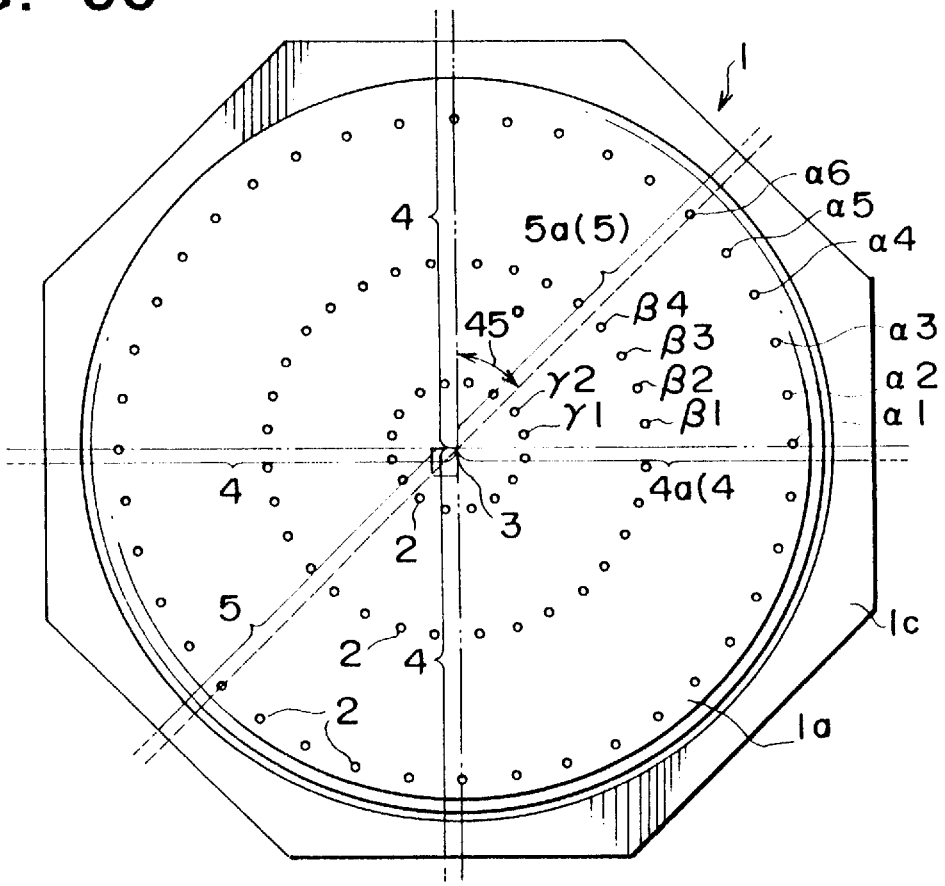
FIGS. 35 and 36 are a plan view and an elevation view, respectively, of a sprinkler head according to one embodiment based on a seventh aspect of the present invention.
Figure 36:
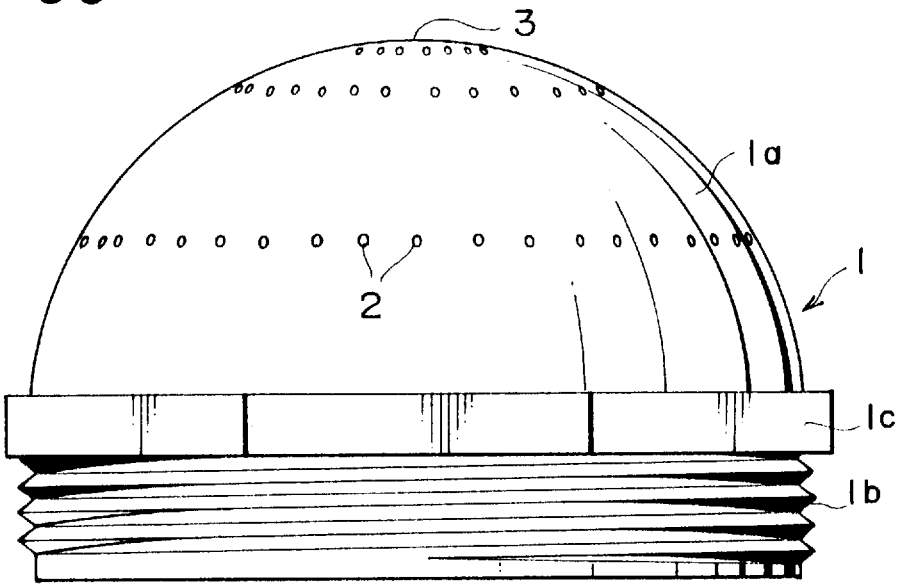

Embodiments according to the seventh aspect of the present invention will be described in detail below:

According to a first embodiment as shown in FIGS. 35 and 36, nozzle 2 are formed along concentrical lines from the vertex 3 of the substantially hemispherical sprinkler head 1 as a center. The nozzles 2 formed along the same concentrical lines, i.e. at the same angle of nozzle elevation to the center of the hemispherical part 1*a* have the smallest diameters at positions nearest to four imaginary lines 4 substantially radially extending on the surface of the hemispherical part 1*a* from the vertex 3 downwards at an angular distance of 90° to one another and have increasing diameters with increasing distance from the imaginary lines 4. Diameters of nozzles 2 formed along the concentrical lines increase in a substantially constant ratio with increasing distance from the imaginary lines 4. That is, the nozzles 2 along or at positions nearest to imaginary central lines 5 each locating at equal distances from the two adjacent imaginary lines 4 have the largest diameters, whereas the diameters of nozzles 2 decrease with increasing distance from the imaginary central lines 5, and are the smallest along or at positions nearest to the imaginary lines 4. Furthermore, total nozzle opening area of nozzles 2 formed along the same concentrical lines increases with increasing distance of the concentrical lines from the vertex 3, that is, with decreasing angle of nozzle elevation. That is, the total nozzle opening area of nozzles 2 formed along the farthest concentrical line from the vertex 3 is larger than that of nozzles 2 formed along the nearest concentrical line to the vertex 3. Total nozzle opening area of nozzles formed along the concentrical line in the intermediate region is larger than that of nozzles 2 nearer to the vertex 3 and smaller than that of nozzles 2 farther from the vertex 3.

Pattern of imaginary lines 4 on the surface of the substantially hemispherical sprinkler head, as shown in FIGS. 35, that is, a distribution pattern of nozzles 2, shows an example that the shape of a sprinkling area is a square. Thus, the pattern of nozzles 2 is not limited only to the pattern shown in FIG. 35.

In the present first embodiment, diameters of nozzles 2 on the substantially hemispherical had are selected as follows:

At first, description will be made of the region enclosed by the imaginary line 4*a* and the imaginary central line 5*a*. As shown in FIG. 35 and Table 3, 6 nozzles 2 are formed along a concentrical line α at an angle of elevation of 27°, which is the farthest from the vertex 3, according to angles between the imaginary line 4*a* and each of the segments from each of nozzle centers to the vertex 3, which will be hereinafter referred to as "sector angles".

Diameters of the nozzles 2 are 0.4 mm for nozzle α1 at a sector angle of 0° locating on the imaginary line 4*a*, 0.5 mm for nozzle α2 at a sector angle of 9°, 0.6 mm for nozzle α3 at a sector angle of 18°, 0.7 mm for nozzle α4 at a sector angle of 27°, 0.7 mm for nozzle α5 at a sector angle of 36° and 0.8 mm for nozzle α6 at a sector angle of 45° locating on the imaginary central line 5*a* with increasing distance from the imaginary line 4*a*.

Likewise, 4 nozzles 2 are formed along another concentrical line β at an angle of elevation of 60°, which locates in the intermediate region, and diameters of the nozzles are as follows: in the direction from the imaginary line 4*a* toward the imaginary central line 5*a*, diameters are 0.4 mm for nozzle β1 at a sector angle of 6°, 0.4 mm for nozzle β2 at a sector angle of 17°, 0.5 mm for nozzle β3 at a sector angle of 28° and 0.5 mm for nozzle β4 at a sector angle of 40°. Diameters of nozzles 2 formed along a further concentrical line γ at an angle of elevation, which is the nearest to the vertex 3, are as follows: 0.3 mm for nozzle γ1 at a sector angle of 11° near the imaginary line 4*a* and 0.4 mm for nozzle γ2 at a sector angle of 33° near the imaginary central line 5*a*. The same nozzle distribution pattern as above is applied to the entire surface of the hemispherical part 1*a*. Thus, there are 4 nozzles α1, 8 nozzles α2, 8 nozzles α3, 8 nozzles α4, 8 nozzles α5, 4 nozzles α6, 8 nozzles β1, 8 nozzles β2, 8 nozzles β3, 8 nozzles β4, 8 nozzles γ1 and 8 nozzles γ2. The distribution pattern and diameters of nozzles 2 are not limited only to those given above.

TABLE 3

| | Nozzles 2 | Sector angle (°) | Diameter (mm) | Total number |
|---|---|---|---|---|
| Concentrical line α (Angle of elevation: 27°) | α1 | 0 | 0.4 | 4 |
| | α2 | 9 | 0.5 | 8 |
| | α3 | 18 | 0.6 | 8 |
| | α4 | 27 | 0.7 | 8 |
| | α5 | 36 | 0.7 | 8 |
| | α6 | 45 | 0.8 | 4 |
| Concentrical line β (Angle of elevation: 60°) | β1 | 6 | 0.4 | 8 |
| | β2 | 17 | 0.4 | 8 |
| | β3 | 28 | 0.5 | 8 |
| | β4 | 40 | 0.5 | 8 |
| Concentrical line γ (Angle of elevation 80°) | γ1 | 11 | 0.3 | 8 |
| | γ2 | 33 | 0.4 | 8 |

Figure 37A:
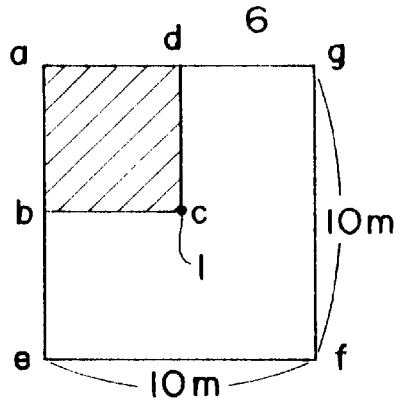
FIGS. 37A and 37B are a plan view showing the entire surface of a sprinkling area to be sprinkled with water by the sprinkler head shown in FIGS. 35 and 36, and a detailed plan view of a one-fourth part the sprinkling area show in FIG. 37A, respectively.

Water sprinkling tests of the above-mentioned sprinkler head 1 were carried out on a square sprinkling area 6, 10 m×10 m, as shown in FIG. 37A in the same manner as already described before by perpendicularly providing the sprinkler at the center of the sprinkling area 6, where diameter of the hemispherical part 1*a* was 5 cm, a sprinkling water feed rate about 13 l/min. and water pressure on the nozzles 2 about 2 kg/cm$^2$.

Figure 37B:
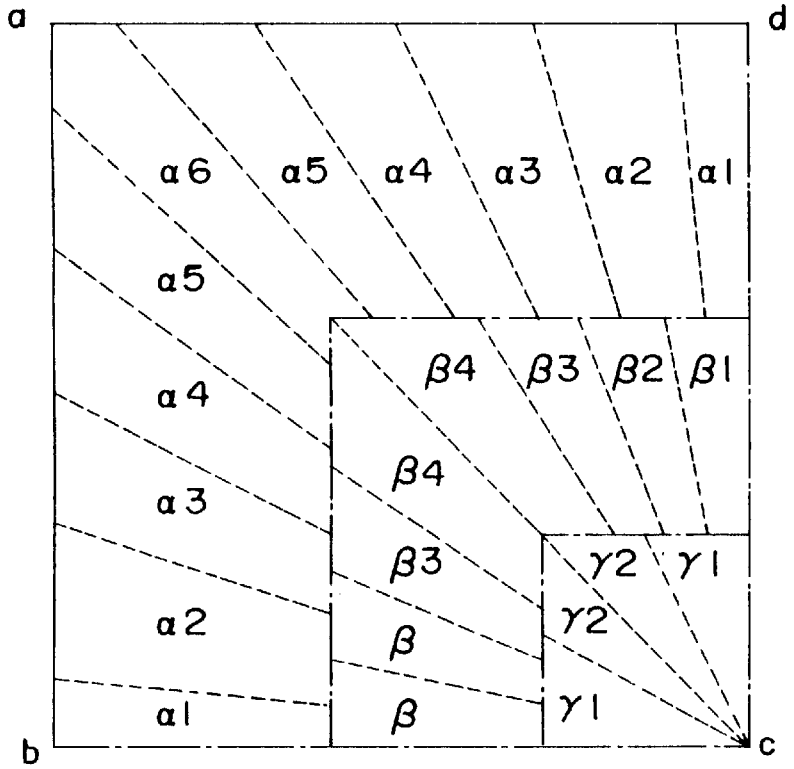

Results of water sprinkling tests will be described on a one-fourth part of the sprinkling area 6, i.e. a hatched square abcd shown in FIG. 37A. The results are shown in FIG. 37B, where the zones sprinkled from the nozzles α1 are zones α1, those sprinkled from the nozzles α2 are zones α2, the zones sprinkled from the nozzles α3 are zones α3, the zones sprinkled from the nozzles α4 are zones α4, the zones sprinkled from the nozzles α5 are zones α5, the zone sprinkled from the nozzle α6 is zone α6, the zones sprinkled from the nozzles β1 are zones β1, the zones sprinkled from the nozzles β2 are zones β2, the zones sprinkled from the nozzles β3 are zones β3, the zones sprinkled from the nozzles β4 are zones β4, the zones sprinkled from the nozzles γ1 are zones γ1, and the zones sprinkled from the nozzles γ2 are zones γ2.

Other parts of the sprinkling area 6 than the square abcd, that is, the remaining three-thirds, could be likewise sprinkled with water substantially uniformly all over from similar nozzles α1 to α6, β1 to β4 and γ1 to γ2. Thus, the entire sprinkling area 6, i.e. square aefg, could so sprinkled with water by the present sprinkler head with substantially equal sprinkled water volumes per unit area.

In the foregoing first embodiment, a sprinkling area of square shape has been exemplified, but the sprinkling area is not limited only to the square shape, but can be a rectangular shape, other polygonal shapes, a circular shape, an elliptical shape or any other desired shape of any size. That is, a combination of distribution pattern and diameters of nozzles 2 can be selected in view of the shape of a sprinkling area, a sprinkled water volume per unit area, etc.

A second embodiment of the seventh aspect of the present invention will be described below, referring to FIGS. 38 to 40.

Figure 38:
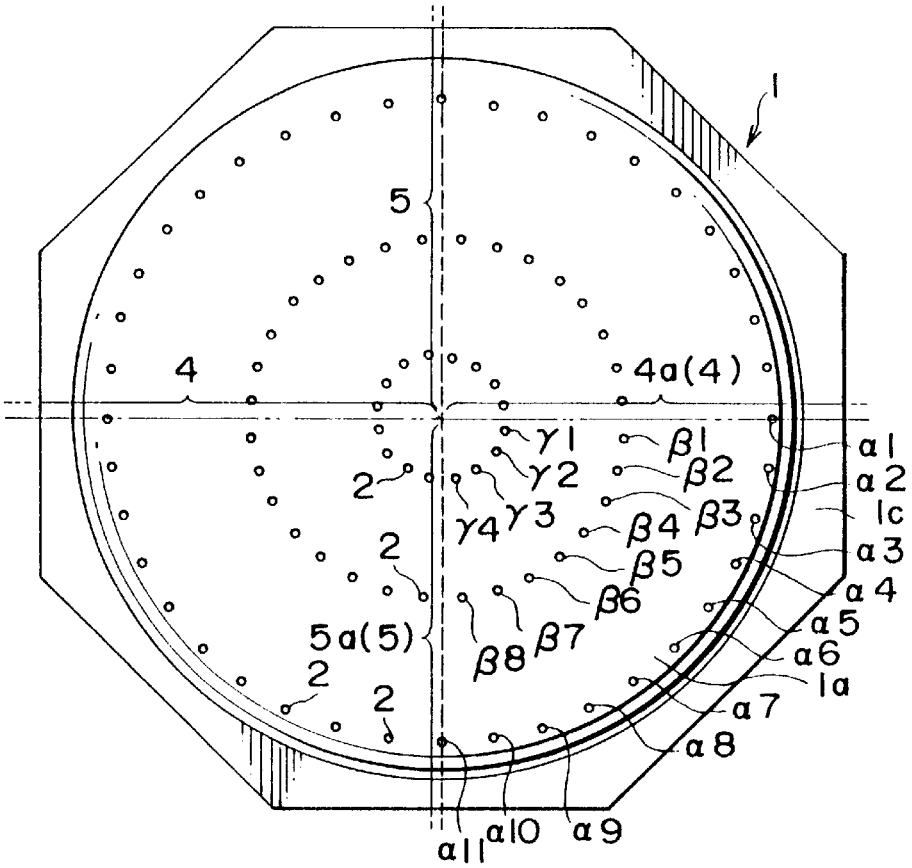
FIGS. 38 and 39 are a plan view and an elevation view, respectively, of a sprinkler head according to another embodiment based on the seventh aspect of the present invention.
Figure 39:
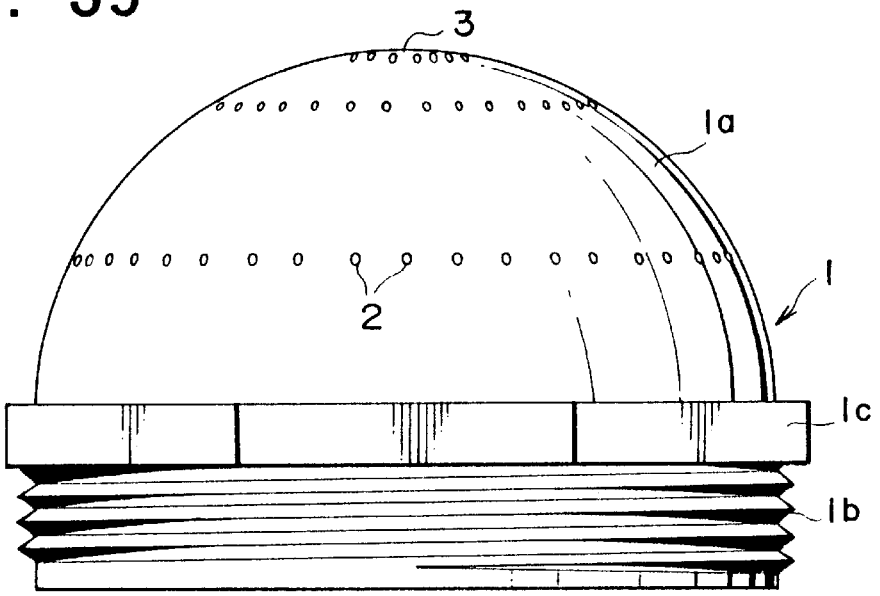

As shown in FIGS. 38 and 39, the distribution pattern and diameters of nozzles 2 formed on the surface of the hemispherical part 1*a* are different from those given in the foregoing first embodiment shown in FIGS. 35 and 36, as follows:

That is, nozzles 2 formed along the same concentrical lines from the vertex 3 of the hemispherical part 1*a* as a center, i.e. at the same angles of elevation, have the smallest diameter at positions nearest to two imaginary lines 4 substantially extending on the surface of the hemispherical part 1*a* from the vertex 3 downwards at an angular distance of 180° to one another and have increasing diameters with increasing distance from the imaginary lines 4. Diameters of nozzles 2 formed along the concentrical lines increase in a substantial constant ratio with increasing distance from the imaginary lines 4. That is, the nozzles 2 along or at positions nearest to an imaginary central line 5 locating at equal distances from the imaginary lines 4 have the largest diameters, whereas the diameters of nozzles 2 decrease with increasing distance from the imaginary central lines 5 and are the smallest along or at positions nearest to the imaginary lines 4. Furthermore, total nozzle opening area of nozzles 2 formed along the same concentrical lines increases with increasing distance of the concentrical lines from the vertex 3, that is, with decreasing angle of elevation.

Diameters of nozzles 2 are selected as follows:

At first, description will be made of the region enclosed by the imaginary line 4*a* and the imaginary central line 5*a*. As shown in FIG. 38, 11 nozzles are formed along the concentrical line a at an angle of elevation of 27° according to the sector angles. Diameters of the nozzles 2 are 0.4 mm for nozzle α1 locating on the imaginary line 4*a* at a sector angle of 0°, 0.4 mm for nozzle α2 at a sector angle of 9°, 0.4 mm for nozzles α3 at a sector angle of 18°, 0.4 mm for nozzle α4 at a sector angle of 27°, 0.4 mm for nozzle α5 at a sector angle of 36°, 0.4 mm for nozzle α6 at a sector angle of 45°, 0.5 mm for nozzle α7 at a sector angle of 54°, 0.5 mm for nozzle α8 at a sector angle of 63°, 0.6 mm for nozzle α9 at a sector angle of 72°, 0.7 mm for nozzle α10 at a sector angle of 81° and 0.8 mm for nozzle all locating on the imaginary central line 5*a* at a sector angle of 90° with increasing distance from the imaginary line 4*a*. Likewise, 8 nozzles 2 are formed along another concentrical line β at an angle of elevation of 60° according to the sector angles. Diameters of the nozzles 2 from the imaginary line 4*a* toward the imaginary central line 5*a* are 0.4 mm for nozzle β1 at a sector angle of 6°, 0.4 mm for nozzle β2 at a sector angle of 17°, 0.4 mm for nozzle β3 at a sector angle of 28°, 0.4 mm for nozzle β4 at a sector angle of 40°, 0.5 mm for nozzle β5 at a sector angle of 50°, 0.5 mm for nozzle β6 at a sector angle of 62°, 0.5 mm for nozzle β7 at a sector angle of 73° and 0.5 mm for nozzle β8 at a sector angle of 84°. Likewise, 4 nozzles are formed along a further concentrical line γ at an angle of elevation of 80° according to the sector angles. Diameters of the nozzles 2 from the imaginary line 4*a* toward the imaginary central line 5*a* are 0.3 mm for nozzle γ1 at a sector angle of 11°, 0.3 mm for nozzle γ2 at a sector angle of 33°, 0.4 mm for nozzle γ3 at a sector angle 57° and 0.4 mm for nozzle γ4 at a sector angle 79°. The same distribution pattern and diameters of the nozzles 2 as above are applied to the entire surface of the hemispherical part 1*a*, and the hemispherical part 1*a* on the entire surface has 4×(11 nozzles α1 to α11, 8 nozzles β1 to β8 and 4 nozzles γ1 to γ4). The distribution pattern and diameters of nozzles 2 are not limited only to those given above.

Figure 40:
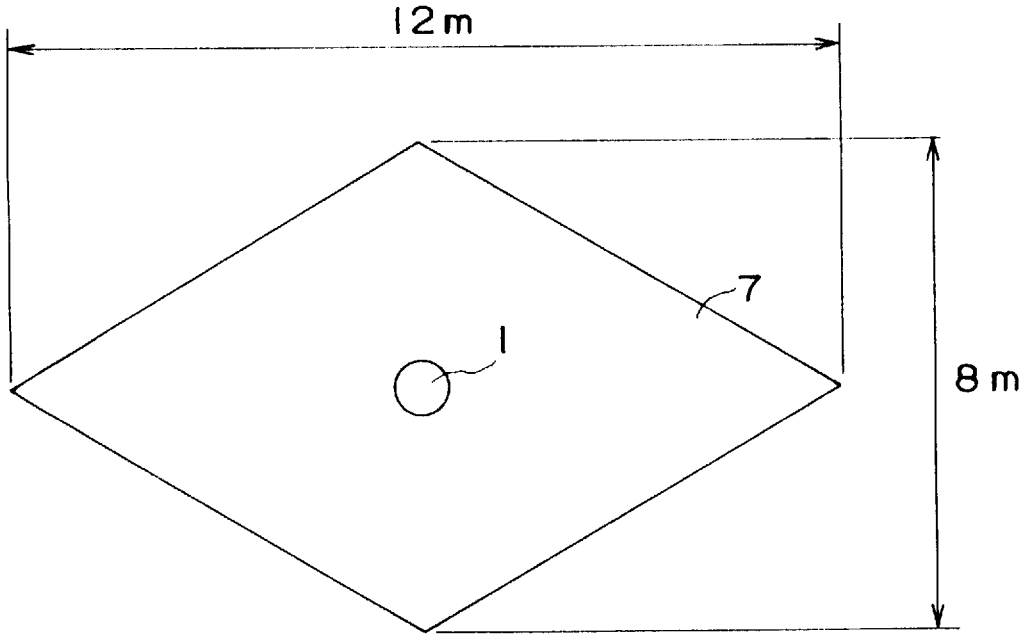
FIG. 40 is a plan view showing a sprinkling area to be sprinkled with water by the sprinkler head shown in FIGS. 38 and 39.

Water sprinkling tests were carried out with the sprinkler head according to the foregoing second embodiment onto a rhombic sprinkling area 7 shown in FIG. 40 under the same conditions as in the above-mentioned first embodiment. It was found that water could be sprinkled all over the rhombic sprinkling area 7 with substantially equal sprinkled water volumes per unit area. That is, the same function and effects as in the above-mentioned first embodiment could be obtained.

Figure 41:
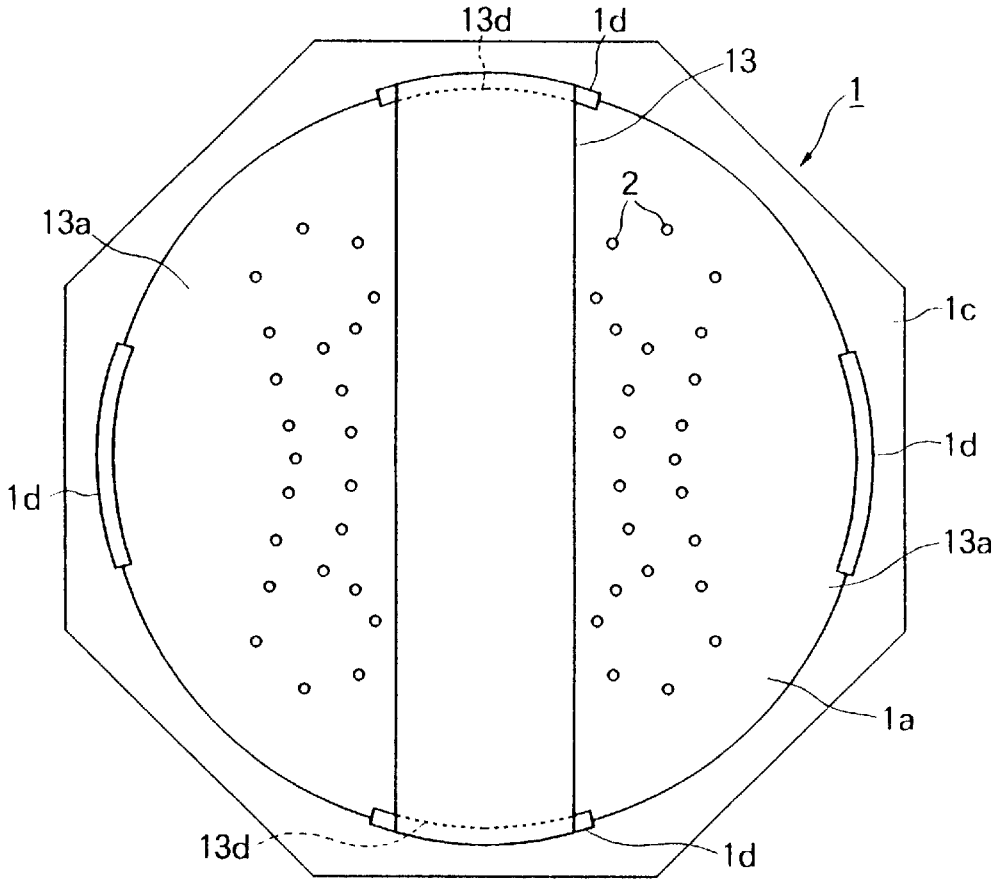
FIGS. 41 and 42 are a plan view and an elevation view, respectively, of a sprinkler head according to one embodiment based on an eighth aspect of the present invention.
Figure 42:
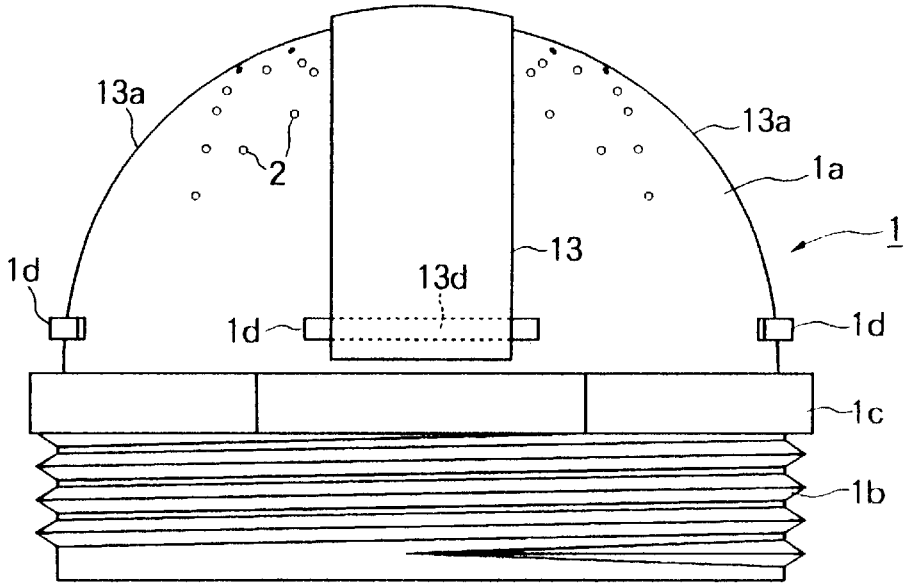

Embodiments according to the eighth aspect of the present invention will be described in detail below:

A distribution pattern of nozzles shown in FIG. 41, which is a plan view of a hemispherical head 1*a* of substantially hemispherical sprinkler head 1, is directed to such an example that the shape of a sprinkling area is a square, and thus the distribution pattern of nozzles 2 is not limited only to the pattern shown in FIG. 41. FIG. 42 is an elevation view of the hemispherical head 1*a* shown in FIG. 41. In this embodiment, diameters of nozzles 2 are set to 0.4 mm to 0.8 mm. However, the distribution pattern and diameters of nozzles 2 are not limited to those given above.

As shown in FIG. 41, projections 1*d* are provided at positions near the connection part 1*c* of the sprinkler head 1 to be engaged with a head cover 13 as a sprinkling inhibiting member. That is, the head cover 13 is provided on the sprinkler head 1 to cover a portion of the nozzles 2 on the sprinkler head 1. The head cover 13 has recesses 13*d* for being inserted with the projections 1*d* of the hemispherical part 1*a*. By inserting the projections 1*d* into the recesses 13*d*, the head cover 13 can be engaged with the sprinkler head 1. Nozzle opening regions 13*a*, which are parts of the hemispherical part 1*a* of the sprinkler head 1, are provided outside the coverage of head cover 13, and water thus can be ejected only from the nozzles 2 locating within the nozzle opening regions 13*a*.

In the foregoing embodiment the projections 1*d* are provided on the sprinkler head 1, and the recesses 13*d* are provided on the head cover 13 to engage the head cover 13 with the sprinkler head 1. The present invention is not limited thereto. That is, recesses 13*d* can be provided on the sprinkler head 1 and the projections can be provided on the head cover 13. Other examples of the procedure for engagement will be described later.

Figure 43A:
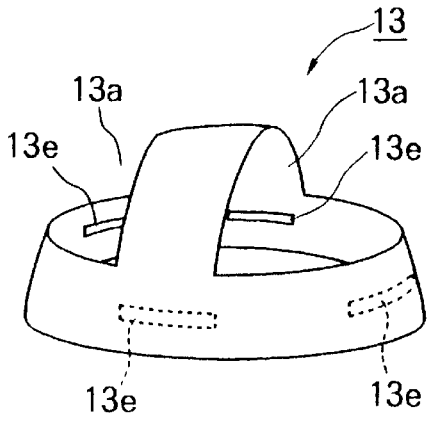
FIGS. 43A and 43B are a perspective view and a plan view, respectively, of the structure of a head cover for the sprinkler head shown in FIGS. 41 and 42.
Figure 43B:
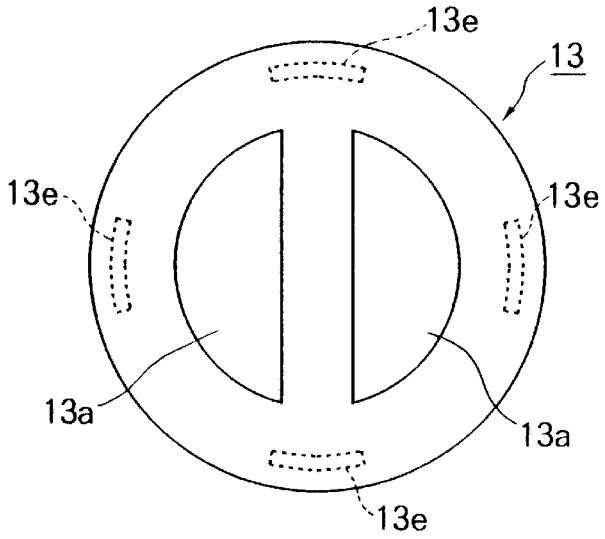

As shown in FIGS. 43A and 43B, the head cover 13 can be in such a shape as to cover the circumference at the connection counterpart of the hemispherical part 1*a* (not shown in the drawings) with respect to the connection part 1*c* (not shown in the drawings), where projections 13*e* are provided at 4 positions on the head cover 13 and recesses are provided at the corresponding 4 positions on the sprinkler head 1 (not shown in the drawings) to insert the projections 13*e* into the recesses, whereby the head cover can be more firmly fixed to the sprinkler head 1 and a fear of unexpected disengagement of the head cover 13 from the sprinkler head 1 can be eliminated.

Figure 45:
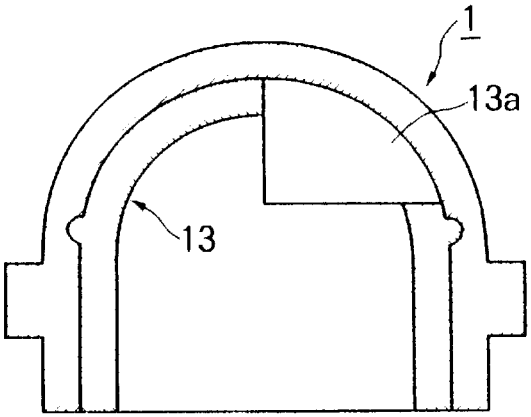
FIG. 45 is a vertical cross-sectional view-showing another structure of the head cover.

The foregoing head cover 13 is to cover the sprinkler head 1 from the outside, but is not limited thereto. So long as the head cover 13 can inhibit water ejection from the specific nozzles 2, the head cover 13 can be provided by providing it on the inner surface of the sprinkler head 1, as shown in FIG. 45.

Figure 46A:
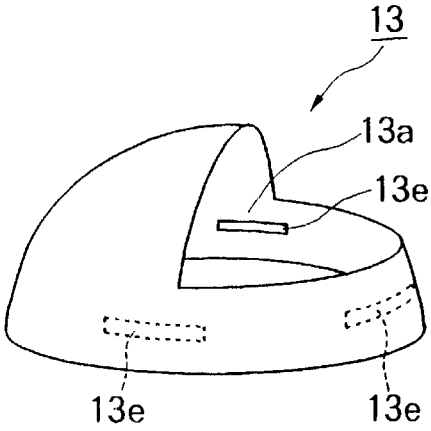
FIGS. 46A and 46B are a perspective view and a plan view, respectively, of other structure of the head cover.
Figure 46B:
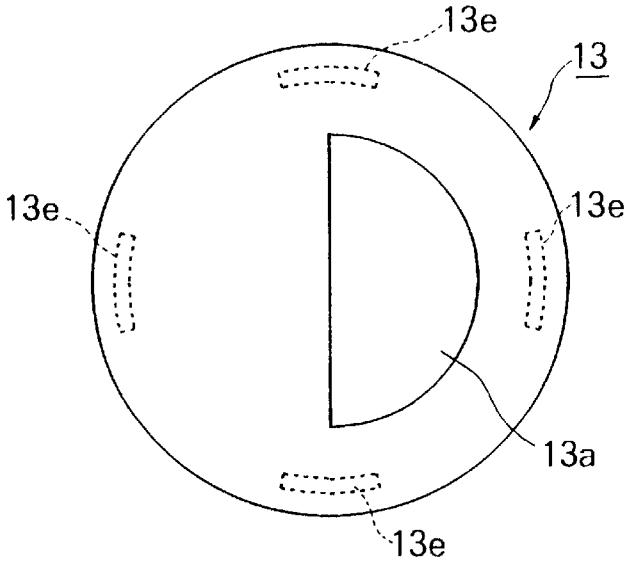

In the foregoing embodiments, the head cover 13 is in such a shape as to cover the central rectangular region of the hemispherical part 1a, as shown in FIG. 41, but is not limited thereto. Other examples of the shape will be described in detail later. For example, the head cover 13 may cover only a one-half of the entire surface of sprinkler head 1, as shown in FIGS. 46A and 46B.

Structure of the connection between the head cover 13 and the sprinkler head 1 will be described in detail below. For simplification of the description, the structure is directed to coverage only of an one-half of the entire area of sprinkler head 1, as mentioned above and shown FIGS. 46A and 46B, in the following description.

Figure 48:
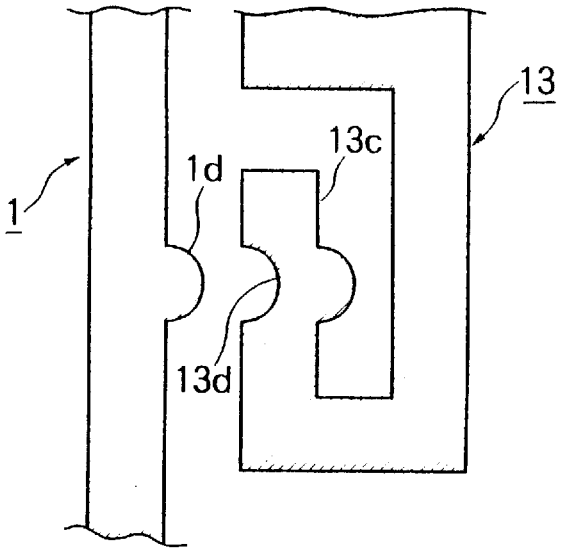
FIG. 48 is a partial vertical cross-sectional view showing another connection mode between the head cover and the sprinkler head.

As shown in FIG. 48, an elastic bent part 13*c* is provided by extension from the lower end of the head cover 13, and the recesses 13*d* for being inserted with the projections 1*d* are provided at positions in contact with the projections 13*c*. By inserting the projections 1*d* into the recesses 13*d*, the head cover 13 can be engaged with the sprinkler head 1, when provided on the outer surface of the sprinkler head. Thus, when the head cover 13 provided on the outer surface of sprinkler head 1 is pushed downwards from the overhead, the bent parts 13*c* are expanded outwardly by the projections 1*d*. By further pushing the head cover 13 downwards, the projections 1*d* are inserted into the recesses 13*d* and the expanded bent parts 13*c* are returned to the original position before the pushing, whereby the head cover 13 can be firmly engaged with the sprinkler head 1. That is, the head cover 13 can be detachably engaged with the sprinkler head 1.

It is only necessary that the projections 1*d* and the recesses 13*d* have such a function as to detachably engage the head cover 13 with the sprinkler head 1. Thus, the sprinkler head 1 can be provided with the above-mentioned bent part and recesses, whereas the head cover 13 can be provided with the projections.

Figure 49:
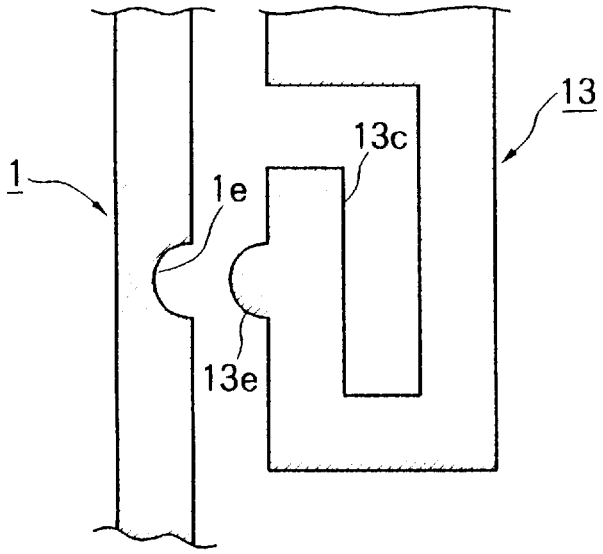
FIG. 49 is a partial vertical cross-sectional view showing other connection mode between the head cover and the sprinkler head.

Furthermore, as shown in FIG. 49, the bent part 13*c* of the head cover 13 can be provided with the projections 13*e* (see FIG. 43A) and the sprinkler head 1 can be provided with the recesses 1*e* for being inserted with the projections 13*e*. Furthermore, the sprinkler head 1 can be likewise provided with the bent part and projections thereon, whereas the head cover 13 can be provided with the recesses.

Figure 50:
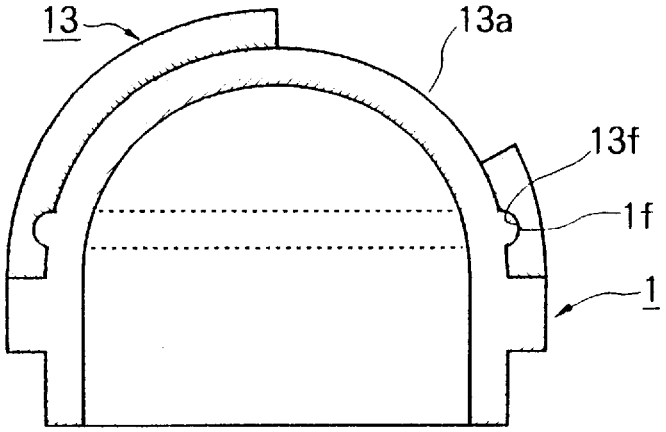
FIG. 50 is a vertical cross-sectional view showing further connection mode between the head cover and the sprinkler head.

In place of the structure as shown in FIG. 48, the structure as shown in FIG. 50 can be employed, where a projections 1*f* are provided at positions on the horizontal circumference of the hemispherical part 1*a* at a level in contact with the lower end region of the head cover 13 and the head cover 13 is made from an elastic material and provided with the horizontal groove 13*f* for being inserted with the projections 1*f* along the horizontal inner circumference of the lower end region of the head cover 13.

Figure 52A:
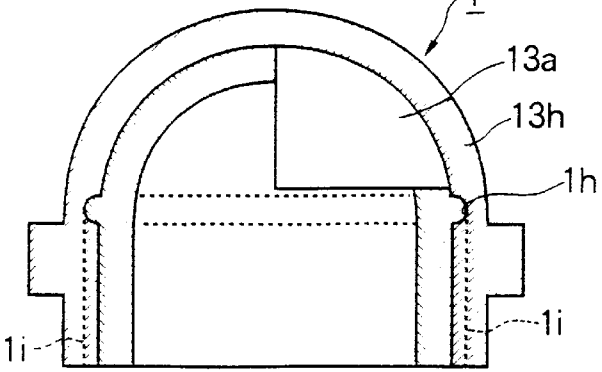
FIGS. 52A, 52B, 52C and 52D are a vertical cross-sectional view showing still further connection mode between the head cover and the sprinkler head, vertical and horizontal cross-sectional views of the sprinkler head shown in FIG. 52A, and a horizontal cross-sectional view of the head cover shown in FIG. 52A, respectively.
Figure 52B:
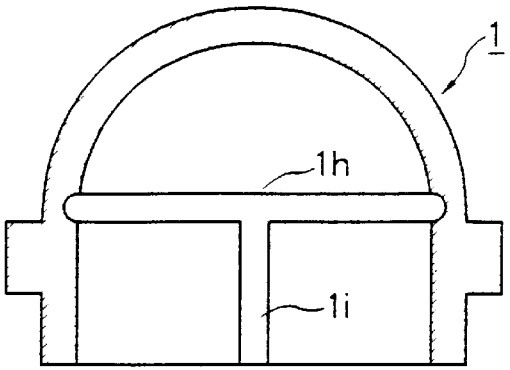
Figure 52C:
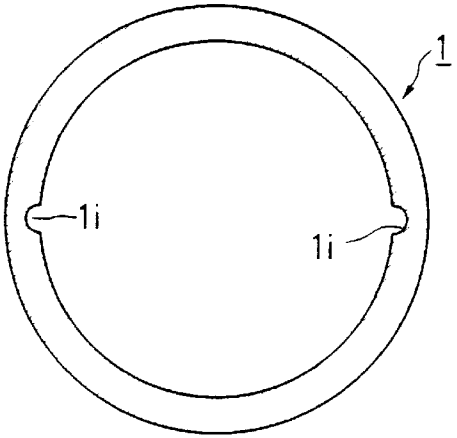
Figure 52D:
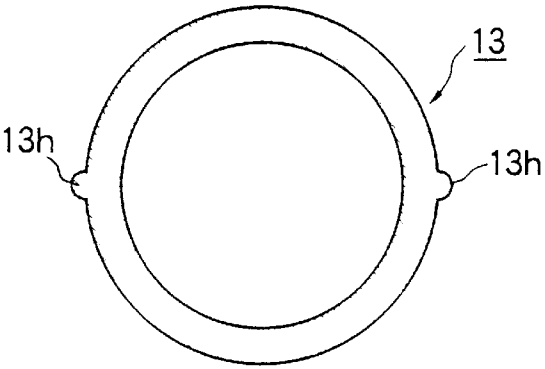

In the structure as shown in FIG. 50, the lower end region of the head cover is expanded when the head cover 13 is pushed downwards from the overhead. By further pushing the head cover 13 downwards, the projections 1*f* are inserted into the horizontal groove 13*f*. On the other hand, when the head cover 13 is subject to an upward force, the lower end region of the head cover is expanded by pushing with the projections 1*f* and thus the projections 1*f* is disengaged from the horizontal groove 13*f*, whereby the head cover 13 can be detachably engaged with the sprinkler head 1. Furthermore, since the projections 1*f* and the horizontal groove 13*f* are formed along the horizontal circumferences of the sprinkler head 1 and the head cover 13, respectively, the head cover 13 can be rotated while engaged with the sprinkler head 1. Also in this embodiment, the projections 13*g* can be provided on the circumference of the lower end region of the head cover 13 and the horizontal groove 1*g* can be provided on the circumference of the sprinkler head 1. In order to smoothly insert the individual projections into the horizontal groove, when the head cover 13 is provided on the sprinkler head 1, vertical grooves as guides for leading the individual projections into the horizontal groove can be provided at the horizontal groove, as shown in FIGS. 52A, 52B, 52C and 52D, where vertical grooves 1*i* intersecting the horizontal groove 1*h* at a right angle are provided on the sprinkler head 1, and when the head cover 13 is to be provided on the inner surface of the sprinkler head 1, projections 13*h* provided on the head cover 13, as shown in FIGS. 52A and 52D, are guided and can smoothly travel along the horizontal grooves 1*i*. FIGS. 52B and 52C are a vertical cross-sectional view and a horizontal cross-sectional view of the sprinkler head 1, respectively, and FIG. 52D is a horizontal cross-sectional view of the head cover 13.

That is, in the structure as shown in FIGS. 52A to 52D, the head cover 13 is engaged with the sprinkler head 1 in the following manner:

At first, the head cover 13 or the sprinkler head 1 is manipulated so that the projections 13*h* can travel along the vertical grooves 1*i*. When the projections 13*h* reach the ends of the vertical grooves 1*i*, i.e. the horizontal groove 1*h*, the head cover 13 or the sprinkler head 1 is twisted toward the right or left side to allow the projections 13*h* to travel along the horizontal groove 1*h*. Disengagement must be carried out by carrying out the above-mentioned manipulations in the reversed order. That is, the sprinkler head 1 and the head cover 13, once engaged, will not be disengaged from each other even if the sprinkler head 1 is subject to an unexpected upward force. Engagement or disengagement of the head cover 13 with or from the sprinkler head 1 can be easily carried out.

Figure 53A:
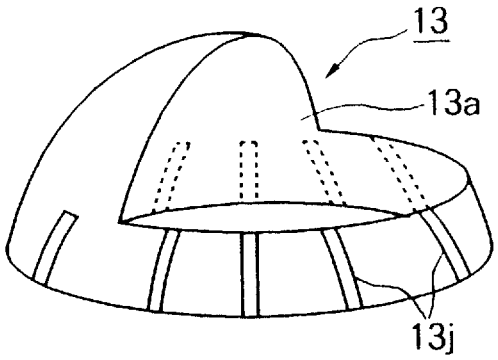
FIGS. 53A, 53B and 53C are a perspective view showing still further structure of the head cover and partial horizontal cross-sectional views showing still further connection modes between the head cover and the sprinkler head, respectively.
Figure 53B:
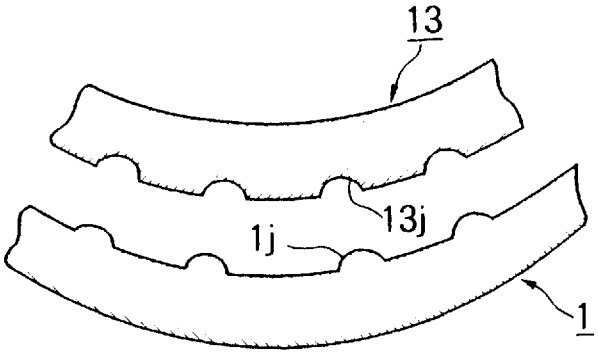
Figure 53C:
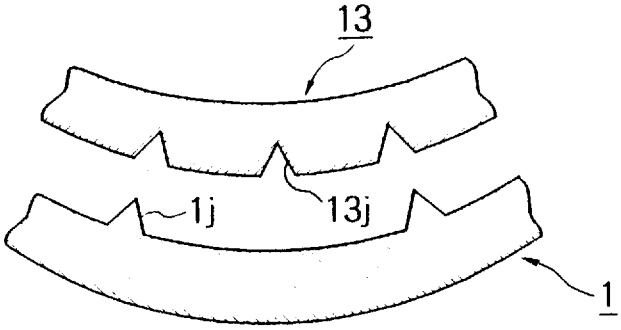

Furthermore, as shown in FIGS. 53A and 53B, small vertical grooves 13*j* can be provided at several locations on the outer end region of head cover 13, and projections 1*j* for being inserted into the small vertical grooves can be provided on the inner surface of sprinkler head 1. After the head cover 13 is provided on the sprinkler head 1, the head cover 13 or the sprinkler head 1 or both are twisted to make some relative dislocation. That is, one of the projections 1*j* on the sprinkler head 1 can slip out of one of the small vertical grooves 13*j* to the adjacent vertical groove 13*j* by the twisting and inserted therein, whereby further twisting can be interrupted. With an appropriate rotating force given to the head cover or the sprinkler head or both, one projection 1*j* can move over vertical grooves 13*j* and fixed in any desired vertical groove 13*j*. Thus, the head cover 13 can be fixed at the desired position on the sprinkler head 1 without any unexpected slipping. Furthermore, as shown in FIG. 53C, the distance between the projections 1*j* can differ from that between the vertical grooves 13*j*.

When the head cover 13 is to be provided on the outside of the sprinkler head 1, the vertical projections can be provided on the inner end region of the head cover and the projections 1*j* can be provided on the outer surface of the sprinkler head 1.

Figure 54A:
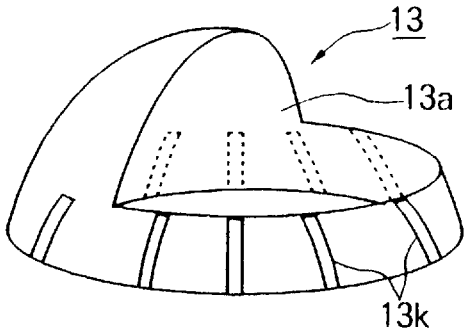
FIGS. 54A and 54B are a perspective view showing still further structure of the head cover and a partial horizontal cross-sectional view showing still further connection mode between the head cover and the sprinkler head, respectively.
Figure 54B:
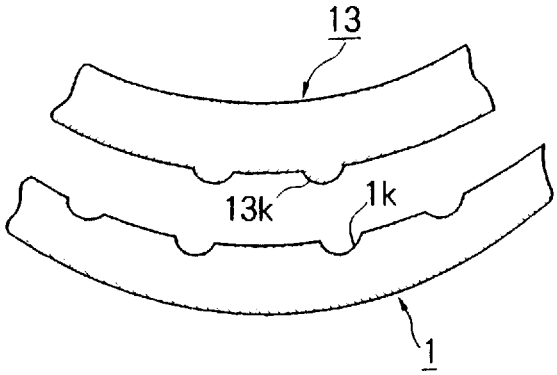

In contrast to the above-mentioned structure, projections 13*k* can be provided in the outer or inner end region of the head cover and grooves 1*k* for being inserted with the projections 13*k* can be provided on the sprinkler head 1, as shown in FIGS. 54A and 54B.

The procedures for engaging the head cover 13 with the sprinkler head 1 are not limited to those described above.

Figure 55:
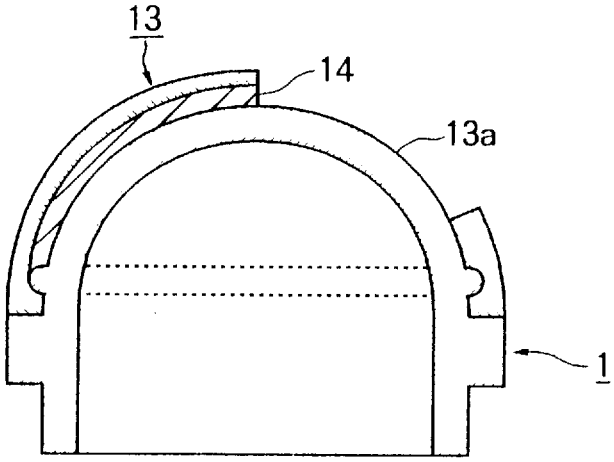
FIG. 55 is a vertical cross-sectional view showing a positional relationship among the head cover, the packing and the sprinkler head.

A packing 14 as a sealing member can be provided between the head cover 13 and the sprinkler head 1, as shown in FIG. 55, to seal clearances there-between, thereby preventing any occurrence of in-convenience such as leakage of water through the clearances, etc. Sealing of clearances between the head cover 13 and the sprinkler head 1 can be improved by providing the packing 14 therebetween. Thus, when water sprinkling is inhibited by the head cover after passage through the nozzles, such inconveniences as retaining of water in clearances between the sprinkler head 1 and the head cover 13, leakage of water to the outside through clearances between the sprinkler-head 1 and the head cover can be eliminated, and effective water sprinkling can be conducted with a smaller volume of water.

Even if the head cover 13 is provided inside the sprinkler head 1, the packing 14 can be provided between the head cover 13 and the sprinkler head 1, whereby water existing between the head cover 13 and the sprinkler head 1 can be prevented from leakage even through the nozzles 2 covered by the head cover 13 or from retaining between the sprinkler head 1 and the head cover 13. Thus, effective water sprinkling can be conducted with a smaller volume of water.

Functions of the head cover 13 in sprinkling of water in a desired sprinkling area will be described in detail below:

In the present embodiments, the head cover 13 is provided on the sprinkler head 1 as already described above, and thus water is sprinkled only through the nozzles 2, through which water is not prevented from passage by the head cover 13, among the nozzles 2 formed on the sprinkler head 1. By changing the fixing position or shape of the head cover 13 and selecting nozzles 2 to be prevented from water passage by the head cover 13, as desired, water can be sprinkled only through the desired nozzles 2. That is, water can be effectively sprinkled only to a desired sprinkling zone of the sprinkling area, i.e. not to the entire sprinkling area around the sprinkler, but to, for example, a sprinkling zone locating on one side, e.g. west side, of the sprinkler, or on both sides, but remote from or near the sprinkler.

Figure 44:
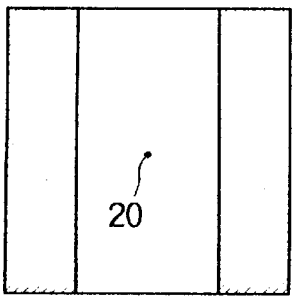
FIG. 44 shows a sprinkled area covered by the sprinkler head with the head cover shown in FIGS. 43A and 43B.

For example, in the case of a head cover having a shape as shown in FIGS. 41, 43A and 43B, water is sprinkled only from the nozzles in the nozzle opening regions 13*a* formed outside the central rectangular region of the hemispherical part 1*a*, and thus when the sprinkler with the head cover 13 is perpendicularly provided at a position 20 in the sprinkling area as shown in FIG. 44, the water sprinkling zones are hatched rectangular zones far from the sprinkler.

In such a structure that projections 1*d* on the sprinkler head 1 are inserted into the recesses 13*d* on the head cover 13, as shown in FIG. 48, the head cover 13 will not be disengaged from the sprinkler head even if the sprinkler head 1 is subject to an unexpected upward force. Thus, the water sprinkling zones can be fixed and stable, and the reliability of the sprinkler can be improved.

Figure 51A:
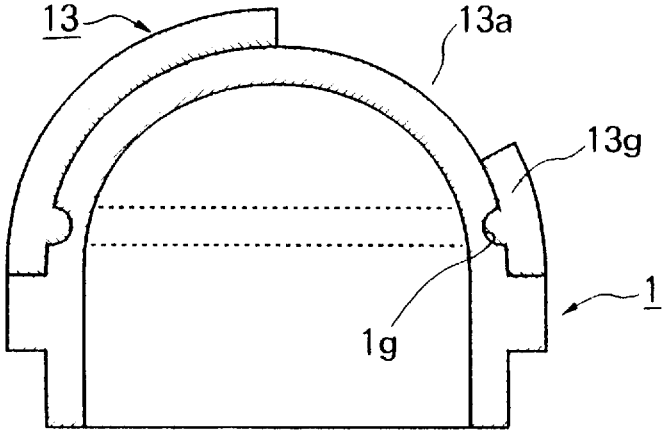
FIGS. 51A and 51B are a vertical cross-sectional view showing further connection mode between the head cover and the sprinkler head, and a perspective view of the head cover shown in FIG. 51A, respectively.
Figure 51B:
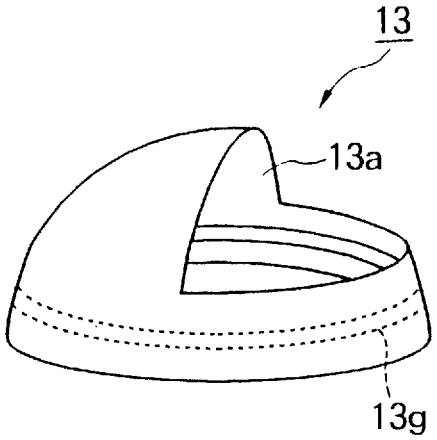

In such a structure that a horizontal groove 1*g* is provided on the circumference of the sprinkler head and projections 13*g* on the head cover are inserted into the horizontal groove 1*g*, as shown in FIG. 51A, the head cover 13 can be rotated, while engaged with the sprinkler head 1, the position of the nozzle opening region 13*a* can be changed as desired while the head cover 13 is engaged with the sprinkler head 1. That is, the water sprinkling zone can be easily changed when water is to be sprinkled with the same sprinkler head 1.

Furthermore, in such a structure as shown in FIGS. 53A, 53B and 53C and FIGS. 54A and 54B, where vertically elongated projections and the vertical grooves are provided on the sprinkler head 1 and the head cover 13, respectively, or vice versa, the head cover 13 can be fixed to a desired position by simply twisting the head cover 13 or the sprinkler head, or both by a desired angle, while the head cover 13 is engaged with the sprinkler head 1. That is, the position of the nozzle opening region 13*a* of the head cover 13 can be more easily changed, and thus the water sprinkling zone can be more easily changed when water is, sprinkled with the same sprinkler head 1. Furthermore, since the head cover 13 or the sprinkler head 1 is not unexpectedly rotated, the water sprinkling zone is fixed and stable, and the reliability of the sprinkler can be improved.

Figure 47:
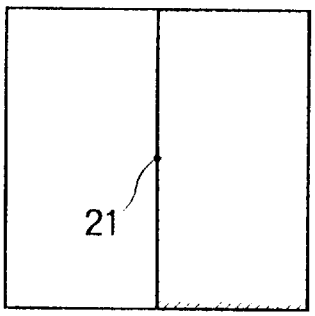
FIG. 47 shows a sprinkled area covered by the sprinkler head with the head cover shown in FIGS. 46A and 46B.

The shape of head cover 13 is not limited to those shown in FIGS. 41, 43A and 43B. Other examples of the shape will be described below:

As shown in FIGS. 46A and 46B, the nozzle opening region 13*a* can be provided in a semicircular section, as viewed from the overhead. When the sprinkler with the head cover 13 of this shape is perpendicularly provided on the point 21 as shown in FIG. 47, the water sprinkling zone is a hatched zone in FIG. 47. That is, water can be sprinkled only onto the zone at one side of the sprinkler.

Figure 56A:
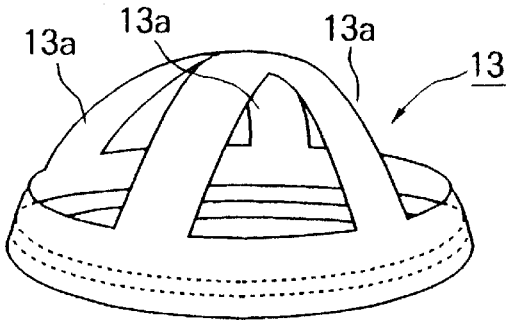
FIGS. 56A and 56B are a perspective view and a plan view, respectively, of still further structure of the head cover.
Figure 56B:
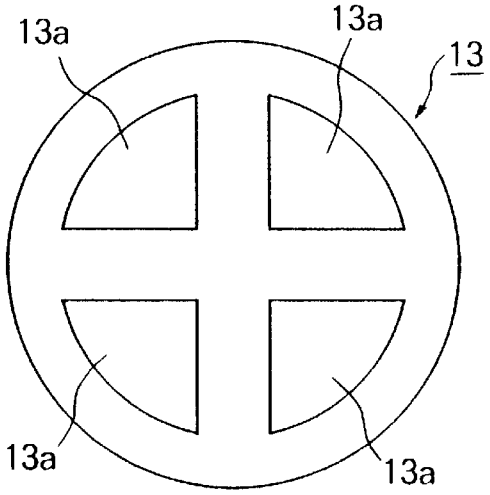
Figure 57:
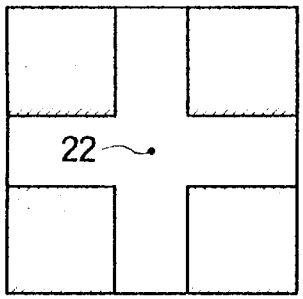
FIG. 57 shows a sprinkling area covered by the sprinkler head with the head cover shown in FIGS. 56A and 56B.

In the structure as shown in FIGS. 56A and 56B, the nozzle opening regions 13*a* can be provided outside the cross zone, as viewed from the overhead. When the sprinkler with this head cover is perpendicularly provided at the position 22 as shown in FIG. 57, the water sprinkling zones are hatched zones in FIG. 57. That is, water can be sprinkled in 4 square zones.

Figure 58A:
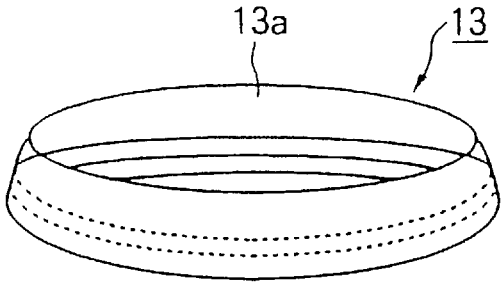
FIGS. 58A and 58B are a perspective view and a plan view, respectively, of still further structure of the head cover.
Figure 58B:
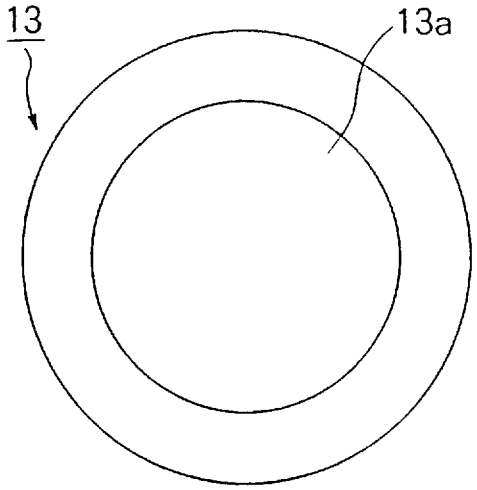
Figure 59:
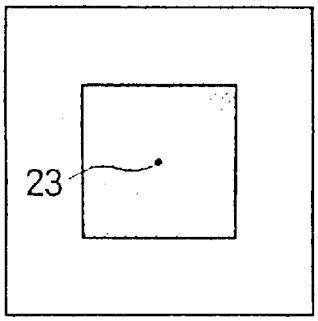
FIG. 59 shows a sprinkling area covered by the sprinkler head with the head cover shown in FIGS. 58A and 58B.

In the structure as shown in FIGS. 58A and 58B, a concentrical nozzle opening region 13*a* can be provided on the head cover 1, as viewed from the overhead. When the sprinkler with this head cover is perpendicularly provided at the position 23 as shown in FIG. 59, the sprinkling zone is a hatched zone in FIG. 59. That is, water can be sprinkled only on the square zone near the sprinkler.

By changing the shape of head cover 13, water can be sprinkled only onto a sprinkling zone or zones of any desired shape at any desired distance.

Embodiments according to the ninth aspect of the present invention will be described below.

Figure 60:
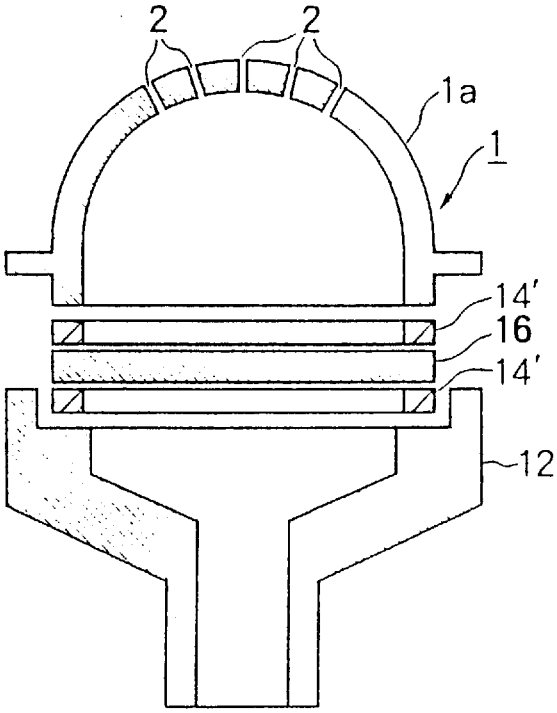
FIG. 60 is a vertical cross-sectional view showing the sprinkler head according to one embodiment based on a ninth aspect of the present invention.

As shown in FIG. 60, a filter 16 having smaller mesh sizes than the diameters of the nozzles 2 and a larger trap area than the lateral cross-sectional area of the rise pipe 11 is provided between the sprinkler head 1 and the fixing jig 12 through packing members 14' sandwiching the filter 16 to prevent water leakage.

In the present embodiments, diameters of nozzles 2 are set to, for example, 0.4 mm to 0.8 mm. Diameters of nozzles 2 are not limited to those given above.

Materials of the filter 16 are not particularly limited. For example, metals and synthetic resins are suitable materials. Metals include, for example, stainless steel, copper, aluminum, etc., and synthetic resins include, for example, polyethylene, polyvinyl chloride, etc. In the case of metals, it is desirable to apply an anti-corrosion treatment thereto. Mesh sizes of the filter 16 depend on the diameters of nozzles 2, and preferably are 0.1 mm to 0.3 mm.

Materials for the packing members 14' are not particularly limited and are preferably synthetic resins, synthetic rubber, etc. Synthetic resins include, for example, fluorocarbon resins, polyamide resins, etc.

In the above-mentioned structure, the filter 16 is provided between the sprinkler head 1 and the fixing jig 12, and has a larger trap area than the lateral cross-sectional area of the rise pipe 11, that is, a larger filtration area. In other words, larger number of meshes can be assured at the filter 16, whereby the pressure drop can be decreased, there can be no particular limit to the water feed rate and cloggings with sands, rusts, dusts, algae, and pond snails, tadpoles, etc. can be prevented for a long time.

Water stream from the rise pipe 11 and the fixing jig 12 connected thereto can be distributed throughout the sprinkler head 1 and the water pressure can be uniformly applied to the entire sprinkler head 1. Thus, water can be uniformly sprinkled all over a water sprinkling area.

Accumulated sands, rusts, dusts, etc. can be easily removed by disengaging the sprinkler head 1 and the filter 16 from the fixing jig 12.

Figure 61:
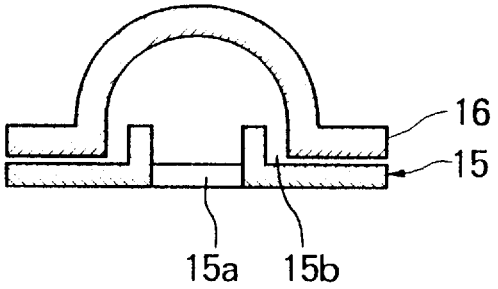
FIGS. 61 and 62 are a vertical cross-sectional view showing the essential part of the sprinkler head according to another embodiment of the present invention, and a perspective view showing a shape of the filter to be provided at the sprinkler head.
Figure 62:
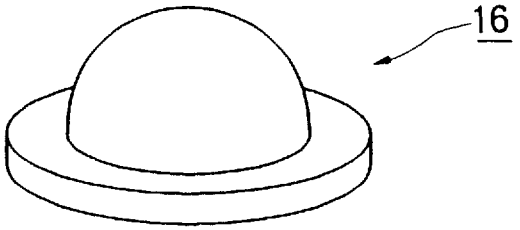
Figure 63:
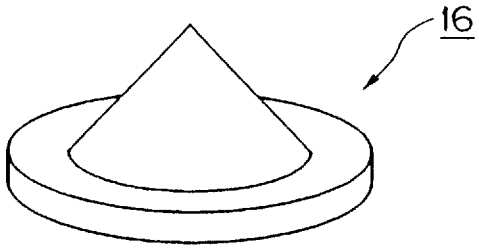
FIG. 63 is a perspective view showing another shape of the filter according to the present invention.

Shape of the filter 16 is not limited to that given above. Other example of filter shape will be described below:

As shown in FIG. 61, a filter 16 having a hemispherical shape protruded toward the sprinkler head 1 can be employed and can be further provided with a collector disk 15 as a member for collecting sands, rusts, dusts, etc. below the filter 16. The collector disk 15 has a throughhole 15*a* for water passage at the center. When sands, rusts, dusts, etc. passing through the throughhole 15*a* from the rise pipe (not shown in the drawing) together with water reach the filter 16, they move downwards along the surface of the filter 16 to a clearance 15*b* between the collector disk 15 and the filter 16 and are retained there. With this structure, clogging of the filter 16 can be more effectively prevented. The central part of the filter can be in a hemispherical shape, as shown in FIG. 62 or in a semiellipsoidal shape, or a in a sharp conical shape, as shown in FIG. 63.

Accumulated sands, rusts, dusts, etc. can be easily removed by disengaging the sprinkler head 1, filter 16, and collector disk 15 from the fixing jig 12. Furthermore, sands, rusts, dusts, etc. are accumulated particularly in the 15*b*, and thus can be more easily removed.

Figure 64:
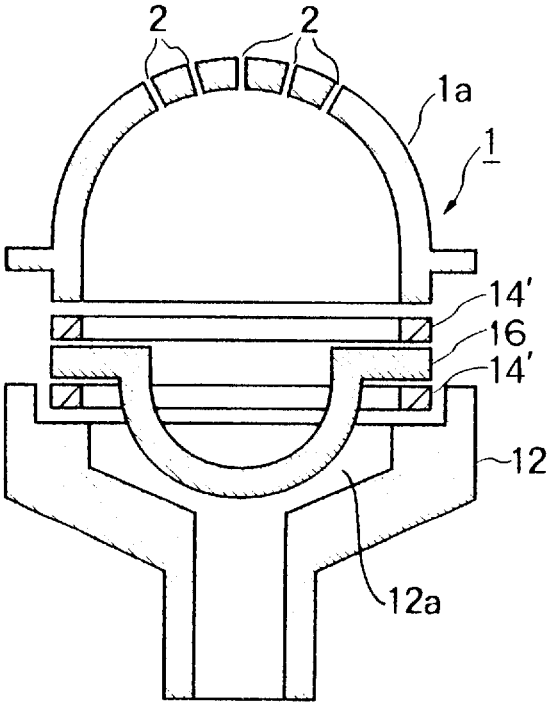
FIG. 64 is a vertical cross-sectional view showing a modification of the sprinkler head.

As shown in FIG. 64, a filter 16 having a hemispherical shape protruded toward the fixing jig 12 can be employed. With this structure, sands, rusts, dusts, etc. reaching the filter 16 together with water from the rise pipe 11 (not shown in the drawing) move along the filter 16 to the clearances 12*a* between the fixing jig 12 and the filter 16 and are retained there. Thus, clogging of the filter 16 can be more effectively prevented. For the filter 16 with this structure, the filter having a hemispherical shape shown in FIG. 62 or a hemiellipsoidal shape can be employed by making it upside down, as shown in FIG. 64, or the conical filter having a sharp vertex at the center, as shown in FIG. 63, can be employed by making it upside down.

Accumulated sands, rusts, dusts, etc. can be easily removed by disengaging the sprinkler head 1 and the filter 16 from the fixing jig 12. Since sands, rusts, dusts, etc. are accumulated in the clearances 12*a*, their removal can be more easily carried out.

Embodiments according to the tenth aspect of the present invention will be described in detail below:

Nozzles 2 are formed at angles of nozzle elevation of not more than 27° to the center of the hemispherical part 1*a* and along a plurality of imaginary lines 4 substantially radially extending on the surface of the substantially hemispherical sprinkler head from the vertex 3 thereof, and diameters of the nozzles 2 along the same imaginary lines 4 decrease with increasing distance from the vertex 3.

Figure 65:
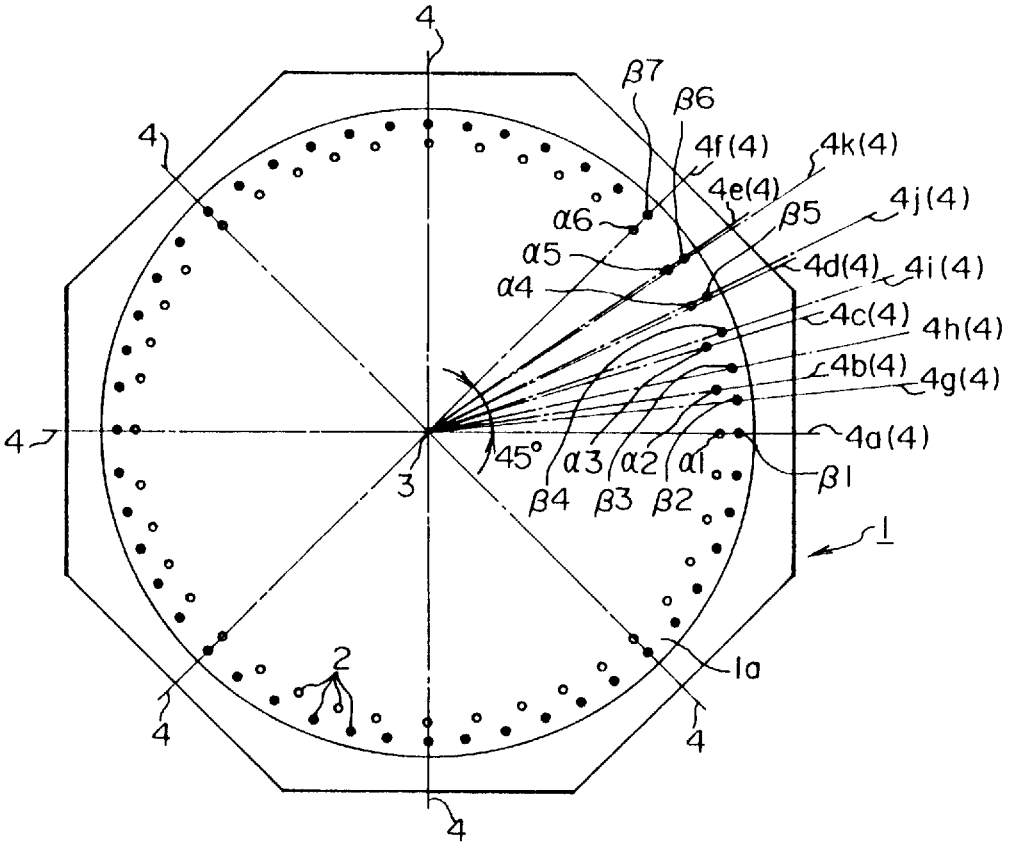
FIGS. 65 and 66 are a plan view and an elevation view, respectively, of a sprinkler head according to one embodiment based on a tenth aspect of the present invention.
Figure 66:
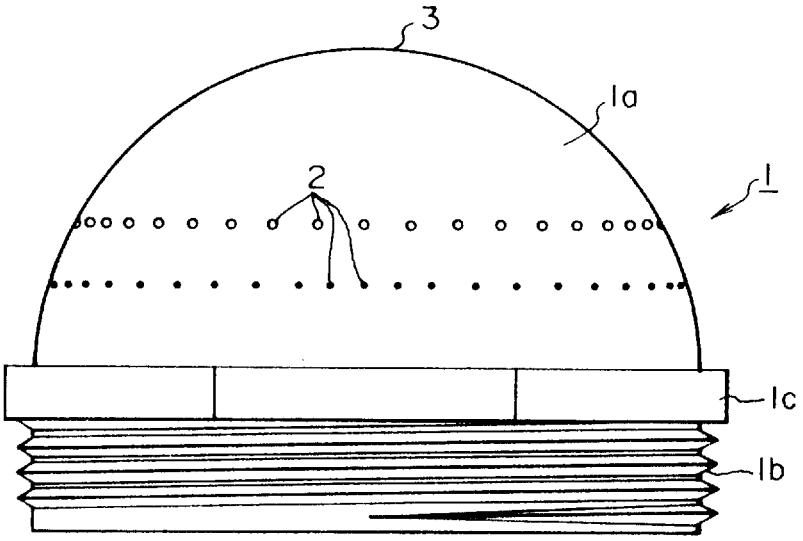

A pattern of imaginary lines 4 on the substantially hemispherical head 1 shown in FIG. 65, that is, a distribution pattern of nozzles 2, is directed to an example of a square sprinkling area, and is not limited only to the pattern shown in FIG. 65.

Diameters of nozzles on the hemispherical part 1*a* are selected as follows:

At first, description will be made of the region enclosed by two imaginary lines 4*a* and 4*f* intersecting each other at an angle of 45°. Angles between the imaginary line 4*a* and each of imaginary lines 4*b* to 4*f* are sector angles as already defined before. As shown in FIG. 65 and Table 4, nozzles 2 are formed each at angles of nozzle elevation of 27° and 15° in the hemispherical part 1*a*. That is, 13 nozzles 2 are formed between the imaginary lines 4*a* and 4*f*. Diameters of nozzles 2 at an angle of nozzle elevation of 27° are 0.4 mm for nozzle α1 locating on the imaginary line 4*a* at a sector angle of 0°, 0.5 mm for nozzle α2 locating on the imaginary line 4*b* at a sector angle of 9°, 0.6 mm for nozzle α3 locating on the imaginary line 4*c* at a sector angle of 18°, 0.7 mm for nozzle α4 locating on the imaginary line 4*d* at a sector angle of 27°, 0.7 mm for nozzle α5 locating on the imaginary line 4*e* at a sector angle of 36°, and 0.8 mm for nozzle α6 locating on the imaginary line 4*f* at an sector angle of 45°. Diameters of nozzles 2 at an angle of nozzle elevation of 15° are 0.2 mm for nozzle β1 locating on the imaginary line 4*a* at a sector angle of 0°, 0.2 mm for nozzle β2 locating on the imaginary line 4*g* at a sector angle of 6°, 0.2 mm for nozzle β3 locating on the imaginary line 4*h* at a sector angle of 12°, 0.3 mm for nozzle β4 locating on the imaginary line 4*i* at a sector angle of 20°, 0.3 mm for nozzle β5 locating on the imaginary line 4*j* at a sector angle of 28°, 0.3 mm for nozzle β6 locating on the imaginary line 4*k* at a sector angle of 36° and 0.4 mm for nozzle β7 locating on the imaginary line 4*f* at a sector angle of 45°. The same pattern as above is applied to the entire hemispherical part 1*a* and thus there are 4 nozzles α1, 8 nozzles α2, 8 nozzles α3, 8 nozzles α4, 8 nozzles α5, 4 nozzles α6, 4 nozzles β1, 8 nozzles β2, 8 nozzles β3, 8 nozzles β4, 8 nozzles β5, 8 nozzles β6 and 4 nozzles β7. The distribution pattern and diameters of nozzles 2 are not limited only to those given above.

TABLE 4

| | Nozzle identification 2 | Sector angle (°) | Diameter (mm) | Total number of nozzles |
|---|---|---|---|---|
| Angle of nozzle elevation: 27° | α1 | 0 | 0.4 | 4 |
| | α2 | 9 | 0.5 | 8 |
| | α3 | 18 | 0.6 | 8 |
| | α4 | 27 | 0.7 | 8 |
| | α5 | 36 | 0.7 | 8 |
| | α6 | 45 | 0.8 | 4 |
| Angle of nozzle elevation: 15° | β1 | 0 | 0.2 | 4 |
| | β2 | 6 | 0.2 | 8 |
| | β3 | 12 | 0.2 | 8 |
| | β4 | 20 | 0.3 | 8 |
| | β5 | 28 | 0.3 | 8 |
| | β6 | 36 | 0.3 | 8 |
| | β7 | 45 | 0.4 | 4 |

Figure 68:
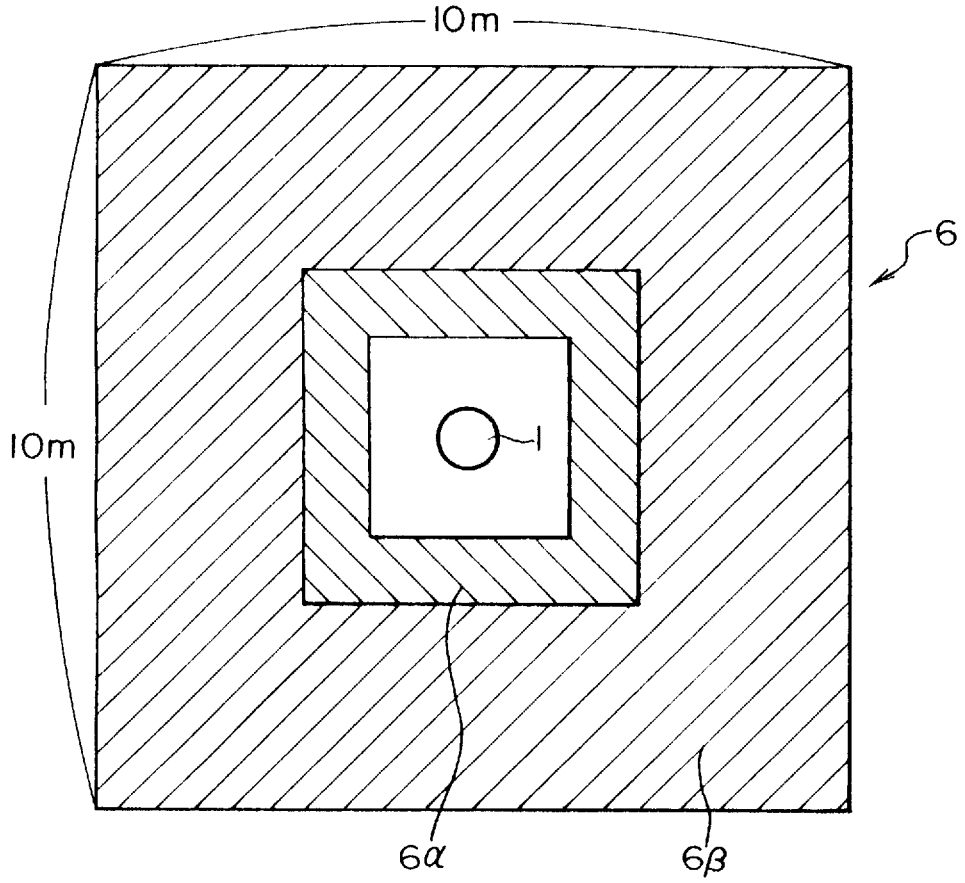
FIG. 68 is a plan view of a sprinkling area sprinkled with the sprinkler head shown in FIGS. 65 and 66.

Water sprinkling tests of the present sprinkler head 1 were carried out in the same manner as already described before by perpendicularly providing a liquid sprinkler with the present sprinkler head 1 at the center of a square sprinkling area 6, as shown in FIG. 68, 10 m×10 m, where diameter of the hemispherical part 1*a* was 5 cm, sprinkling water feed rate was about 11 l/min. and water pressure on the nozzles 2 was about 2 kg/cm$^2$.

Results are shown in FIG. 68, where the region sprinkled from the nozzles α1 to α6 is a hatched region α6 and the region sprinkled from the nozzles β1 to β7 is a hatched region β6. That is, the desired sprinkling area 6 could be sprinkled according to the desired . shape, that is, the desired square shape, by the present sprinkler head 1.

Figure 69:
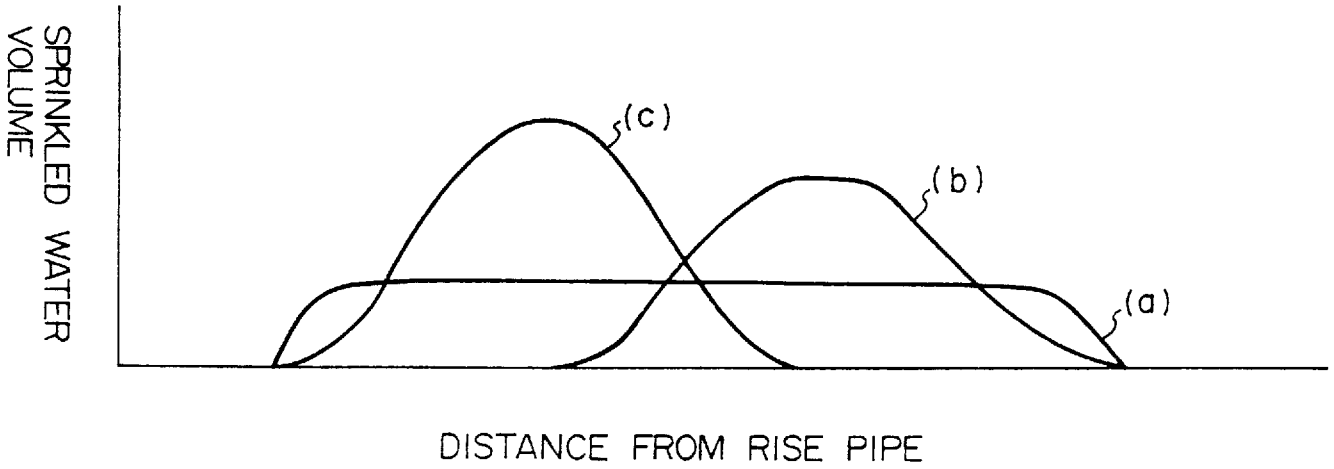
FIG. 69 is a profile of sprinkled water distribution in the sprinkling area of the sprinkler head shown in FIGS. 65 and 66 in relation to the distance from the rise pipe.

Sprinkled water volume per unit area was measured and is shown in FIG. 69, where the curve (a) shows the results of the present sprinkler head 1.

Water sprinkling tests were also carried out under the same conditions as above by conventional sprinkler heads each having only a nozzle for water sprinkling at an angle of nozzle elevation of 27° or 15°, but having an equal nozzle opening area to that of the present sprinkler head 1. The results are shown in FIG. 69, where the curve (b) shows results of the conventional sprinkler head having a nozzle at an angle of nozzle elevation of 27° and the curve (c) shows those with the conventional sprinkler head having a nozzle at an angle of nozzle elevation of 15°.

As is evident from FIG. 69, the present sprinkler head 1 can sprinkle water substantially uniformly all over the sprinkling area, whereas the conventional sprinkler heads suffer from variations in the sprinkled water volume per unit area, depending on distances from the rise pipe 11, that is, the sprinkled water volume per unit area is not uniform and there are zones not sprinkled with water. Thus, the conventional sprinkler heads cannot conduct uniform water sprinkling.

Maximum height of water droplets ejected from a nozzle at varied angles of nozzle elevation of the present sprinkler head 1 will be described below, referring to FIG. 70 and Table 5.

Figure 70:
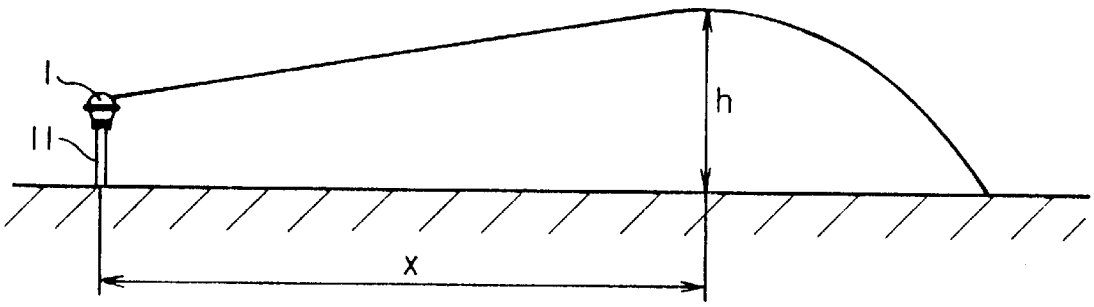
FIG. 70 is a profile showing a relationship between the angle of nozzle elevation of the sprinkler head shown in FIGS. 65 and 66 and the maximum height of sprinkled water droplets.

As shown in FIG. 70, a rise pipe 11 with a sprinkler head having a nozzle at a level as high as 0.33 m from the soil surface was perpendicularly provided on a sprinkling area and subjected to water sprinkling under a water pressure on the nozzle of 2 kg/cm$^2$. Angles of nozzle elevation, nozzle diameters, maximum height h of water droplets ejected from the nozzle, distance x from the rise pipe 11 to the point of the maximum height, and sprinkling water feed rate are shown in Table 5.

TABLE 5

| Angle of nozzle elevation (°) | Diameter (mm) | Maximum height h (m) | Distance x (m) | Water feed rate (ml/min.) |
|---|---|---|---|---|
| 27 | 0.4 | 1.65 | 3.1 | 105 |
| 27 | 0.6 | 1.8 | 4.1 | 210 |
| 27 | 0.8 | 1.8 | 4.7 | 350 |
| 60 | 0.4 | 3.6 | 2.6 | 105 |
| 60 | 0.6 | 4.2 | 3.7 | 210 |
| 60 | 0.8 | 4.6 | 4.0 | 350 |

As is evident from Table 5, there is no substantial difference in the distance x between the angle of nozzle elevation of 27° and that of 60°, when the nozzle diameters are equal to each other, but there is a large difference in the maximum height h. That is, the maximum height h is 1.65 m for a nozzle diameter of 0.4 mm, 1.8 m for a nozzle diameter of 0.6 mm and 1.8 m for a nozzle diameter of 0.5 mm at an angle of nozzle elevation of 27°. At an angle of nozzle elevation of 60°, on the other hand, the maximum height h is 3.6 m for a nozzle diameter of 0.4 mm, 4.2 m for a nozzle diameter of 0.6 mm and 4.6 m for a nozzle diameter of 0.8 mm. Thus, the maximum height h at an angle of nozzle elevation of 60° is at least twice as large as that at an angle of nozzle elevation of 27°.

Figure 67:
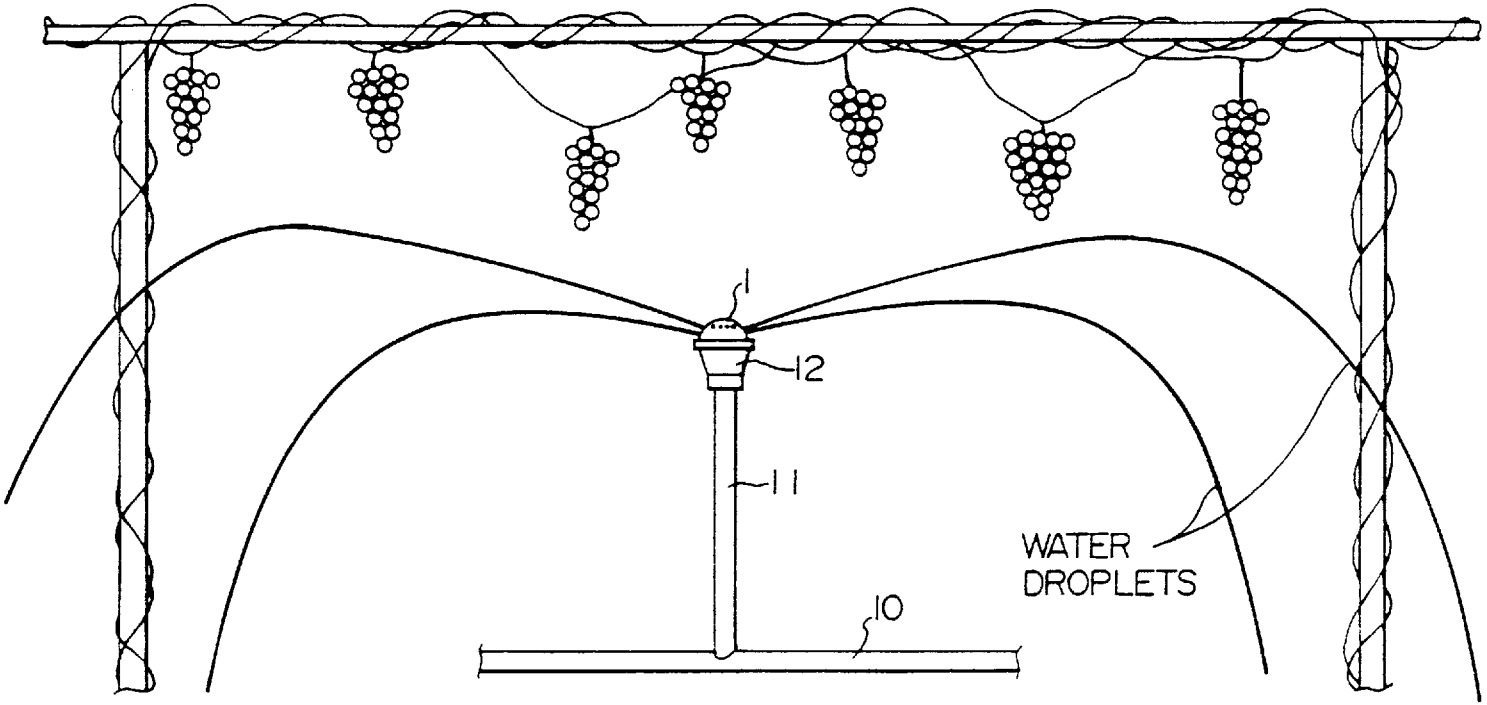
FIG. 67 is a schematic elevation view showing a liquid sprinkler with the sprinkler head shown in FIGS. 65 and 66 perpendicularly provided under grape vine trellises.
Figure 71:
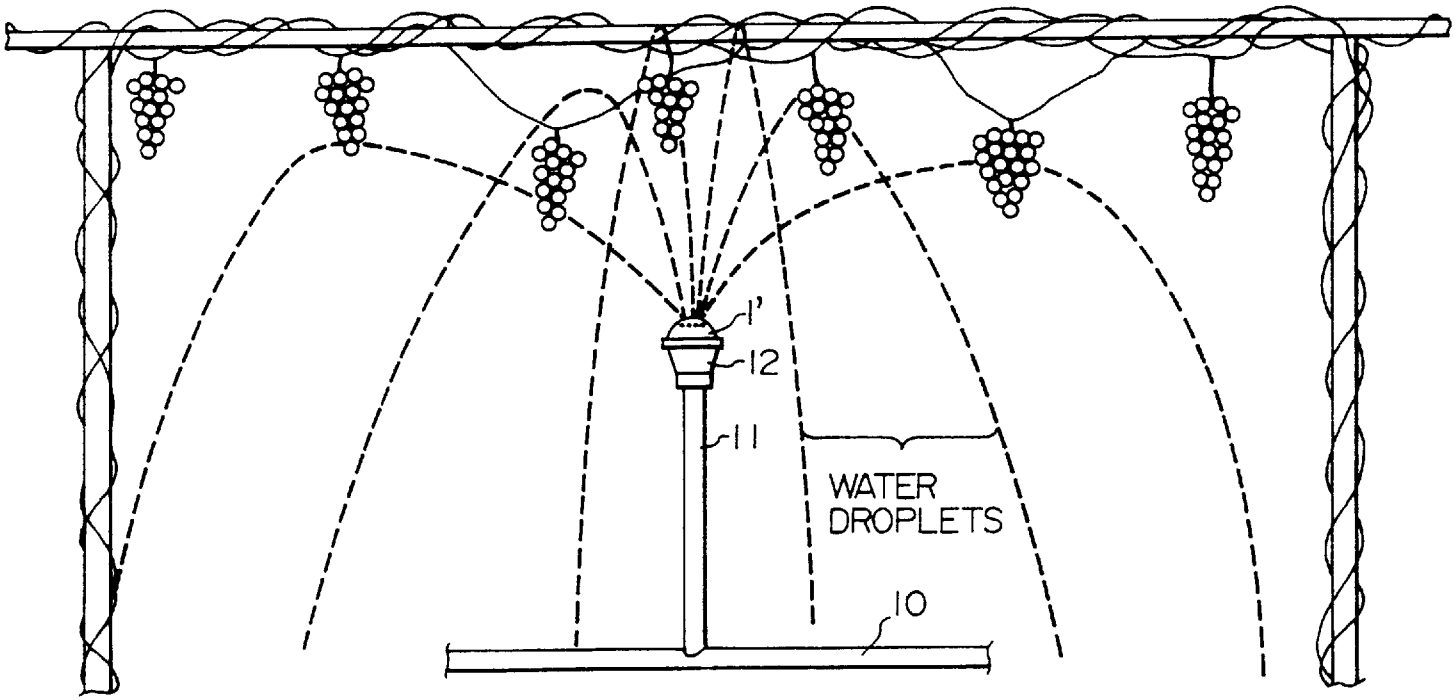
FIG. 71 is a schematic elevation view showing a liquid sprinkler with the conventional sprinkler head perpendicularly provided under grape vine trellises.

Since the angles of elevation of nozzles 2 on hemispherical part 1*a* are selected from a range of not more than 27° in the present embodiment, the water droplets ejected from the nozzles 2 can have a maximum height of about 1.8 m. Thus, even if the present liquid sprinkler is used in an orchard with the so called limitation to the sprinkling height, as shown in FIG. 67, water droplets are never attached to the overhead fruits, whereas in case of a comparative sprinkler head 1' having nozzles at an angle of elevation of, for example, 60°, as shown in FIG. 71, water droplets are attached to the overhead fruits.

Furthermore, total nozzle opening area of the nozzles 2 at the same angle of nozzle elevation is made to decrease with decreasing angle of nozzle elevation, whereby the sprinkled water volume per unit area can be made equal between a region of relatively short sprinkling distance, i.e. a region near the liquid sprinkler, and a region of relative long sprinkling distance, i.e. a region far from the liquid sprinkler, and more uniform water sprinkling can be conducted all over a sprinkling area.

In the foregoing embodiments, materials for the sprinkler head 1 are not particularly limited, and preferably are materials having a good weathering resistance, a high impact resistance, a good chemical resistance, etc. For example, metals, synthetic resins and synthetic rubber are preferable. Metals include, for example, stainless steel and synthetic resins include, for example, high density polyethylene, medium and low density polyethylenes, polypropylene, polyvinyl chloride, polyolefins such as ethylene-vinyl acetate copolymer, etc., acrylonitrile-butadiene-styrene resin (ABS resin), engineering plastics, reinforced plastics, etc. These materials can be selected in view of uses of the sprinkler head 1, that is, the sprinkler.

Process for preparing the sprinkler head 1 is not particularly limited, and a process suitable for mass production at a low production cost is preferable. For example, a press process is suitable for metals and an injection molding process is suitable for synthetic resins and synthetic rubber.

Procedure for forming nozzles 2 is not particularly limited, and a procedure suitable for mass production at a low production cost is preferable. For example, a laser perforation procedure or a drill perforation procedure is suitable.

Figure 72:
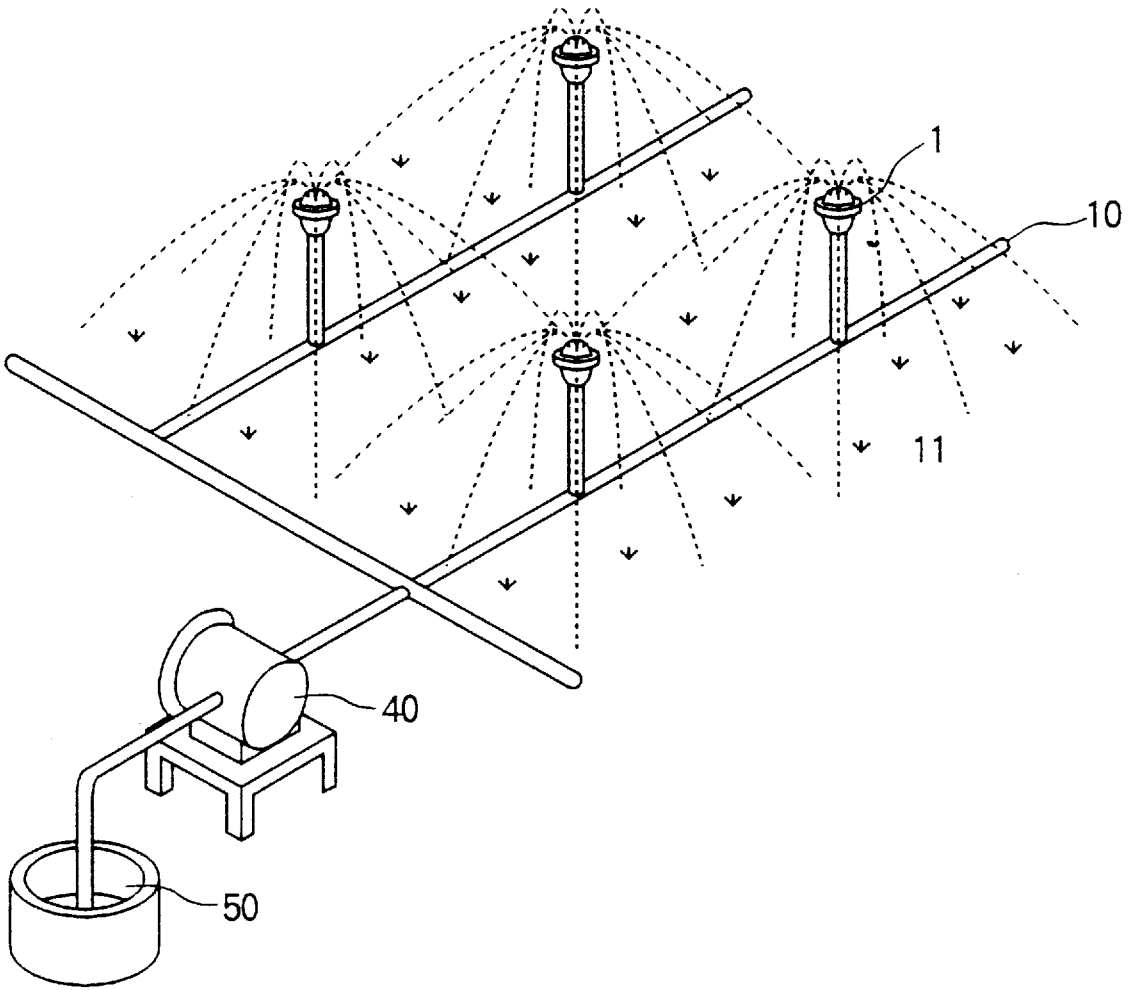
FIG. 72 is a schematic view showing application of the present liquid sprinklers in a sprinkling area.
Figure 73:
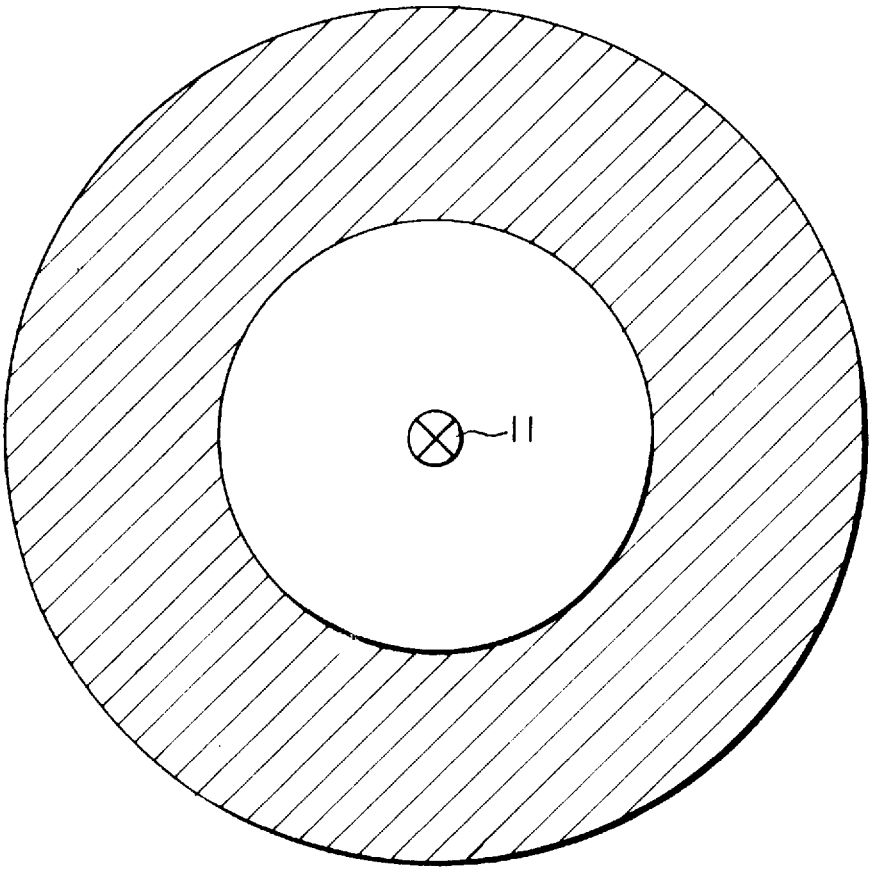
FIGS. 73 and 74 are a sprinkled region and an overlapped sprinkled region obtained by one and a plurality of conventional sprinklers, respectively.
Figure 74:
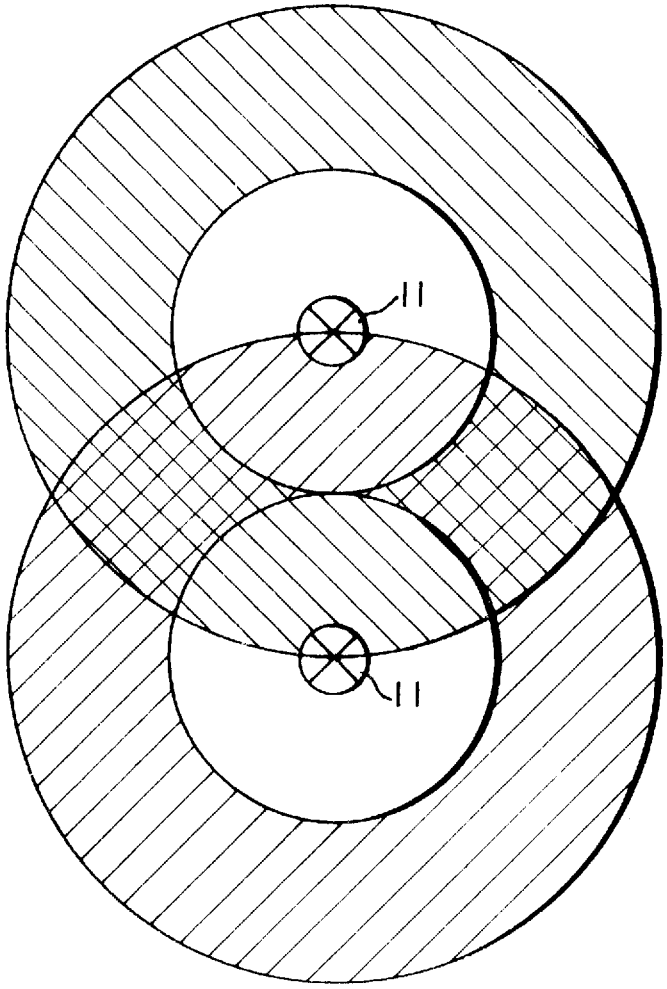

An example of using a plurality of the present liquid sprinklers is shown in FIG. 72, where numeral 40 is a pump and 50 a liquid storage tank.

The liquid sprinkler with the present sprinkler head can be used for sprinkling water to farms or gardens for outdoor raising of vegetables, flowers, etc. green house farms or gardens, orchards, parks or gardens planted with lawns or flowers, or to roads.

In the foregoing embodiments, the liquid sprinkler is limited to a water sprinkler, but the liquid to be sprinkled by the present liquid sprinkler is not limited only to water, but also solutions of agricultural chemicals such as insecticides, pesticides, etc. or liquid fertilers can be sprinkled by the present liquid sprinkler, when used in the agriculture, horticulture, etc. Furthermore, the present liquid sprinkler can be used for preventing salt damages due to spread sea water mists, or frost damage in tea gardens, etc.

What is claimed is:

1. A liquid sprinkler for sprinkling a desired soil area, said sprinkler comprising:

a rise pipe upstanding generally perpendicularly above said desired soil area;

an upwardly protruding sprinkler head at an upper end of said rise pipe, said head being of substantially hemispherical shape with a vertex on the surface thereof in substantial alignment with a central axis of said rise pipe; said substantially hemispherical shaped head having a symmetrical center lying on said central vertical axis;

a plurality of nozzle openings in said head arranged in a pattern in relation to said vertex, said nozzle openings having longitudinal axes which, when extended, project radially outward from said symmetrical center, said nozzle having a diameter selected from a range of 0.1 mm to 2 mm;

all the nozzle openings in said head which are spaced a greater distance from said vertex having a greater diameter than all nozzle openings positioned close to said vertex.

2. A liquid sprinkler according to claim 1, wherein the angle of elevation of said nozzle axes in relation to a line perpendicular to and passing through said vertical axis at said symmetrical center is selected from a range of 20° to less than 90°.

3. A liquid sprinkler according to claim 1, wherein a liquid pressure-changing means capable of changing the liquid pressure to a desired pressure is provided in a liquid supply pipe or the rise pipe.

4. A liquid sprinkler according to claim 1, wherein the sprinkler nozzles are formed along a plurality of imaginary lines intersecting at said vertex and extending substantially radially on the surface of the substantially hemispherical sprinkler head, and the nozzles formed along the same imaginary lines have increasing diameters with increasing distances of the nozzles from the vertex.

5. A liquid sprinkler according to claim 1, wherein the sprinkler head has the nozzles formed along first imaginary lines defined by the respective sides of a polygon surrounding the vertex of the substantially hemispherical sprinkler head, the first imaginary lines defined by the respective sides of the polygon being curved toward the substantially hemispherical sprinkler head, as viewed in a plan view of the substantially hemispherical sprinkler head from the vertex side, and also nozzles formed along second imaginary lines drawn in parallel to the first imaginary lines, but positioned from the first imaginary lines toward the vertex.

6. A liquid sprinkler according to claim 5, wherein the polygon is a rhombus.

7. A liquid sprinkler according to claim 5, wherein the nozzles formed on the same imaginary lines have an equal nozzle diameter.

8. A liquid sprinkler according to claim 1, wherein the sprinkler head is provided with a sprinkling-inhibiting member for inhibiting sprinkling of a liquid through other nozzles than those destined to the desired sprinkling area.

9. A liquid sprinkler according to claim 1, wherein the sprinkler head is provided with a sealing member for sealing clearances between the sprinkling-inhibiting member and the sprinkler head.

10. A liquid sprinkler for sprinkling a desired soil area, said sprinkler comprising:

a rise pipe upstanding generally perpendicularly above said desired soil area:

an upwardly protruding sprinkler head at an upper end of said rise pipe, said head being of substantially hemispherical shape with a vertex on the surface thereof in substantial alignment with a central vertical axis of said rise pipe; said substantially hemispherical shaped head having a symmetrical center lying on said central vertical axis;

a plurality of circular nozzle openings in said head arranged in a pattern in relation to said vertex, said nozzle openings have longitudinal axes, which, when extended, project radially outward from an extension of said vertical axis through said head and defining an angle of elevation between said symmetrical center and said extended longitudinal axes, said nozzle having a diameter selected from a range of 0.1 mm to 2 mm;

all the nozzle openings in said head which are oriented at a smaller angle to said symmetrical center having a greater diameter than all nozzle openings oriented at a greater angle to said symmetrical center.

* * * * *